US007592531B2

(12) United States Patent
Karakawa et al.

(10) Patent No.: US 7,592,531 B2
(45) Date of Patent: Sep. 22, 2009

(54) TONE GENERATION SYSTEM

(75) Inventors: Shuzo Karakawa, Hamamatsu (JP); Hiroyuki Oba, Hamamatsu (JP); Eiichiro Aoki, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 99 days.

(21) Appl. No.: 11/725,214

(22) Filed: Mar. 15, 2007

(65) Prior Publication Data

US 2007/0214945 A1 Sep. 20, 2007

(30) Foreign Application Priority Data

Mar. 20, 2006 (JP) ..... 2006-077533
Mar. 20, 2006 (JP) ..... 2006-077534
Mar. 20, 2006 (JP) ..... 2006-077535

(51) Int. Cl.
*G10H 1/00* (2006.01)

(52) U.S. Cl. ..... 84/600; 84/622; 84/659

(58) Field of Classification Search ..... 84/600–609, 84/622, 659
See application file for complete search history.

(56) References Cited

U.S. PATENT DOCUMENTS 5,563,359 A 10/1996 Okamura
5,867,497 A 2/1999 Fujimori et al.
6,153,820 A * 11/2000 Fujimori ..... 84/633
6,700,050 B2 * 3/2004 Sakurada et al. ..... 84/615
6,737,571 B2 * 5/2004 Furukawa ..... 84/610
6,822,153 B2 * 11/2004 Comair et al. ..... 84/609
7,089,333 B2 * 8/2006 Marinescu et al. ..... 709/248
7,189,911 B2 * 3/2007 Isozaki ..... 84/609
7,348,483 B2 * 3/2008 Puryear ..... 84/645
7,420,112 B2 * 9/2008 Juszkiewicz et al. ..... 84/600
2007/0214945 A1 * 9/2007 Karakawa et al. ..... 84/622

FOREIGN PATENT DOCUMENTS

JP 6289861 10/1994
JP 7287572 10/1995
JP 2003-323173 11/2003

* cited by examiner

*Primary Examiner*—David S. Warren
(74) *Attorney, Agent, or Firm*—Morrison & Foerster LLP

(57) ABSTRACT

Processor devices functioning as tone-generation-related processing elements, such as a keyboard, tone generator and speaker, are connected to a star-type network. Desired processing elements are logically connected (e.g., a keyboard is logically connected to the input side of the tone generator and a speaker is connected to the output side of the tone generator) in an internal network, so that a tone generation system can be built. Each processor device possesses a content file, and each of the processor devices has a table storing, for each of the processor devices, information indicating whether the content file possessed thereby can be supplied. If a particular one of the processor devices does not possess a content file to be used, the particular processor device extracts, from the table, another processor device capable of supplying the content file to be used and receives the content file from the extracted processor device.

11 Claims, 24 Drawing Sheets

| LOGICAL DEVICE ID | IP ADDRESS | (PHYSICAL DEVICE ID) | DEVICE NAME | (PROCESSING ID) | PROCESSING ELEMENT NAME | VOICE FILE SUPPLY | SUBJECT OF LOAD DISTRIBUTION |
|---|---|---|---|---|---|---|---|
| No.1 | 192.168.111.1 | (01) | SV | (AA) | SERVER | X | X |
| No.2 | 192.168.111.2 | (02) | TG1 | (AB) | TONE GENERATOR | O | O |
| No.3 | 192.168.111.3 | (03) | TG2 | (AB) | TONE GENERATOR | X | X |
| No.4 | 192.168.111.4 | (04) | KB | (AC) | KEYBOARD | X | X |
| No.5 | 192.168.111.5 | (05) | SP1 | (AD) | SPEAKER | X | X |
| No.6 | 192.168.111.6 | (06) | SP2 | (AD) | SPEAKER | X | X |
| No.7 | 192.168.111.7 | (07) | DU | (AE) | DSP UNIT | X | X |
| | | | | (AF) | MIXER | X | O |
| No.8 | 192.168.111.8 | (08) | MX | (AF) | MIXER | X | O |
| No.9 | 192.168.111.9 | (09) | CR | (AG) | CONTENT RECORDER | O | X |
| No.10 | 192.168.111.10 | (10) | AA | (AH) | AUTO. ACCOMPANIMENT | X | O |
| No.11 | 192.168.111.11 | (11) | MR | (AI) | MIDI RECORDER | X | O |
| No.12 | 192.168.111.12 | (12) | ED | (AJ) | EDITOR | X | X |
| No.13 | 192.168.111.13 | (13) | EF | (AK) | EFFECTOR | X | O |
| No.14 | 192.168.111.14 | (14) | AR | (AL) | AUDIO RECORDER | X | O |
| No.15 | 192.168.111.15 | (15) | SY | (AB) | TONE GENERATOR | O | O |
| No.16 | 192.168.111.15 | (15) | SY | (AC) | KEYBOARD | X | X |
| No.17 | 192.168.111.16 | (16) | MC | (AM) | MICROPHONE | X | X |
| No.18 | 192.168.111.17 | (17) | CD | (AN) | CD PLAYER | X | X |
| ⋮ | ⋮ | ⋮ | | ⋮ | | | |

FIG. 3

| SUBJECT | INPUT CONNECTION | OUTPUT CONNECTION |
|---|---|---|
| (AA) SERVER | × | × |
| (AB) TONE GENERATOR | (AC) KEYBOARD | (AD) SPEAKER |
| | (AH) AUTO. ACCOMPANIMENT | (AK) EFFECTOR |
| | (AI) MIDI RECORDER | (AL) AUDIO RECORDER |
| | (AJ) EDITOR | (AF) MIXER |
| (AC) KEYBOARD | × | (AB) TONE GENERATOR |
| | | (AG) MIDI RECORDER |
| | | (AJ) EDITOR |
| (AD) SPEAKER | (AB) TONE GENERATOR | × |
| | (AF) MIXER | |
| | (AK) EFFECTOR | |
| | (AL) AUDIO RECORDER | |
| | (AM) MICROPHONE | |
| | (AN) CD PLAYER | |
| ⋮ | ⋮ | ⋮ |

CONNECTION BUFFER

| | |
|---|---|
| ● CASE OF SY1 KEYBOARD | OUTPUT 1 → SY2 TONE GENERATOR → SY1 SPEAKER |
| ● CASE OF SY2 TONE GENERATOR | INPUT 1 ← SY1 KEYBOARD<br>INPUT 1 → OUTPUT 1<br>OUTPUT 1 → SY2 SPEAKER |

CURRENT BUFFER

| | | |
|---|---|---|
| ● CASE OF SY1 | KEYBOARD | PORT 1 : OUTPUT → SY2 TONE GENERATOR |
| | TONE GENERATOR | |
| | SPEAKER | PORT 2 : INPUT ← SY2 TONE GENERATOR |

| | | |
|---|---|---|
| ● CASE OF SY2 | TONE GENERATOR | PORT 1 : INPUT ← SY1 KEYBOARD |
| | | PORT 1 → PORT 2 |
| | | PORT 1 → PORT 3 |
| | | PORT 2 : OUTPUT → SY1 SPEAKER |
| | | PORT 3 : OUTPUT → SY2 SPEAKER |
| | SPEAKER | PORT 3 : INPUT ← SY2 TONE GENERATOR |

FIG. 15

TONE GENERATION SYSTEM

BACKGROUND OF THE INVENTION

The present invention relates to a tone generation system composed of a plurality of processor devices connected to a network.

So-called MIDI (Musical Instrument Digital Interface) technique has heretofore been known, via which a plurality of musical instruments are connected with each other to constitute an electronic musical instrument network system. The MIDI standard is a common standard for transmitting automatic performance data etc., which allows performance data, such as a key code, to be transmitted, in a single direction, from a given one of a plurality of electronic musical instruments distributed in a network to another one of the electronic musical instruments. With the MIDI technique, each MIDI message is in the form of serial data and MIDI lines are wired so as to connect between the instruments in series, so that the MIDI lines would occupy a considerable space. Further, if any one of the MIDI lines is disconnected even at one point by accident or by error, no signal can be delivered beyond that point any longer, which would result in unwanted termination of tone generation. Further, once any one of the MIDI lines is disconnected, wiring operation for restoring the connection would become very cumbersome and laborious.

Therefore, "mLAN" (musical Local Area Network) has been proposed as a musical instrument system using a network (e.g., Japanese Patent No. 3271493). The mLAN is a technique for transmitting digital audio/MIDI data using the IEEE1394 standard, which permits communication of digital audio data or MIDI data of 256 channels or over by connecting between AV devices and/or electronic devices and a computer system via an IEEE1394 interface. The mLAN defines commands for, for example, controlling individual AV devices and/or electronic devices and corporation among the devices on the basis of the "IEC61833-6 Audio and Music Data Transmission Protocol" that is a protocol for communicating audio/MIDI data via the IEEE1394 interface. With such an mLAN, complicated connections between a plurality of devices, which used to be made using analog cables. MIDI cables, etc., can be replaced with daisy-chain connections of IEEE 1394 cables, to thereby greatly simplify the connections between the devices.

In a case where the aforementioned conventional electronic musical instrument does not possess a requested tone color (i.e., voice file), it has been conventional for the electronic musical instrument to generate a tone using another tone color as a substitute for the requested tone color (see, for example, Japanese Patent Application Laid-open Publication No. SHO-59-197090). It has also been known that a recording medium, such as a CD-ROM or floppy disk, having a tone color recorded therein, is inserted into the conventional electronic musical instrument to add the tone color (see, for example, Japanese Patent Application Laid-open Publication No. HEI-8-76752).

However, because the mLAN is in the form of daisy-chain connections, physically connecting a new device to a desired point of the network and then performing logical connection setting would involve extremely difficult operation. Further, because lines are wired to connect the individual devices in series, the lines would occupy a considerable space. Further, if any of the lines is disconnected even at a single point by accident or by error, no signal can be delivered beyond that point any longer, which would result in unwanted termination of tone generation. Furthermore, once any of the lines is disconnected, wiring operation for restoring the connection would become very cumbersome and laborious.

Further, the "LAN" (Local Area Network) has been known as a network capable of connecting a new device to a desired point. The LAN is a computer network, such as an intranet, installed within a relatively limited area, and in recent years, such a LAN is built in an ordinary house as well. However, there presently exists no tone generator or other tone-generation-related device that can be connected directly to a LAN, and it has so far been impossible to build a musical instrument system using an ordinary form of network, such as a LAN. Further, if a tone of a desired tone color that is not possessed by a musical instrument is generated by the musical instrument using another tone color as a substitute for the desired tone color, there would arise the problem that the tone can not be generated with the exact tone color, because the tone color used is just a substitute. If, in such a case, a recording medium so far inserted in the musical instrument is replaced with another recording medium in accordance with the tone color to be used, then medium-replacing operation tends to be cumbersome, and a user has to remember which tone colors are recorded in which recording media.

Furthermore, if it is desired to build a musical instrument system using an ordinary network such as a LAN, tone-generation-related devices, such as a keyboard, tone generator and speaker, are logically connected via the network. In this case, logical connections are made in accordance with requested logical connection states. But, if a requested connected-to (i.e., destination) tone-generation-related device is incapable of establishing a new connection, the requested logical connection can not be made. Thus, in such a case, the user has to repeat operation for setting the requested logical connection so as to find an alternative connectable tone-generation-related device, and such operation tends to be cumbersome and complicated, leading to an increased burden on the user.

Furthermore, the logical connection states established in the aforementioned manner are canceled by logging off from the network, and, at next logon, the logical connections will be established through connection-establishing setting operation performed again. Because the same connection states set last time are often carried over as connection states to be established next, it is conceivable to restore, at the time of logon, the connection states that were being maintained till immediate before the last logoff. However, if, at the time of logon, any client that was being connected to the network till immediately before the last logoff is no longer present in the network or has a different construction than that immediately before the last logoff, then no connection can be made to the desired client, so that the last-set connection states can not be restored. As a consequence, the tone generation system can not be restored completely as intended by the user. If the client restored to such an incomplete connection state is logged off, the incomplete connection state would be undesirably restored at the time of next logon.

SUMMARY OF THE INVENTION

In view of the foregoing, it is an object of the present invention to provide an improved tone generation system which can use an ordinary network, such as a LAN, to physically connect processor devices, functioning as a tone generator and various other types of tone-generation-related devices, to desired points of the network and thereby perform logical connection setting with an increased ease, and which can generate a tone with a tone color as close to a requested tone color as possible without requiring a particular recording medium.

It is another object of the present invention to provide an improved tone generation system which, if a requested connection-destination (i.e., connected-to) processing element is incapable of establishing a new connection when the system uses an ordinary network, such as a LAN, to physically connect processor devices, functioning as a tone generator and various other types of tone-generation-related devices, to desired points of the network, can automatically change the connection destination to another available processing element.

It is still another object of the present invention to provide an improved tone generation system which is build using an ordinary network, such as a LAN, to physically connect processor devices, functioning as a tone generator and various other types of tone-generation-related devices, to desired points of the network, and which can restore any user-intended connection state at the time of logon.

In order to accomplish the above-mentioned objects, the present invention provides a tone generation system composed of a plurality of processor devices connected to a star-type network, individual ones of the processor devices being arranged to function as processing elements corresponding to respective programs executed, the tone generation system comprising at least: a first processor device functioning as a performance-information-generating processing element that creates a frame including generated performance information and respective identification information of a source processing element and destination processing element and transmits the created frame to the network; a second processor device functioning as a tone-generator-providing processing element that receives a frame matching identification information of the processing element functioning in the second processor device, synthesizes a tone signal on the basis of performance information taken out from the received frame, creates a frame including the synthesized tone signal and respective identification information of a source processing element and destination processing element and transmits to the network the frame created thereby; and a third processor device functioning as a sounding processing element that receives a frame matching identification information of the processing element functioning in the third processor device and performs a sounding process on a tone signal taken out from the received frame. Here, two or more such processor devices each possess a content file related to tone generation, and each of the processor devices has a table storing, for each of the processor devices, information indicating whether the content file possessed thereby can be supplied to another one of the processor devices. Further, each of the processor devices is adapted to: receive a request for selecting a content file; determine whether or not a content file corresponding to the received request is possessed thereby; and, if the content file corresponding to the received request is not possessed thereby, extract, from the table, any other processor device capable of supplying the content file corresponding to the received request, transmits an acquisition request of the content file to the extracted other processor device via the network, and receive, via the network, the content file transmitted by the other processor device in response to the acquisition request.

The tone generation system of the present invention is composed of a plurality of processor devices connected to a star-type network, and the processor devices are arranged to function as processing elements corresponding to respective programs executed. Each of the processor devices is constructed in such a manner that, if it does not possess a content file corresponding to a received request (i.e., requested content file), it refers to the table, storing information indicating whether the content file possessed thereby can be supplied to another one of the processor devices, and extracts, from the table, the other processor device capable of supplying the requested content file, and then acquires the requested content file from the extracted processor device. As a consequence, each of the processor devices can acquire, using an ordinary network like a LAN, a requested content file (e.g., tone color data file) from another processor device (i.e., client) resident in the network; thus, each of the processor devices can acquire a necessary content file (e.g., tone color data file) with an extremely high probability. Further, by merely connecting a processor device, possessing a new content file (e.g., tone color data file), to the network, the system allows each of the processor devices to use the new content file. Further, because each of the processor devices can use the table, provided therein, to search for another processor device (i.e., client) capable of supplying a desired content file (e.g., tone color data file), it can promptly access a target processor device (client) to acquire a desired content file (e.g., tone color data file) even when the number of the processor devices (clients) connected to the network has considerably increased.

According to another aspect of the present invention, there is provided a tone generation system composed of a plurality of processor devices connected to a star-type network, individual ones of the processor devices being arranged to function as processing elements corresponding to respective programs executed, the tone generation system comprising at least first to third processor devices arranged in a similar manner to the aforementioned first to third processor devices, which further comprises: a connection selection device operable, in response to operation by a user, to not only select a plurality of processing elements and set a logical connection between the selected processing elements but also select a processor device to function as a processing element in the set logical connection; and a control device that, 1) if the selected processor device is in a state incapable of establishing a new connection, determines whether the selected processor device may be replaced with another processor device, 2) if the selected processor device may be replaced with another processor device, searches for another processor device capable of functioning as the same processing element as the selected processor device does, and 3) if the searched-out other processor device is in a state capable of establishing a new connection, determines the searched-out other processor device as the processor device to function as the processing element in the set logical connection in place of the selected processor device.

When a plurality of processing elements are selected and a logical connection is to be made therebetween, and if the selected connection-destination (i.e., connection-partner or connected-to) processing element is in a state incapable of establishing a new connection, the control device determines whether the selected connection-destination (or connection-partner) processor device may be replaced with another processor device. If the selected connection-partner processor device may be replaced with another processor device, the control device searches for another processor device capable of functioning as the same processing element as the selected connection-partner processor device. Further, if the searched-out other processor device is in a state capable of establishing a new connection, the control device establishes the searched-out other processor device as an alternative connection partner. In this way, the present invention permits automatic switching to an appropriate processor device and can eliminate an extra time and effort on the part of the user to find a connectable processor device. Further, determining in advance whether or not the selected processor device may be replaced with another processor device is very advantageous particularly in a case where the selected processor device is a device having unique characteristics, such as a speaker element. The speaker element, for example, has the characteristic that a tone output from the speaker element and heard by a person present in a particular position will greatly differ if the installed position of the speaker element is changed, even though the function of the speaker element remains the same. Namely, if the speaker element used in the tone generation system is switched from a speaker installed in a certain position over to a speaker installed in another position, then the sounding position shifts so that the user will be unable to hear a tone in a predetermined position any more. Thus, in the case of a processing element which may become unable to reflect a user's intention if it is automatically connected to another processor device, the control device determines in advance whether the selected processor device may be replaced with another processor device, to thereby prevent automatic switching and establishment of a connection to another or alternative processor device.

According to still another aspect of the present invention, there is provided a tone generation system composed of a plurality of processor devices connected to a star-type network, individual ones of the processor devices being arranged to function as processing elements corresponding to respective programs executed, the tone generation system comprising at least first to third processor devices arranged in a similar manner to the aforementioned first to third processor devices, which further comprises, the further comprising: a connection control device that sets a logical connection between the processing elements, establishes a connection between the processor devices to function as the processing elements in the set logical connection, and thereby builds a signal path for tone generation in the tone generation system; a default memory that is provided for each of the processor devices and stores default information indicative of logical connections between one or more processing elements the processor device is functioning as and one or more processing elements in the network; and a restoration control device that, when any one of the processor devices has logged into the network, automatically restores logical connections between one or more processing elements of the processor device having logged into the network and one or more processing elements in the network on the basis of the default information stored in the default memory of the processor device having logged into the network, the restoration control device determining, for each of the processing elements of the processor device having logged into the network, whether or not another processing element, selected as a connection partner to be connected with the processing element, is available and then restoring only the logical connection to the available processing element.

In response to any one of the processor devices logging into the network, logical connections between one or more processing elements of the processor device having logged into the network and one or more processing elements in the network are automatically restored on the basis of the default information, indicative of states of logical connections, stored in the default memory of the processor device having logged into the network. With user-desired connection states prestored as default information, it is possible to automatically restore the user-desired connection states at the time of login on the basis of the default information. Also, at that time, a determination is made, for each of the processing elements of the processor device having logged into the network, as to whether or not another processing element, selected as a connection partner to be connected with the processing element, is available or usable, and only the logical connection to each processing element having been determined to be available is restored. Thus, if part of the logical connections, indicated by the default information, can not be restored, only the achievable part of the logical connections is automatically restored, with the result that default-based automatic restoration is permitted with an enhanced flexibility.

Here, the default memory may be arranged in such a manner that, when the logical connection building the signal path has been changed in the connection control device in response to operation by the user, it stores information indicative of a state of the changed logical connection to thereby update the default information stored therein. Also, the default memory may be arranged in such a manner that the default information stored in the default memory is not updated when a logical connection is automatically restored by the restoration control device, on the basis of the default information, in response to any one of the processor devices logging into the network. In this way, information indicative of a state of the logical connection changed (set) in response to operation by the user is stored into the default memory as default information; thus, user-desired logical connection states can be stored as default information. Thus, at next login, the user-desired logical connection states can be automatically restored on the basis of the default information. The default information stored in the default memory is not updated when the logical connections are automatically restored on the basis of the default information, and thus, even when connection states have been restored in an incomplete manner (i.e., only part of the connection states has been restored) at the time of login, the default information in the default memory can be prevented from being updated with information of such incomplete logical connection states, so that the previous user-desired logical connection states can be kept stored as the default information. Further, even when the connection states have been restored in an incomplete manner (i.e., only part of the connection states has been restored) at the time of login, the incomplete logical connection states can be appropriately restored to the user-desired complete logical connection states if the user logs in again after performing a necessary adjustment to make available each other client (processor device) having so far been unavailable; namely, the user-desired complete logical connection states can be restored now that all of the processing elements are available).

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which:

FIG. 3 is a diagram showing a device table indicative of correspondence among various identification information of all processing elements resident on an internal network shown in FIG. 1;

FIG. 15 is a diagram showing examples of connection information and association among processing elements recorded in a current buffer in the tone generation system of the present invention;

DETAILED DESCRIPTION OF THE INVENTION

Figure 1:
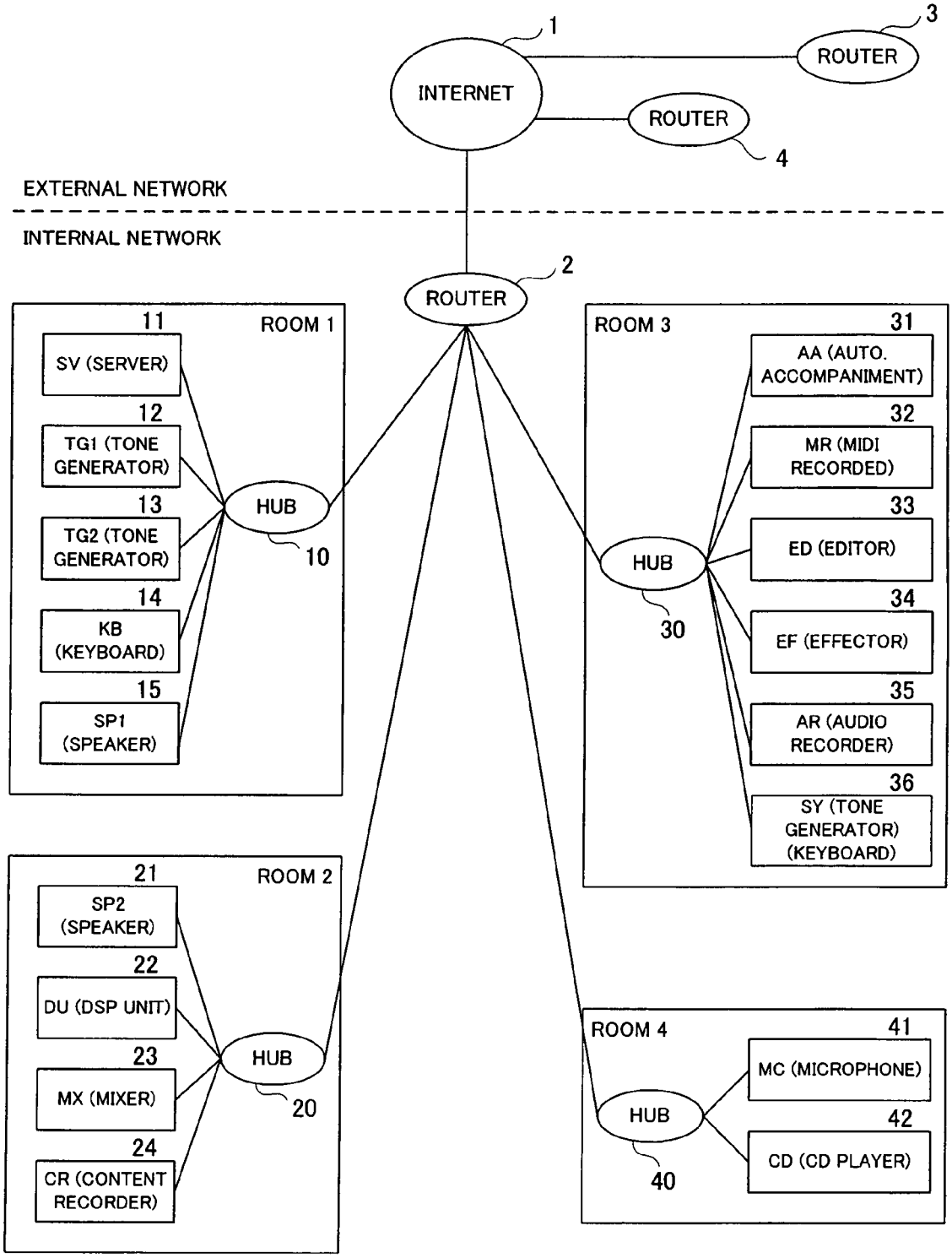
FIG. 1 is a block diagram showing an example setup of a tone generation system in accordance with an embodiment of the present invention.

FIG. 1 is a block diagram showing an example setup of a tone generation system in accordance with an embodiment of the present invention.

As shown in FIG. 1, the tone generation system includes an internal network connectable to an external network. The internal network is in the form of a LAN, such as Ethernet. The internal network includes a router 2, and hubs 10, 20, 30 and 40 connected to a plurality of LAN terminals of the router 2 via LAN cables. The internal network is a star-type network built across four rooms, i.e. Room 1, Room 2, Room 3 and Room 4. WAN terminal of the router 2 is connected to the Internet 1, and routers 3 and 4 connected to other networks are also connected to the Internet 1. Thus, the internal network is connectable, via the router 2 and Internet 1, to the other networks that are connected with the routers 3 and 4.

In Room 1, there are installed several devices, such as a SV (server) 11, TG1 (tone generator) 12, TG2 (tone generator) 13, KB (keyboard) 14 and SP1 (speaker) 15. These devices are provided with network adaptors to function as LAN devices. Upstream LAN terminal of the hub 10 provided in Room 1 is connected with a LAN terminal of the router 2 via a LAN cable, and a plurality of downstream LAN terminals of the hub 10 are connected, via LAN cables, with respective LAN terminals of the network adaptors of the SV (server) 11, TG1 (tone generator) 12, TG2 (tone generator) 13, KB (keyboard) 14 and SP1 (speaker) 15.

In Room 2, there are installed several devices, i.e. SP2 (speaker) 21, DU (DSP unit) 22, MX (mixer 23) and CR (content recorder) 24. These devices are provided with network adaptors to function as LAN devices. Upstream LAN terminal of the hub 20 provided in Room 2 is connected with the LAN terminal of the router 2 via a LAN cable, and a plurality of downstream LAN terminals of the hub 20 are connected, via LAN cables, with LAN terminals of the respective network adaptors of the SP2 (speaker) 21, DU (DSP unit) 22, MX (mixer 23) and CR (content recorder) 24.

In Room 3, there are installed several devices, i.e. AA (automatic accompaniment device) 31, MR (MIDI recorder) 32, ED (editor) 33, EF (effector) 34, AR (audio recorder) 35 and SY (tone generator/keyboard) 36. These devices are provided with network adaptors to function as LAN devices. Upstream LAN terminal of the hub 30 provided in Room 3 is connected with the LAN terminal of the router 2 via a LAN cable, and a plurality of downstream LAN terminals of the hub 30 are connected, via LAN cables, with LAN terminals of the respective network adaptors of the AA (automatic accompaniment device) 31, MR (MIDI recorder) 32, ED (editor) 33, EF (effector) 34, AR (audio recorder) 35 and SY (tone generator/keyboard) 36.

Further, in Room 4, there are installed a plurality of devices, i.e. MC (microphone) 41 and CD (CD player) 42. These devices are provided with network adaptors to function as LAN devices. Upstream LAN terminal of the hub 40 provided in Room 4 is connected with the LAN terminal of the router 2 via a LAN cable, and a plurality of downstream LAN terminals of the hub 40 are connected, via LAN cables, with LAN terminals of the respective network adaptors of the MC (microphone) 41 and CD (CD player) 42.

Each of the devices installed in Room 1-Room 4 and connected to the internal network in the tone generation system, except for the DU (DSP unit) 22, is provided with at least a CPU (Central Processing Unit), RAM (Random Access Memory) and ROM (Read-Only Memory) and corresponding hardware. Namely, each of the devices in the tone generation system of the present invention performs a particular function as represented by the name of the device, through execution of a program corresponding to the name of the device. Namely, the aforementioned devices, except for the DU (DSP unit) 22, in the tone generation system of the present invention are processor devices (computers) capable of performing various programs. Hereinafter, the functions performed by the processor devices executing the corresponding programs are defined as "processing elements". Namely, the SV (server) 11, TG1 (tone generator) 12, TG2 (tone generator) 13, KB (keyboard) 14 and SP1 (speaker) 15 installed in Room 1, the SP2 (speaker) 21, MX (mixer 23) and CR (content recorder) 24 installed in Room 2, the AA (automatic accompaniment device) 31, MR (MIDI recorder) 32, ED (editor) 33, EF (effector) 34, AR (audio recorder) 35 and SY (tone generator/keyboard) 36 installed in Room 3 and the MC (microphone) 41 and CD (CD player) 42 installed in Room 4 are all processing elements, and the processor devices function as the processing elements by executing the corresponding programs.

The SV (server) 11 is a computer that supplies a client computer with a function and various data possessed thereby, and the client computer is a processor device where any one of the above-mentioned processing elements is functioning. Further, the DU (DSP unit) 22 is a processor device provided with a multiplicity of DSPs and can function as any one of processing elements, such as a mixer, editor and effector, by the DSPs executing corresponding microprograms. Namely, the DU (DSP unit) 22 can switch the processing element that should function to another processing element, by selecting and executing the microprograms corresponding to the other processing element.

The processing elements will be explained below in more detail. The TG1 (tone generator) 12 and TG2 (tone generator) 13 function as tone generator elements by the processor devices executing corresponding tone generator programs. The KB (keyboard) 14 functions as a keyboard element by the processor device, provided with a hardware keyboard, executing a keyboard program. The SP1 (speaker) 15 and SP2 (speaker) 21 function as speaker elements by the processor devices, provided with hardware speakers, executing speaker programs. The MX (mixer) 23 functions as a mixer element by the processor device executing a mixer program. The CR (content recorder) 24 functions as a content recorder element by the processor device, provided with a large-capacity storage device, executing a recorder program. The AA (automatic accompaniment) 31 functions as an automatic accompaniment element by the processor device executing an automatic accompaniment program. The MR (MIDI recorder) 32 functions as a MIDI recorder element by the processor device, provided with a large-capacity storage device, executing a recorder program. The ED (editor) 33 functions as an editor element by the processor device executing an editor program. The EF (effector) 34 functions as an effector element by the processor device executing an effector program. The AR (audio recorder) 35 functions as an audio recorder element by the processor device, provided with a large-capacity storage device, executing a recorder program. The SY (tone generator/keyboard) 36 functions as both a tone generator element and a keyboard element by the processor device, provided with a hardware keyboard, executing a ton generator program and keyboard program. The MC (microphone) 41 functions as a microphone element by the processor device, provided with a hardware microphone, executing a microphone program. Further, the CD (CD player) 42 functions as a CD player element by the processor device, provided with a hardware CD drive, executing a player program.

Through communication, data can be exchanged between the SV (server) 11 and the DU (DSP unit) 22 or any of the processing elements and between the processing elements. In the illustrated example, the SV (server) 11 and the aforementioned processing elements support the TCP/IP (Transmission Control Protocol/Internet Protocol) and perform data-exchanging communication using the TCP/IP protocol.

In the internal network, every information transmitted via the LAN cable is put in a packet of a predetermined length called "MAC frame". The MAC frame has an IP packet capsulated therein, and a preamble for a reception section to find the beginning of the MAC frame and a check code for examining the validness of the contents of the MAC frame are attached to the beginning and end, respectively, of the frame.

Further, a MAC address (i.e., Media Access Control address), indicative of a transmission source and transmission destination, is included in a header of the MAC frame. The MAC address is a unique number assigned to each network interface means; in the case of the Ethernet standard, each MAC address consists of 48 bits. Further, each MAC frame is transmitted in accordance with the well-known CSMA/CD. Each node (processor device) constantly monitors MAC frames on the cable and receives each MAC frame if the MAC frame is a frame addressed to that note or broadcast frame. The CSMA/CD stands for a "Carrier Sense Multiple Access/with Collision Detection" scheme, according to which each data-transmitting node (processor device) constantly monitors a communication state by detecting a carrier wave of the cable in question and starts the transmission when the communication state is "vacant". If a plurality of nodes (processor devices) start transmission simultaneously, data destruction may result due to collision between the data; thus, when a data collision has been detected, the data transmission is resumed after waiting for a random time period.

According to the OSI reference model of the TCP/IP, which is a communication protocol, the "IP" corresponds to a third layer (network layer) while the "TCP" corresponds to a fourth layer (transport layer). The TCP layer supplies an upper-level processing element (application) with a communication function with reliable full-duplex flow control, using a datagram-oriented communication function by the IP layer. In this way, data transmitted by a transmitting end can be received accurately by a receiving end with no data omission, duplication or error in the same order as they were transmitted from the transmitting end. Namely, a packet sent by the transmitting end may be lost due to characteristics of the IP layer and lower-level physical transmission medium, data order in the packet may be changed due to a delay, or the packet may be received in duplicate due to retransmission. Thus, it has been conventional to secure a communication path, reliable to processing elements in question, by the TCP, by elimination of the aforementioned adverse influences. Individual bytes of data to be transmitted and received using the TCP are assigned serial numbers called "sequence numbers", and whether or not data omission or duplication has occurred is checked using the sequence numbers. Receiving end, having received the data, returns an ACK (Acknowledgment) to the transmitting end to inform up to which sequence number it has received the data, so that the transmitting end can confirm that the data has accurately reached the receiving end. If, in such a case, no ACK has been returned from the receiving end after passage of a predetermined time, the transmitting end determines that the packet has been lost on its way or has not been received by the receiving end and then performs retransmission control to retransmit the same packet. Such arrangements permit highly-reliable communication. The waiting time before the start of the retransmission is not fixed but dynamically varied depending on conditions, such as the time length before the returning of the ACK and number of retransmissions; in this manner, the waiting time is highly controlled to permit efficient communication.

The tone generation system of the present invention is constructed by combining the processing elements functioning in a plurality of processor devices connected to the internal network shown in FIG. 1. For example, to build a tone generation system where performance data output from the KB (keyboard) 14 are supplied to the TG1 (tone generator) 12 and tone waveform data generated by and output from the TG1 (tone generator) 12 on the basis of the performance data are supplied to the SP1 (speaker) 15, setting is performed to logically connect between the KB (keyboard) 14 and the TG1 (tone generator) 12 and between the TG1 (tone generator) 12 and the SP1 (speaker) 15. Namely, such a tone generation system can be build by combining the processing elements that are functioning in a plurality of processor devices connected to the internal network. Namely, a tone generation system can also be build by logically connecting between the KB (keyboard) 14, the tone generator function of the SY (keyboard/tone generator) 36 and the SP2 (speaker) 21. In such a case, it is possible to impart an effect to tone waveform data and mix a plurality of sets of tone waveform data, by further logically connecting the EF (effector) 34 and MX (mixer) 23.

Figure 2:
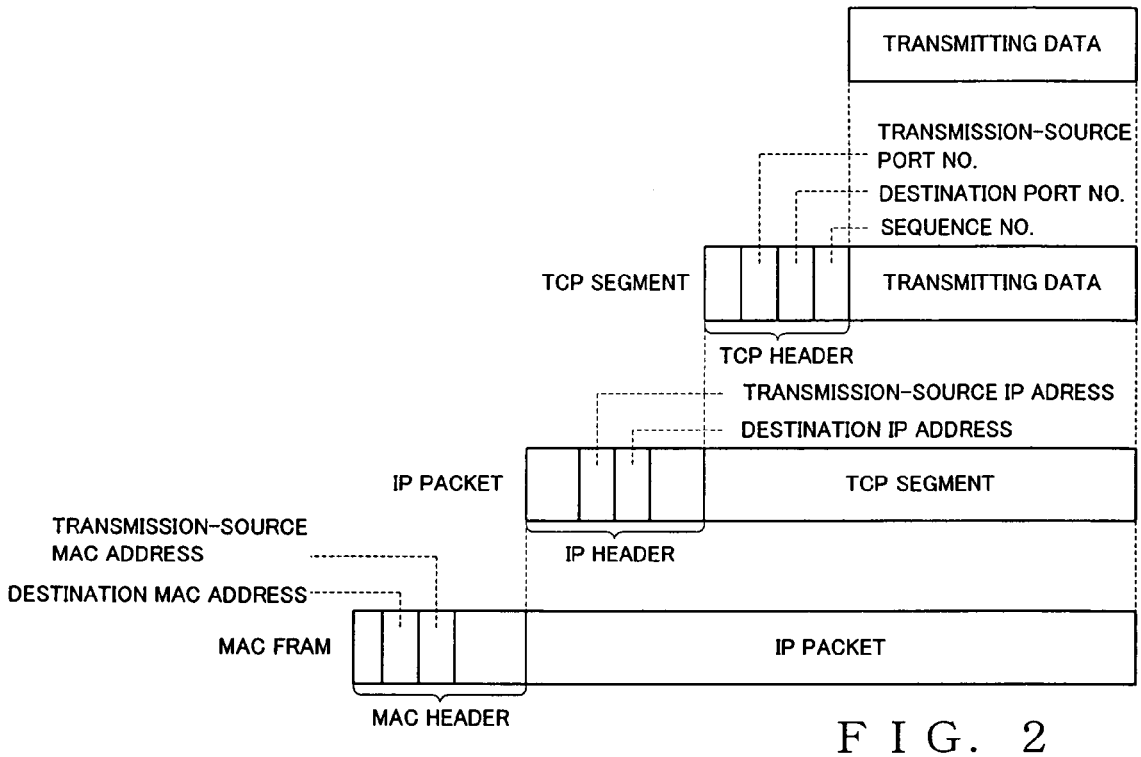
FIG. 2 is a diagram outlining a process for generating a MAC frame to be output to a network in the tone generation system of the present invention.

As set forth above, the processing elements functioning in the individual processor devices can be logically connected via the IAN, so that data can be exchanged or communicated between the logically-connected processing elements. For example, where the KB (keyboard) 14 and TG1 (tone generator) 12 are logically connected with each other, performance data output from the KB (keyboard) 14, which is a processing element, can be communicated to the TG1 (tone generator) 12 which is another processing element. In such a case, performance data output in a packet from the KB (keyboard) 14 can be received by the TG1 (tone generator) 12, through communication between the KB (keyboard) 14 and the TG1 (tone generator) 12 using the TCP/IP. FIG. 2 is a diagram outlining a process in accordance with which a MAC frame is generated by a processing element at a transmitting end and output from the transmitting end to the network.

As illustrated in FIG. 2, data output from the processing element of the transmitting end are divided into transmitting data each having a predetermined length, and a TCP segment is generated in the TCP layer by attaching a TCP header to the beginning of the transmitting data of the predetermined length. The TCP header includes a sequence number, port number of the processing element of the transmitting-end (i.e., transmitted-from or transmission-source) processing element and port number of a processing element of a receiving-end (i.e., transmitted-to or transmission-destination). IP packet is generated in the IP layer by attaching an IP header to the beginning of the TCP segment. The IP header includes IP addresses of the transmission source and transmission destination, and also includes data indicative of a packet length, protocol number, etc. although not specifically shown. The IP address is a specific identification number uniquely assigned to each individual processor device connected to the internal network and external network including the Internet; in the case of "IPv4", the IP address is in the form of numeric values of a total of 32 bits consisting of four 8-bit groups, more specifically four decimal numerals in the range of 0-255, like "192.168.100.8". MAC header is attached to the beginning of the IP packet, in a data link layer and physical layer, to generate a MAC frame. The MAC header includes a specific transmission-source MAC address uniquely assigned to the transmission-source processor device, and a specific destination MAC address uniquely assigned to the transmission-destination processor device. The thus-generated MAC frame is sent out from the transmission-source processor device to the LAN cable and received by the processor device of the address matching the destination MAC address of the MAC frame, so that the transmitting data is passed to the processing element identified by the IP address and port number. Namely, the port number is a sub-address of the IP address, and the processing element is identifiable by a combination of the IP address and port number. Thus, even for a single processor device where a plurality of processing elements are functioning, like the SY (tone generator/keyboard) 36, a MAC frame can be passed to each processing element through identification based on the combination of the IP address and port number.

FIG. 3 is a diagram showing a device table indicative of correspondence among various identification information of all processing elements resident on the internal network shown in FIG. 1. The device table shown here contains information of all of the processing elements functioning in the processor devices included in a broadcast domain. The device table is created by the SV (server) 11, and the same device table (i.e., same contents) is recorded into all of the processor devices on the internal network. When any of the processor devices connected to the internal network has been changed, the contents of the device table are updated by the SV (server) 11, and the thus-updated device table is transmitted from the SV (server) 11 to all of the processor devices on the internal network. Each of the processor devices connected to the internal network receives the device table and records therein the received device table.

In the device table shown in FIG. 3, "logical device IDs" correspond to the port numbers of the processing elements, and a unique or different logical device ID is assigned to each of the processing elements. "IP addresses" are each a specific identification number uniquely assigned to each one of the processor devices connected to the internal network and external network including the Internet. When any one of the processor devices has logged into the network, a DHCP (Dynamic Host Configuration Protocol) server assigns one previously-prepared IP address to the processor device. The router 2 typically becomes such a DHCP server, although the SV (server) 11 or any one of the processor devices too may become the DHCP server. "physical device IDs" are each a specific number uniquely assigned to one network device and corresponds to a MAC address; in the illustrated example of FIG. 3, the physical device ID is a specific number uniquely assigned to each processor device on the internal network. Device name is an abbreviated name of a processor device where a processing element is functioning.

"Processing ID" correspond to a port number of one of the processing elements, and a unique or different processing ID is assigned to each of the processing elements; these processing IDs may be dispensed with because the logical device IDs alone suffice. "Processing Element Name" is a name of the tone-generation-related device implemented by one of the processing elements. For the "DSP unit" of processing device ID "No. 7", for example, the device table has recorded therein a processing ID and processing element name of a preset processing element corresponding to microprograms to be executed because the DSP unit functions in the processing element. Processing element "tone generator" of logical device ID "No. 15" and processing element "keyboard" of logical device ID "No. 16" are assigned the same IP address and same physical device ID because they are processing elements functioning in the same processor device; however, these two processing elements are assigned different logical device IDs (port numbers) so that they can be handled independently of each other. "Voice File Supply" is information indicating whether or not a voice file can be supplied to the outside; if a voice file can be supplied, "○" is recorded as the voice file supply, while, if a voice file can be supplied, "X" is recorded as the voice file supply. In this case, "X" is recorded in each processor device having no voice file, and, X" is recorded even in a processor device having a voice file if the processor device is inhibited from sending the voice file to the outside. Whether or not transmission of a voice file to the outside is to be permitted may be set as desired by the user or creator of the voice file. "Subject of Load Distribution" is information whether the processing element in question can become a subject of load distribution; if the processing element can become a subject of load distribution, "○" is recorded as the subject of load distribution, while, if the processing element can become a subject of load distribution, X" is recorded as the subject of load distribution. What can become a subject of load distribution is limited to each processing element that can perform a user-intended process even of the process is entrusted to another processor device. The "load" means a load imposed on the CPU in the processor device implemented by software processing (via the CPU). Thus, each processor device implementing a processing element by software can become a subject of load distribution, but each processor device implementing a processing element only by hardware can not become a subject of load distribution. As will be detailed later, the "Voice Files" are stored in a voice memory possessed by at least one processor device within the system. Content files that can be "subjects of voice supply" in the present invention are not limited to voice files and may be any tone-generation-related content files.

In the processor devices of the tone generation system of the present invention, various programs capable of functioning as the aforementioned various processing elements are stored in their storage means, such as hard disk devices. By the processor device selecting and executing any of the programs stored in the storage means, one processing element functioning in the processor device can be switched to another processing element. In this case, any one processor device can simultaneously execute a plurality of programs can function as a plurality of processing elements. When a particular processing element to be caused to function in the processor device has been selected, the program corresponding to the selected processing element is set into the processor device for execution, and the processing element in question is registered into the SV (server) 11 so that the logical device ID (port number) is set for the processing element. Then, the device table having been updated in the SV (server) 11 is transmitted to and recorded into all of the processor devices on the internal network.

Data communicated between the processing elements in the tone generation system of the present invention are classified into two types, i.e. substantive data and control data. Here, data that are directly indicative of contents of music to be reproduced and that are to be communicated preferentially in real time are defined as the substantive data. More specifically, MIDI data and audio data (PCM and MP3 data) are examples of the substantive data. The other data than these substantive data are defined as the control data. Transmission/reception (i.e., communication) of the control data can be performed by all of the processor devices including the SV (server) 11.

Figures 4, 5:
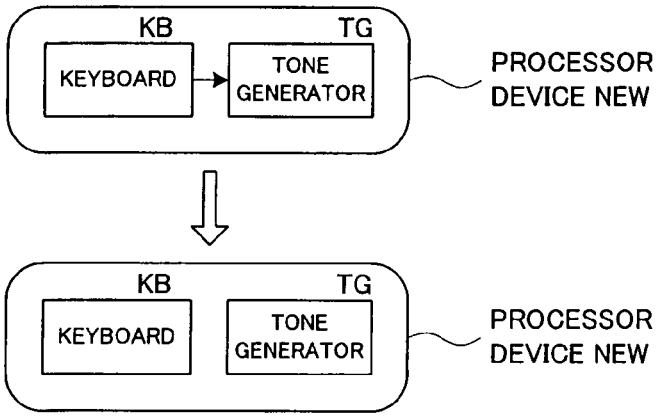
FIG. 4 is a diagram showing a connection table having recorded therein connections at inputs and outputs of individual processing elements resident on the internal network and capable of communication of substantive data.
FIG. 5 is a diagram showing part of network connection processing in the tone generation system of the present invention.

FIG. 4 shows a connection table having recorded therein connections with other processing elements at the input and output (i.e., input and output connections) of each individual processing element resident on the internal network and capable of substantive data communication. The connection table is created by the SV (server) 11, and the same device table (i.e., same contents) is recorded into all of the processor devices resident on the internal network. In this connection table, there is recorded information about each of the processing elements functioning in the processor devices connectable to the internal network shown in FIG. 1. Each of the processor devices connected to the internal network obtains the connection table from the SV (server) 11 and records therein the obtained connection table.

FIG. 4 shows only a part of the connection table pertaining to some of the processing elements on the internal network organized in the manner as shown in FIG. 1. In the connection table, "X" indicates that there is no connectable processing element; thus, it is indicated that the server of processing ID "AA" (i.e., SV (server)) does not perform substantive data transmission/reception. The server here is the SV (server) 11 of FIG. 1. Tone generator element of processing ID "AB" is connectable at its input with processing elements that transmit performance data, such as MIDI data, as the substantive data and connectable at its output with processing elements that receive audio data as the substantive data. Namely, the tone generator element of processing ID "AB" is connectable at its input with a keyboard element of processing ID "AI", automatic accompaniment element of processing ID "AH", MIDI recorder element of processing ID "AI" and editor element of processing ID "AJ", and the tone generator element of processing ID "AB" is connectable at its output with a speaker element of processing ID "AD", effector element of processing ID "AK" and audio recorder element of processing ID "AL". Further, a keyboard of processing ID "AC" is connectable at its output with processing elements that receive performance data, such as MIDI data, as the substantive data, but not connectable at its input with any processing element because of its nature. Namely, the keyboard of processing ID "AC" is connectable at its output with the tone generator element of processing ID "AB", MIDI recorder element of processing ID "AI" and editor element of processing ID "AJ". Further, the speaker of processing ID "AD" is connectable at its input with processing elements that transmit audio data, but not connectable at its output with any processing element because of its nature. Namely, the speaker of processing ID "AD" is connectable at its input with the tone generator element of processing ID "AB", mixer element of processing ID "AF", effector element of processing ID "AK", audio recorder element of processing ID "AL", microphone element of processing ID "AM", CD player element of processing ID "AN", etc. Namely, the connection table indicates, per processing element, other processing elements connectable with the input and output (i.e., input-connectable and output-connectable processing elements) of the processing element, and the user can select any desired ones of such input-connectable and output-connectable processing elements with reference to the connection table.

Figure 6:
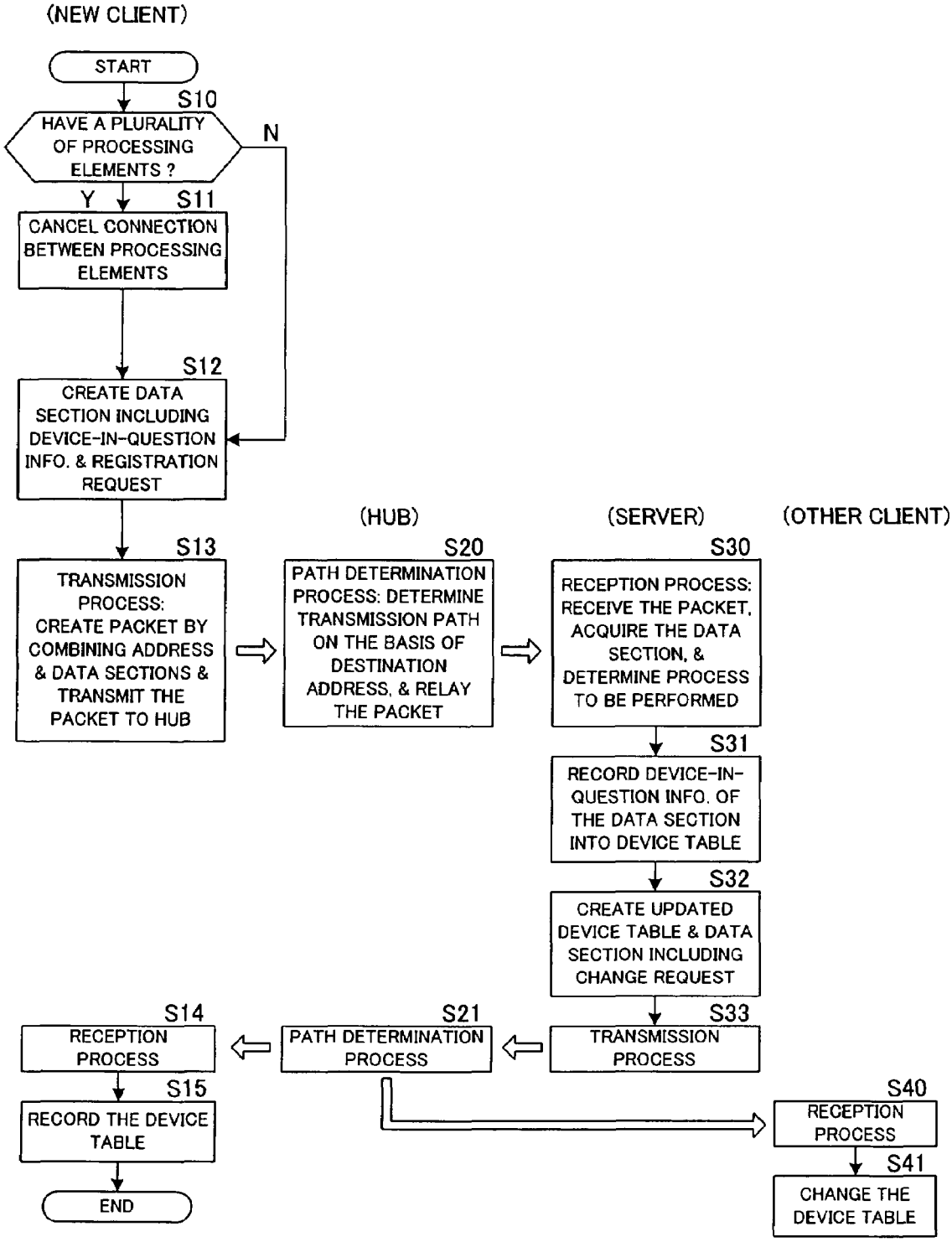
FIG. 6 is a flow chart of the network connection processing performed when a processor device has been newly connected to (logged into) the internal network in the tone generation system of the present invention.

FIG. 6 is a flow chart of network connection processing performed when a given processor device has been newly connected to (logged into) the internal network of the tone generation system shown in FIG. 1. Here, the term "client" represents a client of the SV (server) 11, and all of the other processor devices than the SV (server) 11, resident in the network, can be clients, and control data are communicated between each of the clients and the SV (server) 11 using the IP address of the destination processor device and predetermined port number for the control data.

Once the instant network connection processing is started up, a determination is made, at step S10, as to whether the newly-connected client has a plurality of processing elements. If the newly-connected client is currently functioning as the keyboard element KB and tone generator element TG by executing a keyboard program and tone generator program, like a processor device NEW indicated in an upper section of FIG. 5, and the keyboard element KB and tone generator element TG are connected in such a manner that MIDI data generated by the keyboard element KB are supplied to the tone generator element TG, then a YES determination is made at step S10, so that the instant processing goes on to step S11 in order to disconnect or cancel the internal connection between the keyboard element KB and the tone generator element TG as illustrated in a lower section of FIG. 5. Thus, in the processor device NEW where the plurality of processing elements are functioning, the connection between the processing elements are automatically disconnected upon logon; with such an arrangement, operation for disconnecting the connection in advance before the logon can be omitted. After completion of the operation of step S11 or if the newly-connected client does not have a plurality of processing elements as determined at step S10, the processing jumps to step S12 in order to create a data section including device-in-question information (i.e., information indicative of the newly-connected device) and registration request. The device-in-question information includes the logical device IDs of all of the processing elements in the processor device, IP address (having been assigned to the new client by the DHCP server when the client logged into the internal network), physical device ID and processing IDs and names of all of the processing elements in the newly-connected device. The registration request is a request for registration of the device-in-question information into the device table located in the SV (server) 11. At following step S13, a transmission process is performed, where the data section created at step S12 is formed into transmitting data, a MAC frame is formed with the transmitting data ultimately capsulated therein as illustrated in FIG. 2 and the thus-formed MAC frame is then transmitted to the internal network. In the MAC header of the MAC frame, the MAC address (physical device ID) of the SV (server) 11 is set as a destination MAC address.

Because the internal network is constructed as a "star" type network, the MAC frame transmitted from the new client is received by one of the hubs, and a path determination process is performed by the hub (step S20). In the path determination process, the hub determines a transmission path, on the basis of the destination MAC address of the received MAC frame, to relay the MAC frame. When the new client has been physically connected to the hub 30, for example, the hub 30 relays the received MAC frame to the router 2, then the router 2 relays the MAC frame to the hub 10, and thence the hub 10 relays the MAC frame to the SV (server) 11. In this manner, the MAC frame transmitted from the new client is received by the SV (server) 11 of the address matching the destination MAC address, and the SV (server) 11 carries out a reception process on the MAC frame (step S30). In the reception process, the IP packet is taken out from the MAC frame, then the TCP segment is taken out from the IP packet, and thence the data section is taken out from the TCP segment. Then, the SV (server) 11 reads the data section and judges, because of the registration request present in the data section, that a registration request process is to be performed. At next step S31, the SV (server) 11 records, into the device table, the device-in-question information of the data section. At following step S32, the SV (server) 11 creates an updated device table and data section including a change request requesting that the device table be changed or updated. The thus-created data section is transmitted from the SV (server) 11 to the internal network through a transmission process performed at step S33. This transmission process is similar to the transmission process of step S13 above, except that an "all-one" broadcast address (FF-FF-FF-FF-FF-FF) is set as the destination MAC address and a broadcast address is set as the destination IP address too. If the network address of the internal network address is set at "192.168.111.0" as in the device table of FIG. 3, the broadcast address of the IP address is set to "192.168.111.255".

The MAC frame broadcast by the SV (server) 11 is then received by the hub 10, and the hub 10 performs a path determination process (step S21). The path determination process of step S21 is similar to the path determination process of step S20 above; however, at step S21, the MAC frame is relayed, via the router 2 and hubs 10-40, to all of the processor devices because the MAC frame has been set to the broadcast address. Upon receipt of the broadcast MAC frame, the new client performs a reception process on the MAC frame of the broadcast address at step S14 in a similar manner to step S30 above. At next step S15, the device table information, taken out from the received MAC frame, is stored into an internal storage means of the new client. After that, the network connection processing in the new client is brought to an end. The other client performs a reception process on the MAC frame of the broadcast address at step S40 in a similar manner to step S30 above. In the reception process of step S40, the device table, stored in its internal storage means, is updated at step S41 with the device table information taken out from the received MAC frame. After that, the network connection processing in the other client is brought to an end. In this way, all of the clients connected to the internal network can have the device table of FIG. 3 constantly updated. The SV (server) 11 may broadcast not only the device table but also the connection table to all of the clients connected to the internal network.

Figure 7:
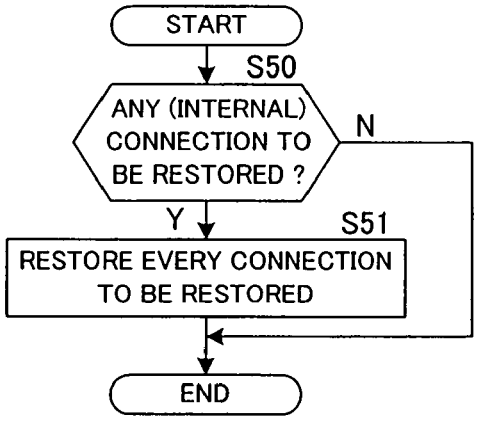
FIG. 7 is a flow chart of network disconnection processing performed when a processor device has been disconnected from (logged off) the internal network in the tone generation system of the present invention.

FIG. 7 is a flow chart of network disconnection processing performed when any one of the processor devices connected to the internal network has been disconnected (logged off) from the internal network.

Figure 8:
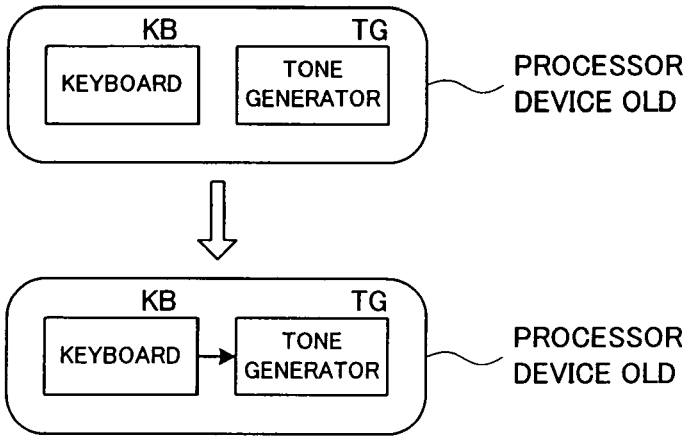
FIG. 8 is a diagram showing part of the network disconnection processing in the tone generation system of the present invention.

Once any one of the processor devices so far connected to the internal network has been disconnected (logged of), the network disconnection processing is started up. First, a determination is made, at step S50, as to whether the disconnected processor device has a plurality of processing elements and has any connection to be restored between the plurality of processing elements. If it has been determined at step S50 that the disconnected processor device has a plurality of processing elements and has any (internal) connection to be restored like a processor device OLD shown in an upper section of FIG. 8, the processing goes to step S51, where every connection to be restored between the plurality of processing elements is restored. For example, in the case of the processor device OLD having the keyboard element KB and tone generator element TG as illustrated in the upper section of FIG. 8, the keyboard element KB and tone generator element TG are internally connected with each other, as illustrated in a lower section of FIG. 8, so that MIDI data generated by the keyboard element KB can be supplied to the tone generator element TG. After completion of the operation of step S51 or with a NO determination at step S50, the network disconnection processing is brought to an end. Thus, in the processor device OLD where the plurality of processing elements are functioning, the connection between the processing elements is automatically restored at the time of logoff so that the processing elements may be used without particular operation being performed for reconnecting between the processing elements. Whereas the processing elements are internally connected with each other using, for example, API (Application Program Interface), they may be interconnected externally through logical connection using the respective port numbers assigned to the processing elements.

The SV (server) 11 periodically performs a client check process for checking presence of clients on the internal network, and, when any disconnected client has been detected through the client check process, it deletes the information of the disconnected client from the device table, to thereby update the device table. Then, the SV (server) 11 broadcasts the thus-updated device table to all of the clients, so that the device table stored in each of the clients can be updated with the updated device table broadcast from the SV (server) 11.

Figure 9:
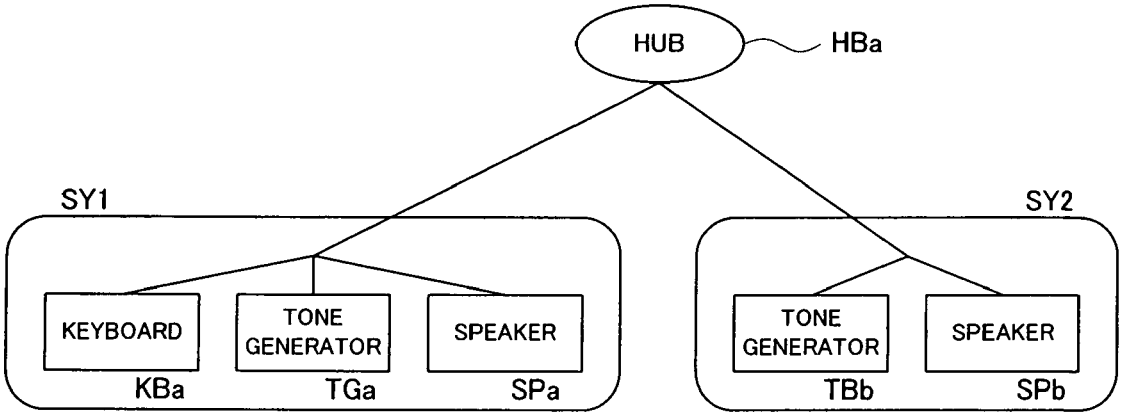
FIG. 9 is a block diagram showing an example setup of the internal network in the tone generation system of the present invention.
Figure 10:
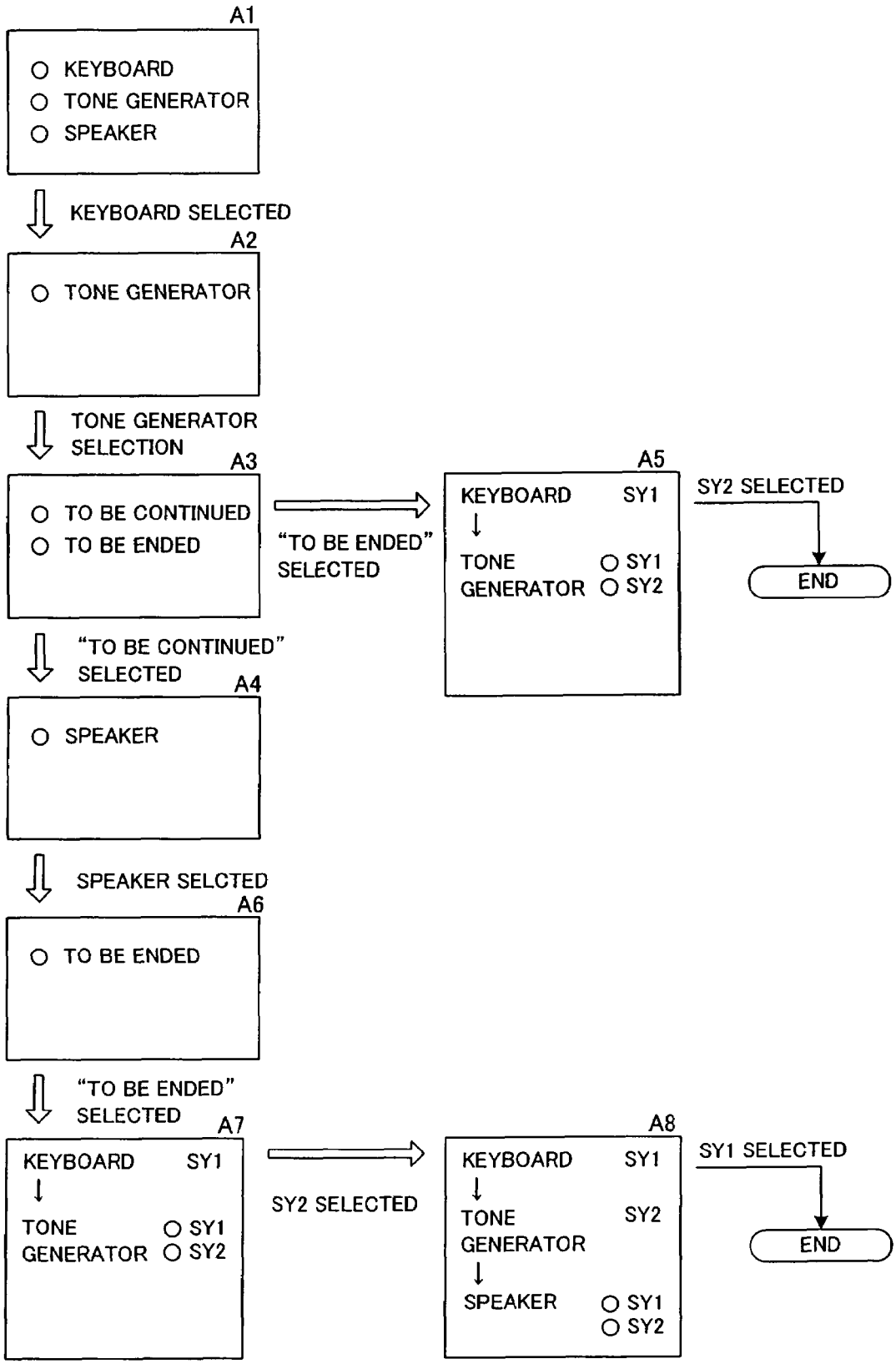
FIG. 10 is a diagram showing examples of setting screens displayed when connections are to be made between processing elements in the tone generation system of the present invention.
Figure 11:
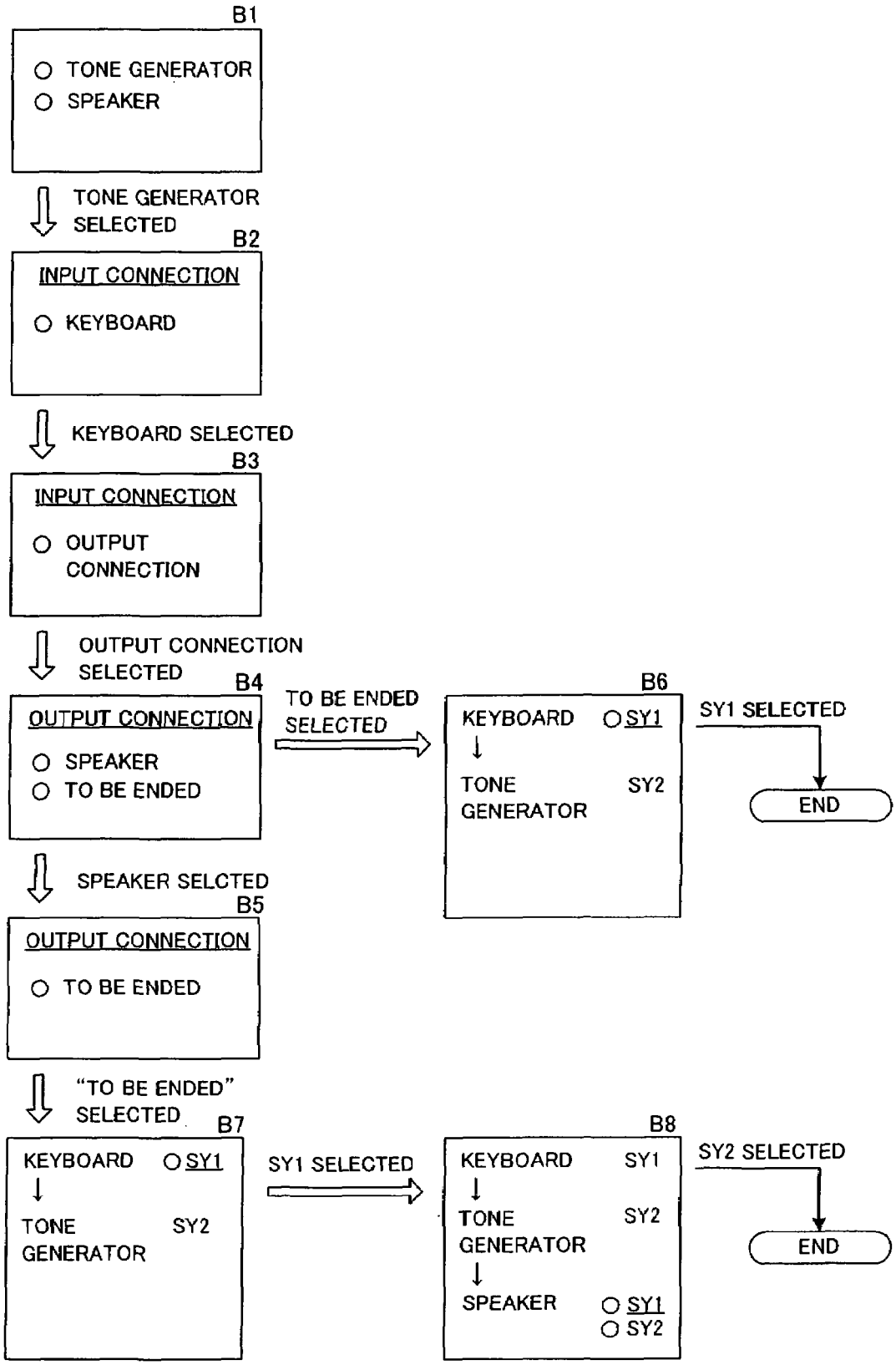
FIG. 11 is a diagram showing other examples of the setting screens displayed when connections are to be made between processing elements in the tone generation system of the present invention.

FIGS. 10 and 11 show setting screens displayed when a connection process is to be performed for setting a connection between processing elements. Here, the setting screens are displayed when the internal network is of a simplified construction as illustrated in FIG. 9.

In the internal network of FIG. 9, a processor device SY1 where a plurality of processing elements are functioning is connected to a hub HBa via a LAN cable, and a processor device SY2 where a plurality of processing elements are functioning is connected to the hub HBa via a LAN cable. More specifically, a keyboard element KBa, tone generator element TGa and speaker element SPa are functioning in the processor device SY1, and a tone generator element TBb and speaker element SPb are functioning in the processor device SY2. In each of the processor devices SY1 and SY2, the connections between the aforementioned processing elements are logically separate from each other, and connecting selection. Namely, in each of the processor devices SY1 and SY2, where the plurality of processing elements are functioning in the aforementioned manner, connection selection can be set independently for each of the processing elements. Here, a description will be given about a case where connection selection setting is performed from the keyboard element KBa. In this case, a connection selection process is started in the processor device SY1, upon which a screen A1 shown in FIG. 10 is displayed on a display of the processor device SY1. The screen A1 displays the three processing elements functioning in the processor device SY1, i.e. keyboard element KBa, tone generator element TGa and speaker element SPa, via which the user can select any desired one of the displayed processing elements as a processing element for which connection setting is to be performed. If the keyboard element KBa is selected on the screen A1 as the processing element for which connection setting is to be performed, a screen A2 shown in FIG. 10 is displayed on the display of the processor device SY1.

The screen A2 displays each processing element that is resident on the internal network of FIG. 9 and connectable with the selected processing element, i.e. keyboard element KBa, via which the user can select any desired one of the displayed connectable processing elements. Such processing elements resident on the internal network of FIG. 9 and connectable with the selected processing element are displayed here with reference to the device table and connection table. In this case, the device table has recorded therein the keyboard element KBa, tone generator element TGa, speaker element SPa, tone generator element TBb and speaker element SPb. Because no processing element is connectable with the input of the keyboard element KBa (i.e., the keyboard element KBa has no input connection function), the connection table has recorded therein only each processing element connectable with the output of the keyboard element KBa. Because, on the internal network, only the tone generator element is connectable with the output of the keyboard element KBa, only such an "output-connectable" tone generator element is displayed on the screen A2. Once the output-connectable tone generator element is selected on the screen A2, another screen A3 shown in FIG. 10 is displayed on the display of the processor device SY1. The screen A3 is a screen for the user to make a selection as to whether the processing element connectable with the selected processing element, i.e. tone generator element, is to be further connected (i.e., "to be continued") or not (i.e., "to be ended"). If the user selects "to be continued", still another screen A4 shown in FIG. 10 is displayed on the display of the processor device SY1. The screen A4 displays processing elements that are connectable with the output of the selected processing element, i.e. tone generator keyboard element, and that are resident on the internal network of FIG. 9, via which the user can select any desired one of the displayed connectable processing elements.

Such connectable processing elements resident on the internal network of FIG. 9 are detected with reference to the device table and connection table. In this case, the device table has recorded therein the keyboard element KBa, tone generator element TGa, speaker element SPa, tone generator element TBb and speaker element SPb. Because only the speaker element is connectable with the output of the tone generator element, only such a speaker element is displayed on the screen A4. Once the speaker element is selected on the screen A4, a screen A6 also shown in FIG. 10 is displayed on the display of the processor device SY1. Because no processing element is connectable with the output of the speaker element (i.e., the speaker element has no output connection function), the screen A6 is a screen for the user to select "to be ended". Once the "to be ended" option is selected on the screen A6, still another screen A7 also shown in FIG. 10 is displayed on the display of the processor device SY1. User's selection of the "to be ended" option means that the setting for logically connecting the keyboard element, tone generator element and speaker element in the order mentioned has been completed. In a case where a plurality of processing elements of a same type exist on the internal network, a connection is set individually for each of the same-type processing elements. Therefore, processor devices where the tone generator device selected on the screen A2 is functioning are detected from the internal network with reference to the device table, and then the names of the detected processor devices are displayed on the screen A7 so that the user is allowed to select any one of the displayed processor device names. In the case of the internal network shown in FIG. 9, the processor device SY1 and SY2 are detected, as the processor devices where the tone generator element selected on the screen A2 is functioning, and displayed on the screen A7 so that any one of the processor device SY1 and SY2 is selectable as the tone generator element.

In the case where the tone generator element of the device name "SY2" (or "SY1") has been selected, processor devices where the speaker element selected on the screen A4 is functioning are detected from the internal network with reference to the device table, and then the names of the detected processor devices are displayed on the screen A8 so that the user is allowed to select any one of the displayed names of the processor devices where the speaker element is functioning. Once the speaker element the device name "SY1" (or "SY2") is selected on the screen A8, the individual processing elements to be connected are determined, and the setting for logically connecting the keyboard element KBa, tone generator element TGb and speaker element SPa in the order mentioned has been completed; in this manner, connection selection processing for connecting between processing elements is completed. If the selected processing elements are functioning in a plurality of processor devices, screens for the user to sequentially select the names of desired ones of the processor devices are sequentially displayed.

Further, in the case where the "to be ended" option has been selected on the screen A3, a screen A5 shown in FIG. 10 is displayed on the display of the processor device SY1. User's selection of the "to be ended" option means that the setting for logically connecting between the keyboard element and the tone generator element in the order mentioned has been completed. In a case where a plurality of processing elements of a same type exist on the internal network, any one of the same-type processing elements is selected. Thus, processor devices where the selected tone generator element is functioning are detected from the internal network with reference to the device table, and then the names of the detected processor devices are displayed on the screen A5 so that the user is allowed to select any one of the displayed processor device names as a connection destination. Namely, the screen A5 similar in displayed contents to the aforementioned screen A7 is displayed, and, if the tone generator element of the device name "SY2" is selected by the user, the individual processing elements to be connected are determined, and setting for logically connecting between the keyboard element KBa and the tone generator element TGb in the order mentioned is completed; in this manner, the connection/selection processing for connecting between the processing elements is completed.

When the connection selection processing for connecting between the processing elements has been completed in the above-described manner, information of the set connections is recorded into a connection buffer of the processor device for which the setting has been completed. Then, as will be later detailed, connection establishment processing is performed, on the basis of the connection information recorded in the connection buffer, to establish the logical connections, and information indicative of the established logical connections is recorded into a current buffer.

Now, a description will be given about connection selection setting that is performed from the tone generator element TGb of the processor device SY2. Let it be assumed here that logical connections between the keyboard element KBa, tone generator element TGb and speaker element SPa has already been completed in the order mentioned. Once the connection selection processing is started up in the processor device SY2, a screen B1 shown in FIG. 11 is displayed on the display of the processor device SY2. The screen B1 displays two processing elements, i.e. tone generator element TGb and speaker element SPb, functioning in the processor device SY2, so that the user is allowed to select any one of the displayed two processing elements as the processing element for which connection setting is to be performed. If the tone generator element TGb is selected, as the processing element for which connection setting is to be performed, on the screen B1, another screen B2 shown in FIG. 11 is displayed on the display of the processor device SY2.

The screen B2 displays processing elements that are connectable with the selected processing element, i.e. tone generator element TGb and that are resident on the internal network of FIG. 9, via which the user can select any desired one of the displayed connectable processing elements. Such processing elements resident on the internal network of FIG. 9 and connectable with the selected processing element are detected with reference to the device table and connection table. In this case, the device table has recorded therein the keyboard element KBa, tone generator element TGa, speaker element SPa, tone generator element TBb and speaker element SPb. Because other processing elements are connectable with the input and output of the tone generator element according to the connection table, the screen B2 for selecting one of the processing elements connectable with the input of the tone generator element TGb is first displayed. Because only the keyboard element is connectable with the input of the tone generator element, only such a keyboard element is displayed on the screen B2, but also a title "input connection" is displayed on the screen B2. Once the keyboard element is selected on the screen B2, still another screen B3 shown in FIG. 11 is displayed on the display of the processor device SY2. Although, in principle, a process should be performed for selecting a processing element to be connected to the keyboard element in response to the selection of the keyboard element, a screen for selecting any one of processing elements connectable with the output of the keyboard element is displayed on the screen B3, instead of a screen for selecting any one of processing elements connectable with the input of the keyboard element, because no processing element is connectable to the input of the keyboard element. When any one of the processing elements has been selected and if there is any further processing element connectable with the selected processing element, screen information for the user to select "to be continued" or "output connection" is displayed. If the "to be continued" option has been selected, the user is prompted to select a processing element to be connected further.

If, on the other hand, the "output connection" option has been selected on the screen B3, still another screen B4 shown in FIG. 11 is displayed on the display of the processor device SY2. Processing elements connectable with the output of the tone generator element are displayed on the screen B4 along with a title "output connection". Such processing elements resident on the internal network and connectable with the output of the tone generator element are detected from the internal network with reference to the device table and connection table. Because, in this case, only the processing element resident on the internal network and connectable with the output of the tone generator element is the speaker element, screen information for the user to select either the speaker element or select a "to be ended" option for ending the setting without selecting the speaker element is displayed on the screen B4. Once the speaker element is selected on the screen B4, still another screen B5 shown in FIG. 11 is displayed on the display of the processor device SY2. When the speaker element has been selected on the screen B4, screen information for the user to select a "to be ended" option is displayed on the screen B5 along with a title "output connection", because no further processing element is connectable with the output of the speaker element. Once the "to be ended" option is selected on the screen B5, still another screen B7 shown in FIG. 11 is displayed on the display of the processor device SY2. User's selection of the "to be ended" option means that the setting for logically connecting between the keyboard element, tone generator element and speaker element in the order mentioned has been completed. In a case where a plurality of processing elements of a same type exist on the internal network, processing element selection is made individually for each of the same-type processing elements.

Thus, processor devices where the selected tone generator element is functioning are detected from the internal network with reference to the device table and then the names of the thus-detected processor devices are displayed on the screen B7, so that the user is allowed to select, as a connection destination, any one of processing elements of the displayed processor device names. Because, in this case, it is detected that the keyboard element logically connectable to the tone generator element TGb is functioning only in the processor device SY1, the screen B7 displays screen information for the user to select the device name SY1. Further, in this case, because the setting of FIG. 10 has already been performed to establish the logical connection between the keyboard element KBa and tone generator element TGb, the name of the device SY1 where the key board element KBa is functioning is displayed with an underline indicating that the logical connection has already been established. Once the device name "SY1" is selected as the keyboard element on the screen B7, processor devices where speaker elements logically connectable to the tone generator element are functioning are detected from the internal network, and the names of the detected processor devices are displayed on still another screen B8 so that the user is allowed to select, as a connection destination, any one of the speaker elements of the detected device names. In this case, because the setting of FIG. 10 has already been performed to establish the logical connection between the tone generator element TGb and the speaker element SPa, the name of the device SY1 where the speaker element SPa is functioning is displayed with an underline indicating that the logical connection has already been established. If the speaker element of the processor device SY2 is selected on the screen B8, it means that the setting has been completed to logically connect the tone generator element TGb to the speaker element SPb as well as the speaker element SPa. In this manner, individual processing elements to be logically connected in the internal network of FIG. 9 are determined so that settings for logically connecting the keyboard element KBa and the tone generator element TGb and for logically connecting the tone generator element TGb and the speaker element SPa and speaker element SPb are completed, as a result of which the connection selection processing for connecting between the processing elements are brought to an end. If the selected processing elements are functioning in a plurality of processor devices, screens for the user to sequentially select the names of desired ones of the processor devices are sequentially displayed.

Once the "to be ended" option is selected on the screen B4, still another screen B6 shown in FIG. 11 is displayed on the display of the processor device SY2. User's selection of the "to be ended" option means that the setting for logically connecting the keyboard element and tone generator element in the order mentioned has been completed. In a case where a plurality of processing elements of a same type exist on the internal network, any one the same-type processing elements is selected. Then, processor devices where the selected keyboard element is functioning are detected from the internal network with reference to the device table, and then the names of the detected processor devices are displayed on the screen B6 so that the user is allowed to select any one of the displayed processor device names as a connection destination. Then, once the keyboard element of the processor device SY1 is selected, individual processing elements to be connected are determined, and the setting for connecting the keyboard element KBa and the tone generator element TGb is selected, and the connection selection processing for setting the connections between processing elements is brought to an end.

When the connection selection processing for setting connections between processing elements has been brought to an end, connection information indicative of the contents of the established connections are stored into the connection buffer of the processor device for which the setting has been performed. Then, the connection establishment processing is performed, on the basis of the connection information recorded in the connection buffer, to establish the logical connections, and information indicative of the established logical connections is recorded into the current buffer.

Figures 12, 13:
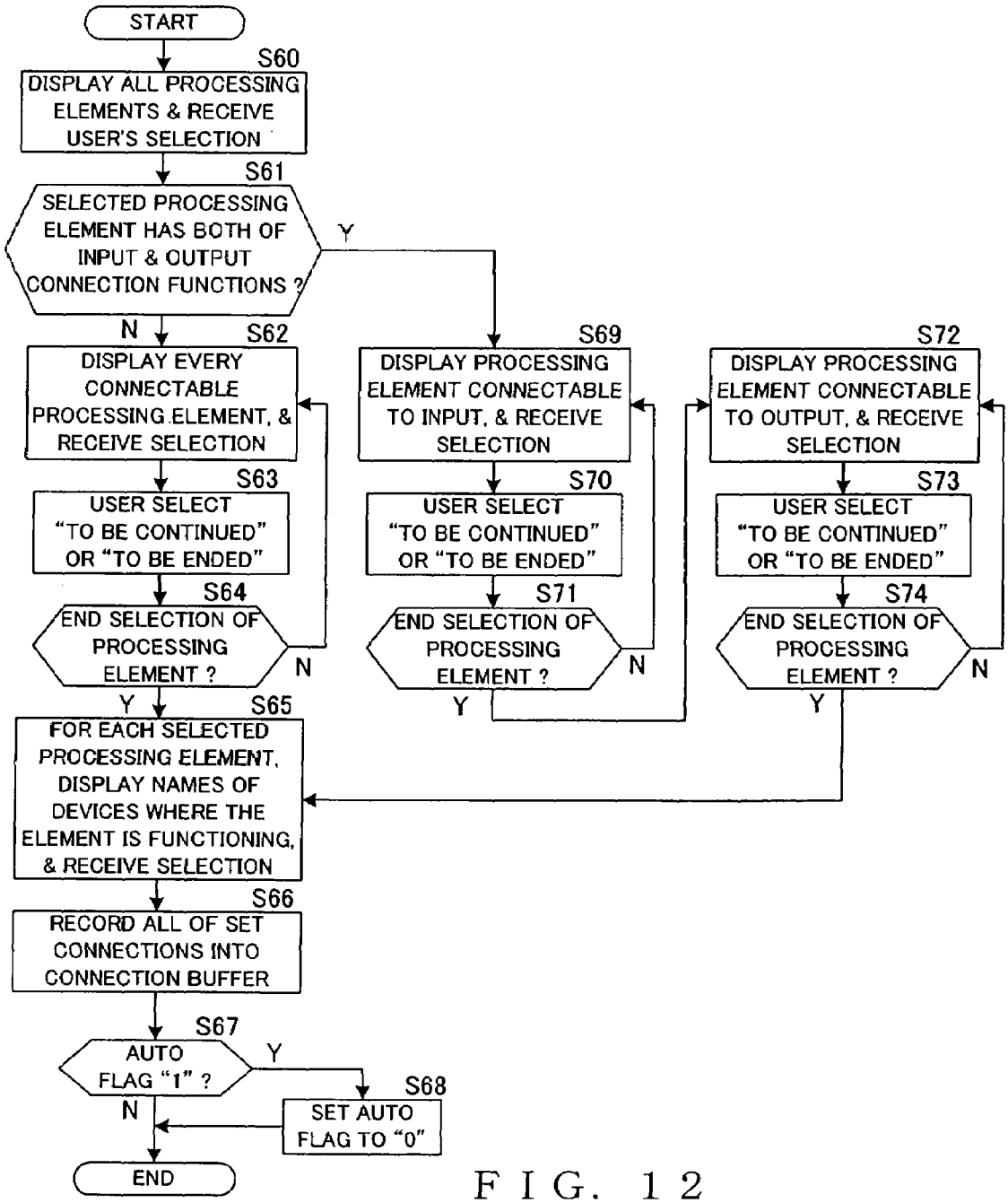
FIG. 12 is a flow chart of connection selection processing performed when setting connections between processing elements in the tone generation system of the present invention.
FIG. 13 is a diagram showing an example of connection information recorded into a connection buffer when the connection selection processing has been performed to effect setting of logical connections between processing elements in the tone generation system of the present invention.

FIG. 12 is a flow chart of the connection selection processing for setting connections between processing elements via the setting screens of FIGS. 10 and 11.

Once the connection selection processing is started in a given processor device for which connections between processing elements are to be set, all of the processing elements of the given processor device are displayed on a screen, like the screen A1 of FIG. 10 or screen B1 of FIG. 11, and a user's selection of any one of the processing elements is received, at step S60. When any one of the processing elements has been selected, the connection selection processing goes to step S61, where a determination is made, with reference to the connectable table, as to whether the selected processing element has both of input and output functions. If the selected processing element has only one of the input and output connection functions, a NO determination is made at step S61, and the processing goes on to step S62, where every processing element connectable to one of the inputs or outputs is displayed and a screen is displayed for receiving a user's selection of any one of the displayed processing elements. Once any one of the displayed processing elements is selected, the processing proceeds to step S63, where, if there is any further processing element connectable to the processing element selected on the screen displayed at step S62, another screen is displayed to allow the user to make a selection as to whether the further processing element is to be connected (i.e., the connection is to be continued) or the connection is to be ended, at step S63. If, on the other hand, there is no further processing element connectable to the processing element selected on the screen displayed at step S62, another screen is displayed for the user to select "to be ended". At next step S64, a determination is made as to whether the "to be ended" option has been selected. If the "to be ended" option has been selected as determined at step S64, the processing goes to step S65, but, if the "to be continued" option has been selected as determined at step S64, the processing reverts to step S62, so that the operations of steps S62 to S64 are performed again to allow the user to perform a selection process on the processing element further connectable to the last selected processing element. The operations of steps S62 to S64 are repeated until no further processing element is detected as connectable to the last selected processing element, or until the "to be ended" option is selected by the user.

If the selected processing element has both of the input and output connections as determined at step S61, then the processing branches to step S69, where every processing element connectable to the input of the selected processing element is displayed and a screen is displayed for receiving a user's selection of any one of the displayed processing elements. Once any one of the displayed processing elements is selected and if there is any processing element connectable to the input of the processing element selected at step S70, a screen is displayed to allow the user to make a selection as to whether the connection is to be connected or to be ended. If there is no further processing element connectable to the selected processing element, a screen is displayed for the user to select "to be ended". Then, a determination is made, at step S71, as to whether the "to be ended" option has been selected. If the "to be ended" option has been selected as determined at step S71, the processing goes to step S72, but, if the "to be continued" option has been selected as determined at step S71, the processing reverts to step S69, so that the operations of steps S69 to S71 are performed again to allow the user to perform a selection operation on a processing element further connectable to the input of the last selected processing element. The operations of steps S69 to S71 are repeated until no further processing element is detected as connectable to the input of the last selected processing element, or until the "to be ended" option is selected by the user.

Upon reaching step S72 after selection of the "to be ended" option at step S71, every processing element determined to be connectable to the output of the processing element selected at step S61 is displayed, and a screen is displayed for receiving a user's selection of any one of the displayed processing elements. Once any one of the displayed processing elements is selected and if there is any processing element connectable to the output of the processing element, a screen is displayed to allow the user to make a selection as to whether the connection to be continued or to be ended, at step S73. If there is no further processing element connectable to the selected processing element, a screen is displayed for the user to select "to be ended". Then, a determination is made, at step S74, as to whether or not the "to be ended" option has been selected. If the "to be ended" option has been selected as determined at step S74, the processing goes to step S65, but, if the "to be continued" option has been selected as determined at step S74, the processing reverts to step S72, so that the operations of steps S72 to S74 are performed again to allow the user to perform a selection operation on a processing element further connectable to the output of the last selected processing element. The operations of steps S72 to S74 are repeated until no further processing element is detected as connectable to the output of the last selected processing element, or until the "to be ended" option is selected by the user.

At step 65 following the determination at step S64 or S74 that the "to be ended" option has been selected, an operation is performed, for each selected processing element, for displaying a screen indicating names of processor devices where the selected processing element is functioning and for receiving a user's selection of any one of the displayed processor device names. Once any one of the displayed processor device names is selected, the user selects any one of processing elements functioning in the processor device of the selected device name, so that connection information indicative of the contents of the thus-set logical connections are stored into the connection buffer at step S66. In this case, the successively-selected logical connections are stored into the connection buffer in association with each other, assuming that they will be communicated successively. When connections of the input and output of any of the processing elements have been selected successively, that communication is performed between the input and output is recorded into the connection buffer. Upon completion of step S66, a determination is made, at step S67, as to whether an auto flag is currently set at a value "1". The auto flag is provided to indicate whether a later-described default buffer (default memory) should be updated or not; when the auto flag is set at a value "0", it means that the default buffer should be updated, while, when the auto flag is at the value "1", it means that the default buffer should not be updated. The default memory is provided per processor device. Processing for automatically restoring connections recorded in the default buffer is performed in each of the processor devices upon powering-on as will be later described, and thus, when the user has newly set a connection, the default buffer is updated to reflect the newly-set connection. Thus, when the auto flag is at the value "1" as determined at step S67, the processing branches to step S68, where the auto flag is set to "0", so that connections set in the connection selection processing can be automatically restored upon next powering-on. Upon completion of step S68, the connection selection processing is brought to an end. When the auto flag is not at the value "1" as determined at step S67, the connection selection processing is brought to an end without performing any further operation because the auto flag is at the value "0". Then, once the later-described connection establishment processing, which is arranged to be periodically started up, is started up, the connection establishment is performed, on the basis of the connection information set and stored in the connection buffer at step S66, to establish the logical connections, so that information indicative of the established connections (i.e., established connection information) is recorded into the current buffer.

FIG. 13 shows an example of the connection information recorded in the connection buffer when the connection selection processing shown in FIGS. 10 and 11 has been performed to perform the setting of the logical connections of the processing elements.

The connection selection processing of FIG. 10 is performed in the processor device SY1, where a connection of the keyboard element KBa is carried out first followed by setting of connections between the keyboard element KBa, processor device SY2 and tone generator element TGb and where a connection between the tone generator element TGb and speaker element SPa of the processor device SY1 is set. Thus, as indicated as "● case of SY1 tone generator" in FIG. 13, connection information, "output 1→SY2 tone generator→SY1 speaker", is stored into the connection buffer. "Output 1" represents a first output of the keyboard of the device SY1

Further, the connection selection processing shown in FIG. 11 is performed in the processor device SY2, where setting of a connection of the tone generator element TGb is carried out first followed by setting of a connection of the keyboard element KBa of the processor device SY1 to the input of the tone generator element TGb and setting of a connection of the speaker element SPb of the processor device SY2 to the output of the tone generator element TGb. Thus, as indicated as "● case of SY2 tone generator" in FIG. 13, connection information, "input 1←SY1 keyboard", "input 1→output 1" and "output 1→SY2 speaker", is stored into the connection buffer. Connection information, "input 1←SY1 keyboard", "input 1→output 1" and "output 1→SY2 speaker", indicates that MIDI data output from the keyboard of the device SY1 are input to the tone generator element TGb of the device SY2 (input 1) and processed results of the MIDI data from the tone generator element TGb (output 1) are output to (or associated with) the speaker of the device SY2.

Figure 14:
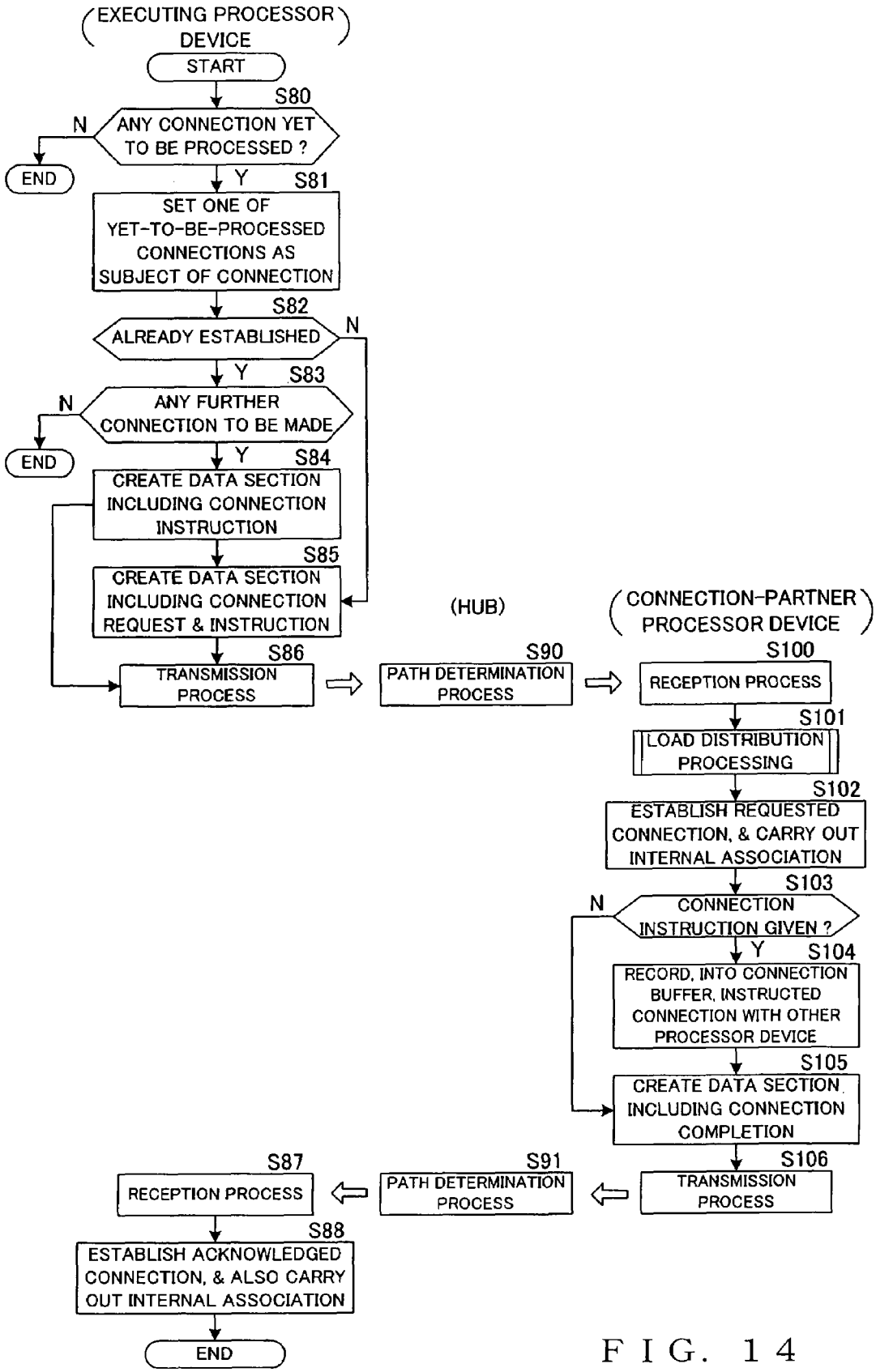
FIG. 14 is a flow chart of connection establishment processing performed following the connection selection processing in the tone generation system of the present invention.

FIG. 14 is a flow chart of the connection establishment processing. The connection establishment processing is started periodically at predetermined time intervals. Control data which a given processor device having started execution of the connection establishment processing (hereinafter also referred to as "executing processor device") should communicate with another processor device are communicated using the IP address of a destination processor device and predetermined port number for the control data.

First, at step S80 of the connection establishment processing, a determination is made, on the basis of recorded contents in the connection buffer, as to whether there is any connection yet to be processed. If there is no connection to be processed as determined at step S80, the connection establishment processing is brought to an end without performing any further operation. If, on the other hand, there are one or more connections yet to be processed as determined at step S80, the processing proceeds to step S81, where one of the connections yet to be processed is set as a subject of connection to be established. Here, "one of the connections" means setting of a port for performing communication of substantive data. At following step S82, a further determination is made, with reference to the current buffer, as to whether the subject of connection has already been established. If the subject of connection has already been established as determined at step S82, the processing goes to step S83 without establishing the new connection. At step S83, a determination is made as to whether the subject of connection has any further connection to be made. With a NO determination at step S83, the connection establishment processing is brought to an end without performing any further operation. If, on the other hand, the subject of connection has any further connection to be made as determined at step S83, the connection establishment processing goes to step S84 in order to create a data section including a connection instruction. In this case, if the subject of connection has any internal (i.e., input-to-output) association within the processor device, information indicative of the internal (i.e., input-to-output) association is included in the connection instruction. The connection instruction is an instruction indicating any further partner to be connected with the connection partner (or communication partner), and in a case where the connection partner has a plurality of further connections successively set therefor, information indicative of all of these further connections is included in the connection instruction.

If no subject of connection is recorded in the current buffer and has been established yet as determined at step S82, the processing branches to step S85 in order to create a data section including a connection request and connection instruction. The connection request is intended to request establishment of a connection between the processor device in question and a connection partner (or communication partner). The connection instruction is an instruction indicating any further partner to be connected with the connection partner, and if the subject of connection has any internal association, information indicative of the internal association is included in the connection instruction. Further, if the connection partner has a plurality of further connections successively set therefor, information indicative of all of these further connections is included in the connection instruction. After the data section has been created at step S84 or S85, a transmission process is performed at step S86 for transmitting the data section. In the transmission process of step S86, the data section created at step S84 or S85 is formed into transmitting data, a MAC frame is formed with the transmitting data ultimately capsulated therein as illustrated in FIG. 2, and the thus-formed MAC frame is then transmitted to the internal network. In this case, the MAC address (physical device ID) of the processor device where the processing element selected as the subject of connection is functioning is set, as a destination MAC address, in the MAC header of the MAC frame.

Because the internal network is a star-type network, the MAC frame transmitted to the internal network is received by one of the hubs, and a path determination process is performed by the hub (step S90). In the path determination process, the hub determines a transmission path, on the basis of the destination MAC address of the received MAC frame, to relay the MAC frame. As a consequence, the MAC frame transmitted from the processor device, where operation for the connection establishment is being performed, is received by the processor device where the processing element as the subject of connection is functioning and which matches the destination MAC address, and the processor having received the MAC frame performs a reception process (step S100). In the reception process, the IP packet is taken out from the MAC frame, then the TCP segment is taken out from the IP packet, and thence the data section is taken out from the TCP segment. Then, load distribution processing is performed at step S101 as will be later described. The load distribution processing is arranged such to, when a requested connection-destination client is unable to establish a new connection, change the connection destination to another client having the same processing element as the requested connection-destination client. Upon completion of the load distribution processing, the processor device reads the received data section and establishes the requested connection at step S102. If any internal (i.e., input-to-output) association instruction is contained, the instructed internal association is also carried out at step S102. Then, connection information indicative of the established connection and internal association is recorded into the current buffer. In the connection establishment, the IP address of the processor device where the processing element as the partner of the connection in question is functioning and the logical device ID (port number) of that processing element are acquired with reference to the device table. Because the processing element selected as the connection partner of the processor device in question can be identified from the acquired IP address and port number, the intended connection can be established by setting the IP address and port number. After completion of the operation of step S102, the processing goes to step S103, where a determination is made as to whether the data section includes a connection instruction. With a YES determination at step S103, the instructed connection with another processor device is recorded into the connection buffer of the processor device in question at step S104, after which the processing moves on to step S105.

If the data section includes no connection instruction as determined at step S103, the processing branches to step S105, where a data section including data indicative of connection completion is created. Then, a transmission process is performed at step S106 for transmitting the data section. In the transmission process of step S106, the data section created at step S104 is formed into transmitting data, a MAC frame is formed with the transmitting data ultimately capsulated therein as illustrated in FIG. 2, and the thus-formed MAC frame is then transmitted to the internal network. In this case, the MAC address of the executing processor device is set, as a destination MAC address, in the MAC header of the MAC frame. Because the internal network is a star-type network, the MAC frame transmitted from the connection-partner processor device to the internal network is received by one of the hubs, and a path determination process is performed by the hub (step S91). In the path determination process, the hub determines a transmission path, on the basis of the destination MAC address of the received MAC frame, to relay the MAC frame. As a consequence, the MAC frame transmitted from the connection-partner processor device is received by the processor device where the connection establishment processing is being performed and which matches the destination MAC address, and a reception process is performed in the executing processor device (step S87).

In the reception process, the IP packet is taken out from the MAC frame, then the TCP segment is taken out from the IP packet, and thence the data section is taken out from the TCP segment. Then, at step S88, the executing processor device reads the received data section and establishes the connection completion of which has been acknowledged. If any internal (i.e., input-to-output) association instruction is contained, the instructed internal association is also carried out. Then, connection information of the established connection and internal association is recorded into the current buffer. In the connection establishment, the IP address of the processor device where the processing element as the partner of the connection in question is functioning and the logical device ID (port number) of that processing element are acquired with reference to the device table. Because the processing element selected as the connection partner can be identified from the acquired IP address and port number, the intended connection can be established by setting these IP address and port number. The connection establishment processing is brought to an end after completion of the operation of step S88.

Note that the connection based on the connection information recorded in the connection buffer of the connection-partner processor device can be established by the connection-partner processor device being caused to function as an executing processor device to perform the connection establishment processing of FIG. 14.

The connection information indicative of the substantive-data-communicating logical connections, established through the execution of the connection establishment processing, and internal (input-to-output) association within the processor device is recorded into the current buffer. FIG. 15 shows examples of the connection information and internal association recorded in the current buffer. In the illustrated example, substantive-data-communicating connections currently established in the executing processor device are recorded into the current buffer.

The connection information and internal association shown in FIG. 15 are results obtained by the connection establishment processing being performed on the basis of the connection information recorded in the connection buffer as shown in FIG. 13, and respective connection information of the keyboard element KBa, tone generator element TGa and speaker element SPa functioning in the processor device SY1 and association among them is recorded into the current buffer of the processor device SY1. In this case, the connection information and association of the keyboard element KBa is recorded as "port 1: output→SY2 tone generator", which indicates that MIDI data output from the keyboard element KBa are supplied, via port 1 of the processor device SY1, to the tone generator element of the processor device SY2. Because the tone generator element TGa is not connected with any other processing element, no connection information and association is recorded for the tone generator element TGa. The connection information and association of the speaker element SPa is recorded as "port 2: input←SY2 tone generator", which indicates that audio data output from the tone generator element TGb of the processor device SY2 are received via port 2 of the processor device SY1 and thereby supplied to the speaker element SPa.

Further, respective connection information of the tone generator element TGb and speaker element SPb functioning in the processor device SY2 and association between them is recorded into the current buffer of the processor device SY2. In this case, the connection information and association of the tone generator element TGb is recorded as "port 1: input←SY1 keyboard", "port 1→port 2", "port 1→port 3", "port 2: output→SY1 speaker" and "port 3: output→SY2 speaker". "port 1: input←SY1 keyboard" is connection information indicating that MIDI data output from the keyboard element KBa of the processor device SY1 are received via port 1 of the processor device SY2 and thereby supplied to the tone generator element TGb. "port 1→port 2" and "port 1→port 3" is connection information indicating that audio data obtained by the tone generator element TGb processing the MIDI data output from the keyboard element KBa of the processor device SY1 are output via port 2 and port 3. "port 2: output→SY1 speaker" and "port 3: output→SY2 speaker" is connection information indicating that audio data output from the tone generator element TGb processing the MIDI data input via port 1 are supplied via port 2 to the speaker element SPa of the processor device SY1 and that audio data obtained by the tone generator element TGb processing the MIDI data input via port 1 are supplied via port 3 to the speaker element SPb of the processor device SY2. Association of the speaker element SPb with the connection information is recorded as "port 3: input←SY2 tone generator", which indicates that audio data output from the tone generator element TGb of the processor device SY2 are received via port 3 and thereby supplied to the speaker element SPb.

Figure 16:
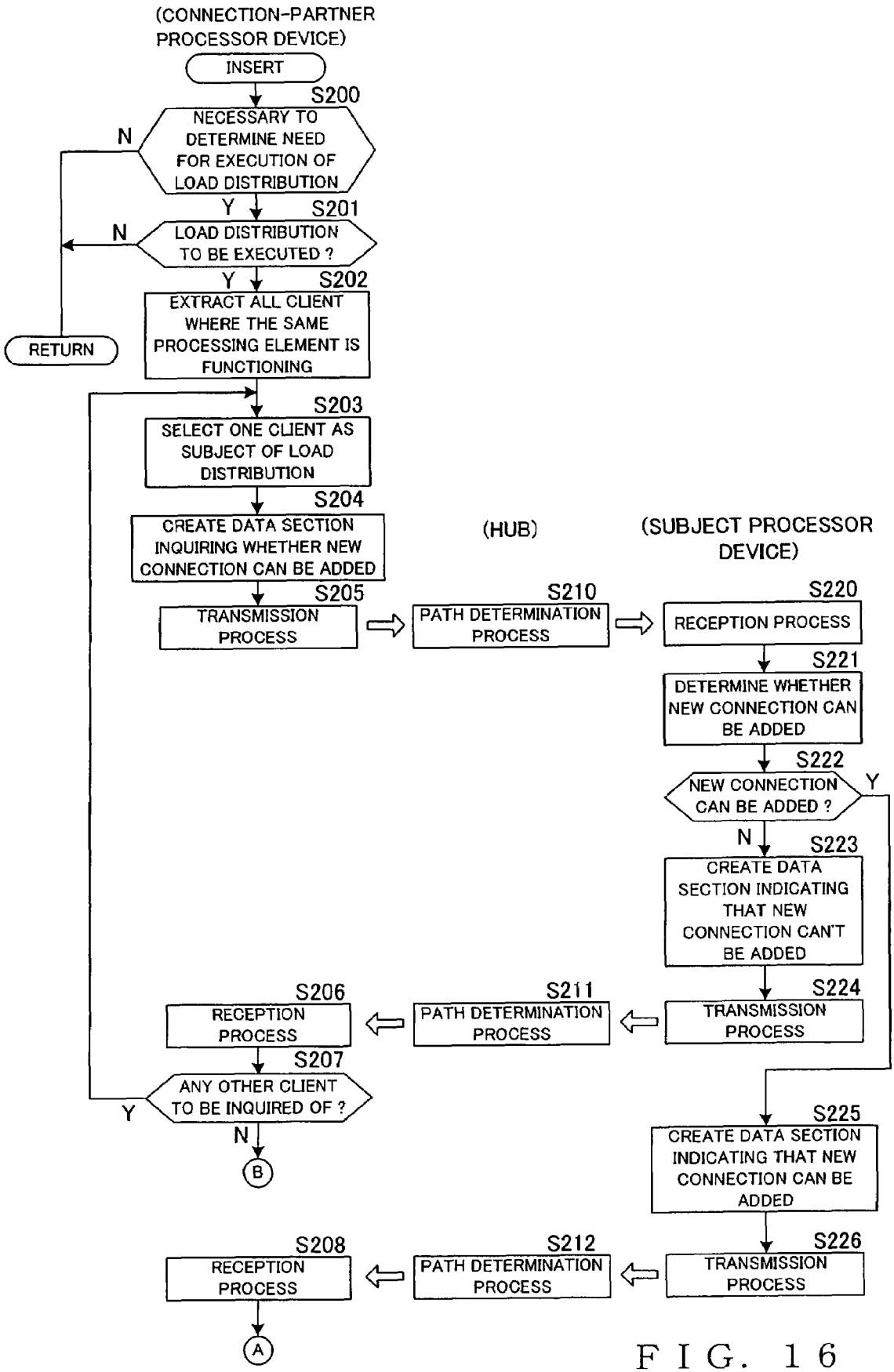
FIG. 16 is a flow chart of part of load distribution processing performed in the connection establishment processing in the tone generation system of the present invention.
Figure 17:
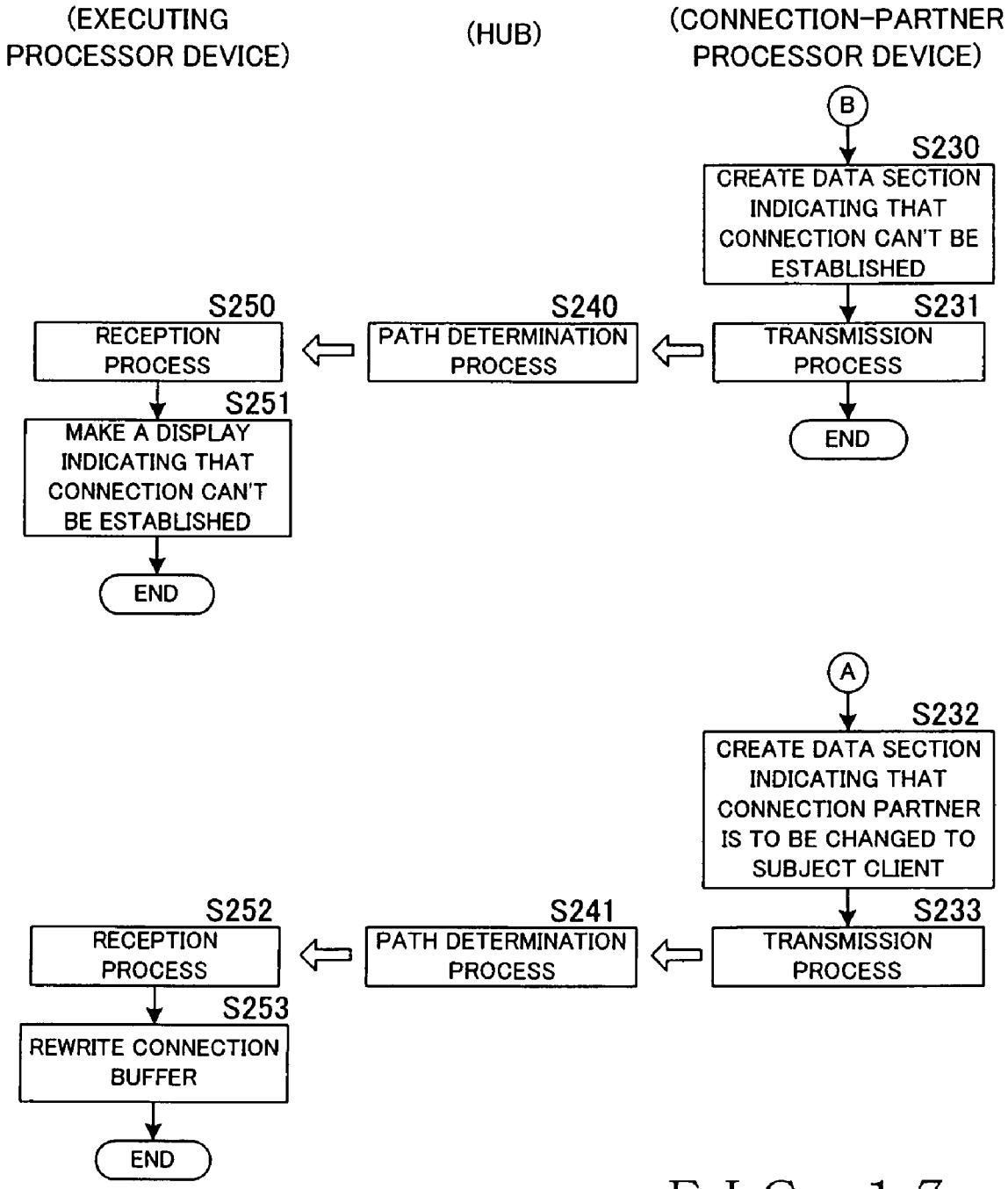
FIG. 17 is a flow chart of the remaining part of the load distribution processing performed in the connection establishment processing in the tone generation system of the present invention.

FIGS. 16 and 17 are flow charts of the load distribution processing performed at step S101 of the connection establishment processing shown in FIG. 14. In this case, the load distribution processing is not performed by the processor device having started execution of the connection establishment processing (i.e., executing processor device), but performed by the processor device accessed externally as the connection partner ("connection-partner processor device"). Control data to be communicated between the executing processor device and the communication-partner processor device are communicated using the IP address of the destination processor device and predetermined port number for the control data.

Upon start-up of the load distribution processing, a determination is made at step S200, on the basis of "subject of load distribution" information in the device table shown in FIG. 3, as to whether or not it is necessary to determine a need for execution of load distribution. If "○" is recorded in a "subject of load distribution" field for a processing element for which a connection is to be established in the connection-partner processor device, the connection-partner processor device determines that it is necessary to determine a need for execution of load distribution, and then it proceeds to step S201. On the other hand, if "X" is recorded in the "subject of load distribution" field, the connection-partner processor device determines that it is not necessary to determine a need for execution of load distribution, and then it returns to step S102.

If a use rate of the CPU of the connection-partner processor device exceeds a predetermined value, then it is determined, at step S201, that the load distribution should be executed because a processing time delay may occur. In this case, the tone generator, mixer and effector elements, implemented by hardware instead of software, are excluded. If the use rate of the CPU has not yet exceeded the predetermined value and thus the load distribution need not be executed as determined at step S201, the connection-partner processor device returns to step S102. On the other hand, if the use rate of the CPU has exceeded the predetermined value and thus the load distribution should be executed as determined at step S201, the connection-partner processor device moves on to step S202. At step S202, all clients (processor devices) where the same processing element is functioning is extracted with reference to the device table of FIG. 3. Then, at step S203, one of the extracted processor devices is selected as a subject of the load distribution. At next step S204, a data section is created which inquires the processor device, selected as the subject of the load distribution, whether a new connection can be added or not. Then, at step S205, a transmission process is performed for transmitting the created data section. In the transmission process, the data section created at step S204 is formed into transmitting data, a MAC frame is formed with the transmitting data ultimately capsulated therein as illustrated in FIG. 2, and the thus-formed MAC frame is then transmitted to the internal network. In this case, the MAC address of the processor device, selected as the subject of the load distribution is set, as a destination MAC address, in the MAC header of the MAC frame. Because the internal network is a star-type network, the MAC frame transmitted from the connection-partner processor device to the internal network is received by one of the hubs, and a path determination process is performed by the hub (step S210). In the path determination process, the hub determines a transmission path, on the basis of the destination MAC address of the received MAC frame, to relay the MAC frame. As a consequence, the MAC frame transmitted from the connection-partner processor device is received by the processor device selected as the subject of the load distribution (i.e., selected processor device) which matches the destination MAC address, and a reception process is performed in the selected processor device (step S220).

In the reception process, the IP packet is taken out from the MAC frame, then the TCP segment is taken out from the IP packet, and thence the data section is taken out from the TCP segment. Then, at step S221, the selected processor device reads the received data section to determine whether a new connection can be added or not. If the use rate of the CPU of the selected processor device has increased so that the new connection can not be added, the selected processor device proceeds to step S223 to create a data section indicating that the new connection can not be added, and a transmission process is performed, at step S224, for transmitting the thus-created data section. In the transmission process, the data section created at step S224 is formed into transmitting data, a MAC frame is formed with the transmitting data ultimately capsulated therein as illustrated in FIG. 2, and the thus-formed MAC frame is then transmitted to the internal network. In this case, the MAC address of the connection-partner processor device is set, as a destination MAC address, in the MAC header of the MAC frame. Then, in the same manner as described above, a path determination process is performed (step S210) so that the MAC frame is received by the connection-partner processor device and a reception process is performed in the connection-partner processor device (step S206). In the reception process, the data section is acquired from the MAC frame. Then, the acquired data section is read, and, because the data section indicates that the new connection can not be added, the connection-partner determines, at step S207, whether there is any other client (processor device) to be inquired of about whether a new connection can be added or not. If two or more clients have been extracted at step S202 and it has been determined that there is any other client to be inquired of among the extracted clients, the connection-partner processor device reverts to step S203, so that the operations of steps S203 to S207 are repeated for the other client; these operations of steps S203 to S207 are repeated until it has been determined that there is no more client to be inquired of If it has been determined, at step S207, that there is no more client to be inquired about, the connection-partner processor device shifts to connection point Ⓑ of FIG. 17.

Upon shifting to connection point Ⓑ of FIG. 17, a data section indicating that the connection can not be established is created at step S230, and a transmission process is performed, at step S231, for transmitting the thus-created data section. In the transmission process, the data section created at step S230 is formed into transmitting data, a MAC frame is formed with the transmitting data ultimately capsulated therein as illustrated in FIG. 2, and the thus-formed MAC frame is then transmitted to the internal network. In this case, the MAC address of the executing processor device is set, as a destination MAC address, in the MAC header of the MAC frame. Then, in the same manner as described above, a path determination process is performed (step S240) so that the MAC frame is received by the connection-partner processor device and a reception process is performed in the executing processor device (step S250). In the reception process, the data section is acquired from the MAC frame. Then, the acquired data section is read, and, because the data section indicates that the connection can not be established, the executing processor device makes a display indicating that the connection can not be established and terminates not only the load distribution processing but also the connection establishment processing.

If the use rate of the CPU of the selected processor device is low so that the new connection can be added as determined at step S222, the selected processor device branches to step S225 to create a data section indicating that the new connection can be added, and a transmission process is performed, at step S226, for transmitting the thus-created data section. In the transmission process, the data section created at step S225 is formed into transmitting data, a MAC frame is formed with the transmitting data ultimately capsulated therein as illustrated in FIG. 2, and the thus-formed MAC frame is then transmitted to the internal network. In this case, the MAC address of the connection-partner processor device is set, as a destination MAC address, in the MAC header of the MAC frame. Then, in the same manner as described above, a path determination process is performed (step S212) so that the MAC frame is received by the connection-partner processor device and a reception process is performed in the connection-partner processor device (step S208). In the reception process, the data section is acquired from the MAC frame. Then, the acquired data section is read, and, because the data section indicates that the new connection can be added, the connection-partner processor device shifts to connecting point Ⓐ.

Upon shifting to connection point Ⓐ of FIG. 17, a data section indicating that the connection-partner is to be changed to the selected processor device is created at step S232, and a transmission process is performed, at step S233, for transmitting the thus-created data section. In the transmission process, the data section created at step S232 is formed into transmitting data, a MAC frame is formed with the transmitting data ultimately capsulated therein as illustrated in FIG. 2, and the thus-formed MAC frame is then transmitted to the internal network. In this case, the MAC address of the executing processor device is set, as a destination MAC address, in the MAC header of the MAC frame. Then, in the same manner as described above, a path determination process is performed (step S241) so that the MAC frame is received by the executing processor device and a reception process is performed in the executing processor device (step S252). In the reception process, the data section is acquired from the MAC frame. Then, the acquired data section is read, and, because the data section indicates that the connection partner is to be changed to the selected processor device, the executing processor device rewrites the connection buffer to change the connection partner to the selected processor device. Then, the executing processor device terminates not only the load distribution processing but also the connection establishment processing. The connection establishment, based on the connection setting of the buffer intended to change the connection partner to the selected processor device, is effected by the connection establishment processing being started up next in the executing processor device.

Figure 18:
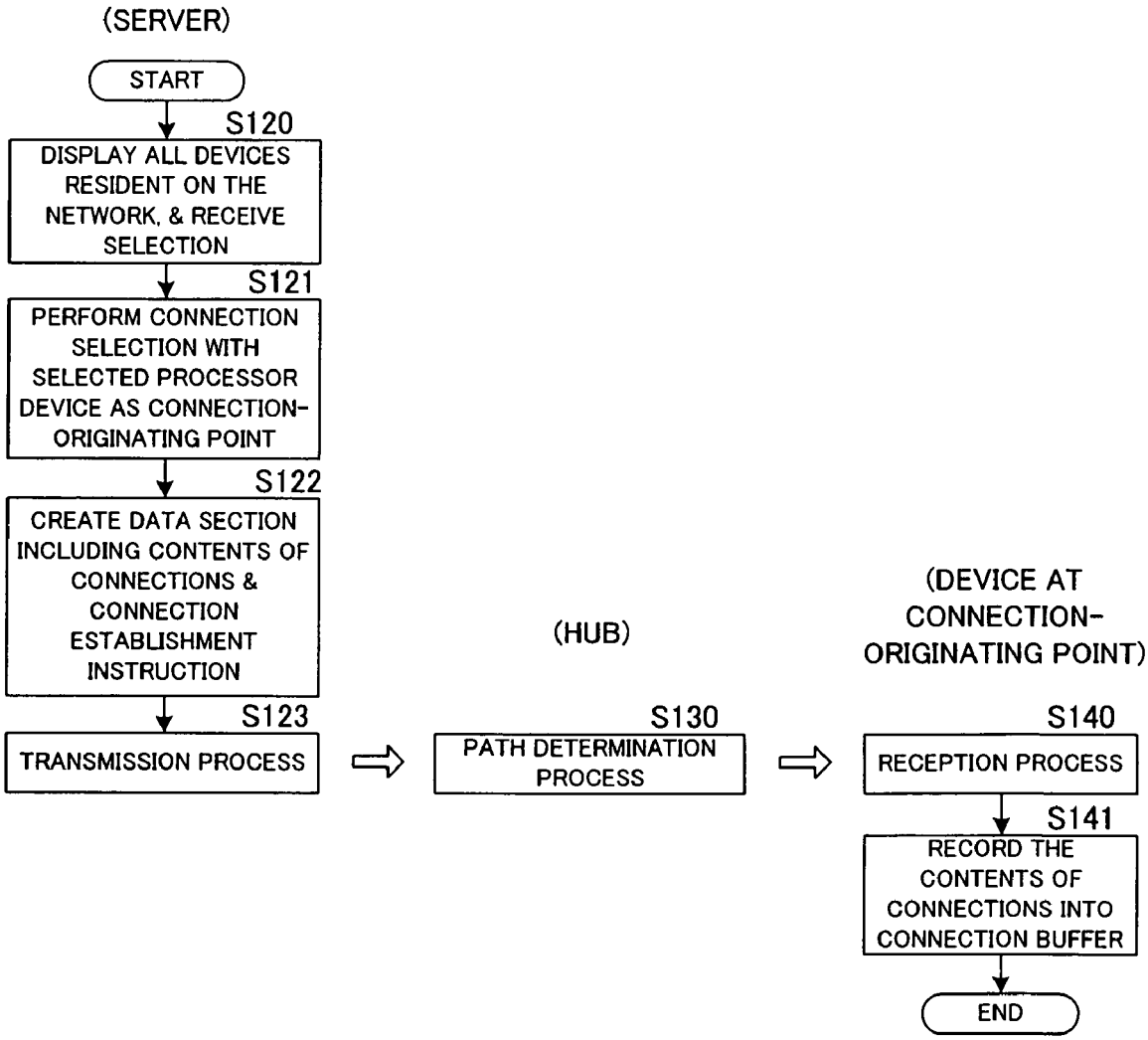
FIG. 18 is a flow chart of the connection selection processing performed by a SV (server) in the tone generation system of the present invention

The above-described connection selection processing may also be performed by the SV (server) 11. FIG. 18 is a flow chart of the connection selection processing performed by the SV (server) 11. Control data to be communicated between the SV (server) 11 and a connection-originating processor device are communicated using the IP address of a destination processor device and port number predetermined for the control data.

Once the connection selection processing is started up in the SV (server) 11, the SV (server) 11 displays, at step S120, all of the processor devices resident on the internal network with reference to the device table, and it receives a selection of the connection-originating processor device. Here, upon detection that a connection-originating processor device has been selected, the SV (server) 11 proceeds to step S121, where it performs connection selection processing, with the selected processor device as a connection-originating point, so that contents of connections of all of the processor devices resident on the internal network, having been set through the connection selection processing, are stored into the SV (server) 11. Then, at step S122, the SV (server) 11 creates a data section that includes connection contents that have been set through the connection selection processing and a connection establishment instruction that instructs the connection-originating processor device to establish the connection contents.

Then, a transmission process is performed at step S123. In the transmission process of step S123, the data section created at step S122 is formed into transmitting data, a MAC frame is formed with the transmitting data ultimately capsulated therein as illustrated in FIG. 2, and the thus-formed MAC frame is then transmitted to the internal network. In this case, the MAC address (physical device ID) of the connection-originating processor device is set, as a destination MAC address, in the MAC header of the MAC frame. Because the internal network is a star-type network, the MAC frame from the SV (server) to the internal network is received by one of the hubs, and a path determination process is performed by the hub (step S130). In the path determination process, the hub determines a transmission path, on the basis of the destination MAC address of the received MAC frame, to relay the MAC frame. As a consequence, the MAC frame transmitted from the SV (server) 11 is received by the processor device which has been selected as the connection-originating point and which matches the destination MAC address, and a reception process is performed in the connection-originating processor device (step S140). In the reception process, the IP packet is taken out from the MAC frame, then the TCP segment is taken out from the IP packet, and thence the data section is taken out from the TCP segment. Then, at step S141, the connection-originating processor device reads the received data section and records the contents of connections, of which establishment has been instructed, into the connection buffer of the connection-originating processor device, after which the connection selection processing is brought to an end.

Note that the connection establishment based on the connection information recorded in the connection buffer of the connection-originating processor device is effected by the connection-originating processor device being caused to function as an executing processor device to perform the connection establishment processing of FIG. 14 when the connection establishment processing is started up in the connection-originating processor device.

As set forth above, the connection selection processing of FIG. 12 is performed, for each of the processor devices in the network, by a respective computer program provided in the processor device. Further, the connection selection processing of FIG. 18 is performed by a computer program provided in the server 11. The hardware arrangements for installing the programs of the connection selection processing (FIGS. 12 and 18) in the computers to perform the connection selection processing, if expressed in different terms, are a "connection selection device that is operable, in response to operation by the user, to not only select a plurality of processing elements and set a logical connection between the selected processing elements but also select a processor device to function as a processing element in the set logical connection".

Further, the above-described load distribution processing (FIGS. 16 and 17) is performed, for each of the processor devices in the network, by a respective computer program provided in the processor device. As noted above, the load distribution processing is actually started up in a connection-partner processor device. The hardware arrangements for installing the program of the load distribution processing (FIGS. 16 and 17) in the computers to perform the load distribution processing, if expressed in different terms, are a "control device that, 1) if the selected processor device is in a state incapable of establishing a new connection (step S201), determines whether the selected processor device may be replaced with another processor device (step S202), 2) if the selected processor device may be replaced with another processor device, searches for another processor device capable of functioning as the same processing element as the selected processor device does (steps S203-S208), and 3) if the searched-out other processor device is in a state capable of establishing a new connection, determines the searched-out other processor device as the processor device to function as the processing element in the set logical connection in place of the selected processor device (step S253)".

Further, the above-described connection establishment processing (FIG. 14) is performed, for each of the processor devices in the network, by a respective computer program provided in the processor device. The hardware arrangements for installing the programs of the aforementioned connection selection processing (FIGS. 12 and 18) and connection establishment processing (FIG. 14) in the computers to perform the connection selection processing and connection establishment processing, if expressed comprehensively, are a "connection control device that sets a logical connection between the processing elements (connection selection processing), establishes a connection between the processor devices to function as the processing elements in the set logical connection (connection establishment processing), and thereby builds a signal path for tone generation in the tone generation system".

Figure 19:
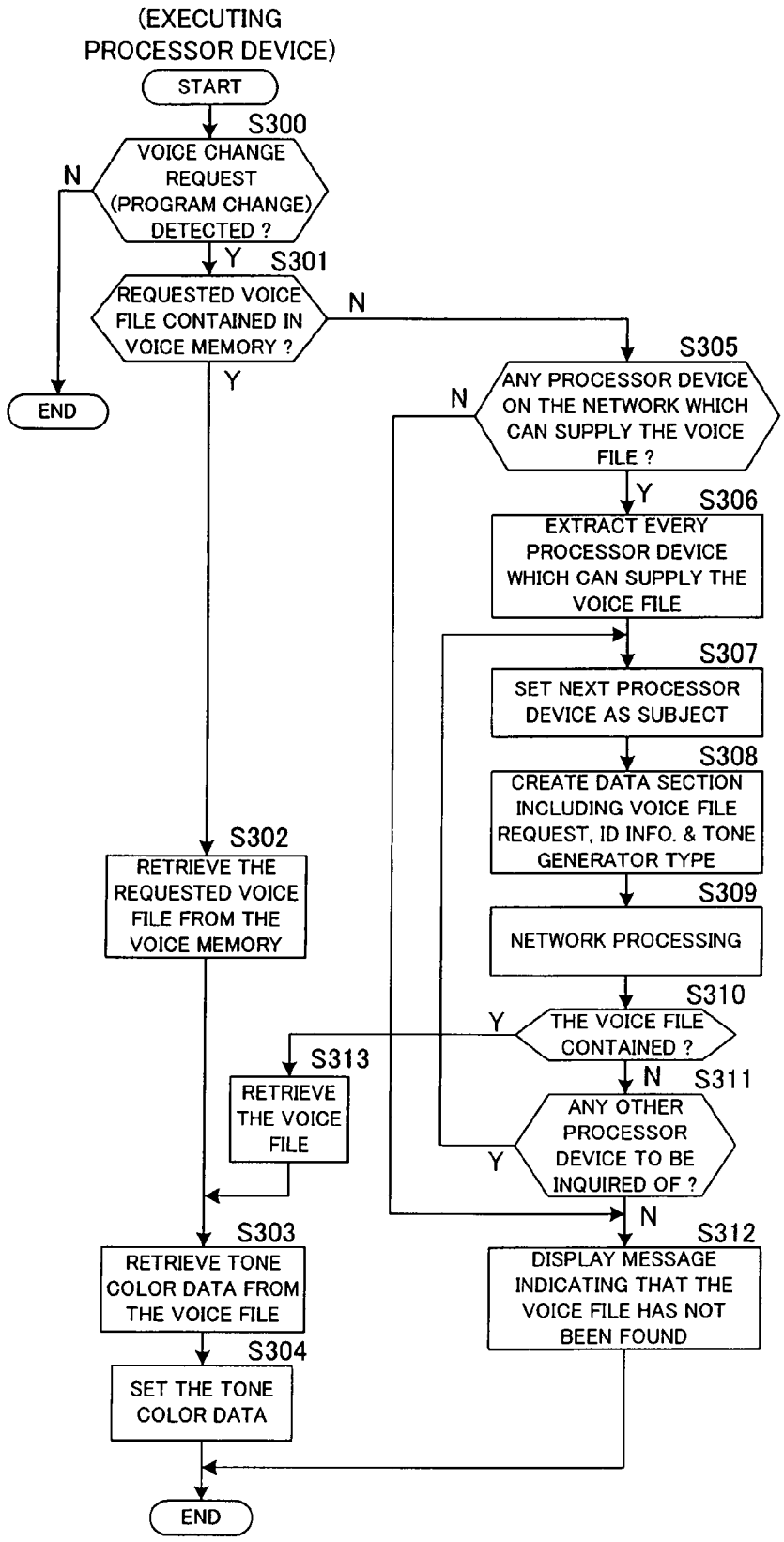
FIG. 19 is a float chart of voice change processing performed when a tone color is to be changed in a tone generator element in the tone generation system of the present invention.

FIG. 19 is a float chart of voice change processing (broadly stated, content file selection processing) that is performed when a tone color is to be changed in the tone generator element. The voice change processing, which is started up at predetermined time intervals, is processing that can supply a requested voice file via the network when the requested voice file is not possessed by the processor device in question.

Once the voice change processing is started up, a determination is made, at step S300, whether or not a voice change request (program change) has been detected. Broadly stated, a request for selecting a desired content file is received at step S300. When a voice change request, made by tone color change operation or given via the network, has been detected, i.e. a content file selection request, has been detected at step S300, the processor device proceeds to step S301, but, if no voice change request has been detected at step S300, the voice change processing is brought to and end without performing any further operation. At step S301, a determination is made as to whether the requested voice file is contained in the voice memory. In this embodiment, a plurality of voice files are prestored in the voice memory along with their respective unique identification information. Each of the voice files contains tone color data of the PCM, FM, physical model or other format capable of synthesizing a tone color. At step S301, a determination is made as to whether the identification information of the requested voice is among the identification information recorded in the voice memory. If the requested voice file is contained in the voice memory as determined at step S301, the requested voice file is retrieved from the voice memory, and the tone color data are retrieved from the retrieved requested voice file. Then, the retrieved tone color data are set in the tone generator element of the executing processor device, after which the voice change processing is brought to an end. In a case where MIDI data have been received, "setting" means making preparations such that PCM data can be generated.

If, on the other hand, the requested voice file is not contained in the voice memory as determined at step S301, the processing branches to step S305, where a determination is made as to whether there is any processor device in the network which can supply the requested voice file. Here, the executing processor device refers to the "voice file supply" field per logical device ID in the device table shown in FIG. 3, to thereby detect any processor device in the network which can supply the requested voice file. For detection of such a processor device which can supply the requested voice file, a search may be made up to a type of the tone generator. If it has been determined there is any processor device in the network which can supply the requested voice file, the processing goes to step S306, where it extracts a list of every processor device which can supply the requested voice file. Then, at step S307, the executing processor device sets a particular one of the listed processor devices as a subject the processing. At next step S308, the executing processor device creates a data section including a voice file request, identification information (program change number) and a tone generator type, such as the PCM, FM or physical model. The thus-created data section is sent to a processor device that is to be inquired of via network processing of step S309; the network processing is flow charted in FIG. 20.

Figure 20:
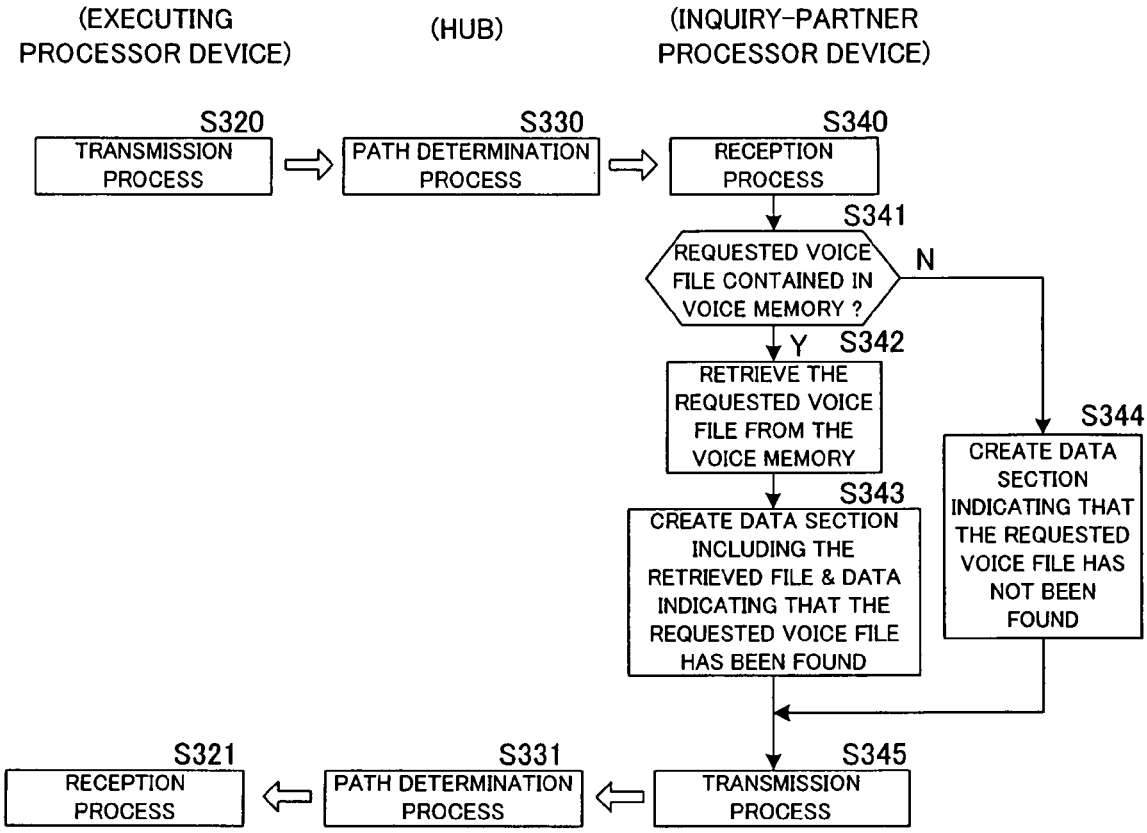
FIG. 20 is a flow chart of network processing performed in the voice change processing in the tone generation system of the present invention.

In the network processing, as shown in FIG. 20, the data section created at step S308 is formed into transmitting data, a MAC frame is formed with the transmitting data ultimately capsulated therein as illustrated in FIG. 2, and a transmission process is performed, at step S320, for transmitting the thus-formed MAC frame to the internal network. In this case, the MAC address of the processor device to be inquired of (hereinafter referred to as "inquiry-partner processor device") is set, as a destination MAC address, in the MAC header of the MAC frame. Then, a path determination process is performed at step S340, and a reception process is performed in the inquiry-partner processor device (step S340). In the reception process, the data section is acquired from the MAC frame and read by the inquiry-partner processor device. Then, a determination is made, at step S341, as to whether the voice memory contains a voice file of the identification information and tone generator type matching those indicated by the data section. If answered in the affirmative, the voice file is retrieved from the voice memory at step S342, and a data section indicating that the requested voice file has been found is created at step S343. If, on the other hand, it has been determined, at step S341, that the requested voice file has not been found, a data section indicating that the requested data file has not been found is created at step S344. Then, the data section created at step S344 is formed into transmitting data, a MAC frame is formed with the transmitting data ultimately capsulated therein as illustrated in FIG. 2, and a transmission process is performed, at step S345, for transmitting the thus-formed MAC frame to the internal network. In this case, the MAC address of the executing processor device is set, as a destination MAC address, in the MAC header of the MAC frame. Then, a path determination process is performed at step S331, and a reception process is performed in the executing processor device (step S321). In the reception process, the data section is acquired from the MAC frame and read by the executing processor device.

Upon completion of the network processing at step S309, a determination is made as to whether the data section read at step S310 includes the voice file. If the data section includes the requested voice file, the process branches to step S313 to retrieve the voice file and perform the operations of steps S303 and 304 to retrieve the tone color data. Also, an operation is performed for setting a tone generator for the tone color. Further, if the data section indicates that the requested voice file has not been found, the process goes to step S311, whether a determination is made as to whether there is any other processor device to be inquired of. If there is any other processor device as determined at step S311, the process reverts to step S307 to again perform the operations of steps S307 to S311 so that the requested voice file may be acquired from the other processor device. Such operations are performed sequentially for each of the processor devices extracted at step S306 above. Then, once it is determined that there is no more processor device to be inquired of, the process proceeds to step S312, a message indicating that the requested voice file has not been found is displayed, and the voice change processing is brought to an end.

Figure 21:
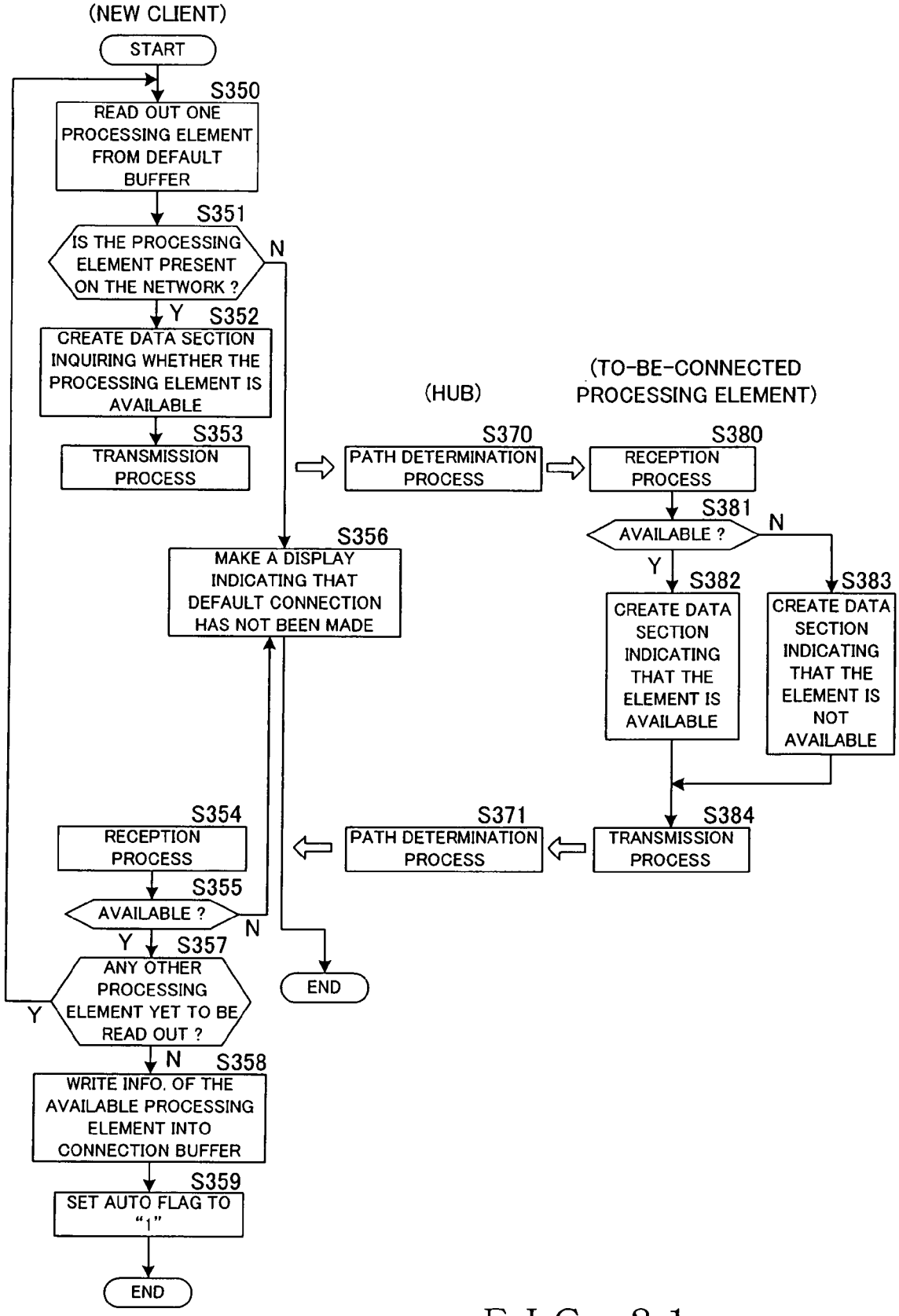
FIG. 21 is a flow chart of automatic setting processing performed in response to powering-on of a processor device in the tone generation system of the present invention.

In the tone generation system of the present invention, various settings made by the individual processor devices are sequentially recorded into a non-volatile default buffer (i.e., default memory), so that, upon next powering-on, these recorded settings (i.e., settings immediately before last powering-off) are read out and automatically restored. FIG. 21 is a flow chart of automatic setting processing performed in response to powering-on.

Once one of the processor devices resident in the internal network is powered on to be newly connected (logged in), the network connection processing of FIG. 6 is performed in the above-described manner. Then, once automatic setting processing is started up following completion of the network connection processing, one of the processing elements selected as subjects of connection (i.e., to-be-connected processing elements) is read out from a default buffer of the newly-logged-in processor device (new-client processor device) at step S350. Then, a determination is made at step S351 as to whether the read-out processing element is present in the network. If the read-out processing element is present in the network as determined at step S351 with reference to the device table acquired from the SV (server) 11 in the network connection processing, the processing proceeds to step S352 in order to create a data section inquiring whether the processing element in question is available. Such inquiry is made about either or both of the input and output sides of the processing element, as necessary.

Then, the data section created at step S352 is formed into transmitting data, a MAC frame is formed with the transmitting data ultimately capsulated therein as illustrated in FIG. 2, and a transmission process is performed, at step S353, for transmitting the thus-formed MAC frame to the internal network. In this case, the MAC address of a processor device where the processing element selected as the subject of connection (i.e., to-be-connected processing element) is functioning is set, as a destination MAC address, in the MAC header of the MAC frame. Then, a path determination process is performed at step S370, and a reception process is performed in the to-be-connected processing element (step S380). In the reception process, the data section is acquired from the MAC frame, and the data section is interpreted as an inquiry about whether or not the processing element is available. Here, the availability is determined for each of the of the input and output sides inquired. Here, connections at the input and output sides of the processing element are detected with reference to the registered contents of the current buffer. If the inquired processing element has not yet been connected with any other processing element, then it is determined that the inquired processing element is available, and the processing moves on to step S382. At step S382, a data section indicating that the inquired processing element is available. If, on the other hand, the inquired processing element has already been connected with another processing element, it is determined, at step S381, that the inquired processing element is available, the processing branches to step S383 in order to create a data section indicating that the inquired processing element is not available.

Then, the data section created at step S382 or step S383 is formed into transmitting data, a MAC frame is formed with the transmitting data ultimately capsulated therein as illustrated in FIG. 2, and a transmission process is performed, at step S384, for transmitting the thus-formed MAC frame to the internal network. In this case, the MAC address of the new-client processor device is set, as a destination MAC address, in the MAC header of the MAC frame. Then, a path determination process is performed at step S371, and a reception process is performed in the to-be-selected processing element (step S354). In the reception process, the data section is acquired from the MAC frame, and the data section is read. Then, a determination is made, at step S355, whether the inquired processing element is available or not. If the read data section indicates that the inquired processing element is available, it is determined, at step S355, that the inquired processing element is available, and the processing proceeds to step S357, where a determination is made as to whether there is any other to-be-connected processing element that is yet to be read out from the default buffer.

If the read-out processing element is not present in the network as determined at step S351 with reference to the device table, the processing proceeds to step S356 in order to cause the display section to make a display indicating that the default connection has not been made, after which the automatic setting processing is brought to an end. If the processing element is not registered in the device table, a message "Not Registered" may be displayed. Further, if the read data section indicates that the inquired processing element is not available, it is determined, at step S355, that the inquired processing element is not available, and the processing branches to step S356 in order to cause the display section to make a display indicating that the default connection has not been made, after which the automatic setting processing is brought to an end. If the processing element is currently connected with another processing element, a message "Currently Used in Other Processing Element" may be displayed.

Further, if there is any other to-be-connected processing element that is yet to be read out from the default buffer as determined at step S357, the processing reverts to step S350, so that the operations of steps S350 to S357 are repeated for the other to-be-connected processing element; these operations of steps S350 to S357 are repeated until it has been determined that there is no more to-be-connected processing element that is yet to be read out from the default buffer. Once it is determined at step S357 that there is no more to-be-connected processing element that is yet to be read out from the default buffer, the processing goes to step S358, where connection information of the processing elements having been determined to be available is written into the connection information. After that, the auto flag is set to "1", and then the automatic setting processing is brought to an end. The auto flag set at "1", which indicates that the default buffer is not to be updated as noted above, also indicates that every connection recorded in the default buffer is to be restored. Further, in case any of the connections recorded in the default buffer is impossible in the automatic setting processing, the connection information in the default buffer is prevented from being written into the connection buffer so as to inhibit all of the connections recorded in the default buffer. In this case, the auto flag is maintained at "0" which also indicates that all of the connections recorded in the default buffer are to be inhibited.

Note that the user may be allowed to make a selection, at the time of connection to the network, as to whether or not connections based on the default buffer are to be effected.

Figure 22:
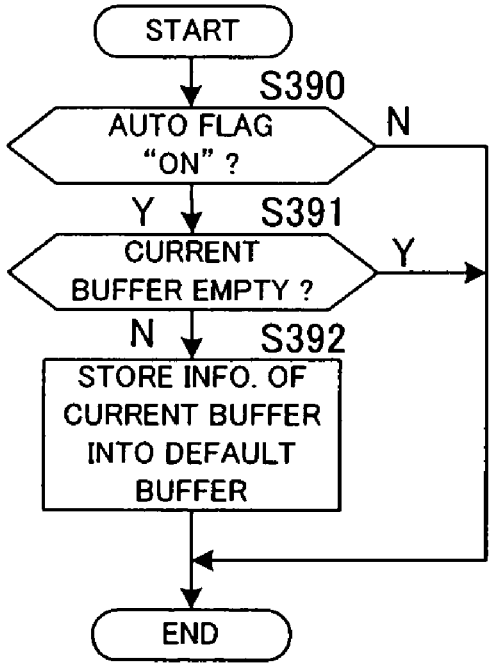
FIG. 22 is a flow chart of flag processing performed on a periodic basis in the tone generation system of the present invention.

FIG. 22 is a flow chart of flag processing performed following the periodic connection establishment processing of FIG. 14.

Upon start-up of the flag processing, a determination is made, at step S390, as to whether the auto flag is currently at "0". Here, when the connections recorded in the default buffer have not be updated or when the connection establishment processing, it is determined that the auto flag is currently at "0", and thus the flag processing proceeds to step S391 in order to make a determination as to whether connection information is currently recorded in the current buffer. If the connections recorded in the default buffer have not been restored and there has been made no manually-set connection or externally-requested connection, it is determined that no connection information is currently recorded in the current buffer and thus the current buffer is empty, so that the flag processing is brought to an end without performing any further processing. If, on the other hand, there has been made a manually-set connection or externally-requested connection and thus connection information is currently recorded in the current buffer, the connection information recorded in the current buffer is recorded into the default buffer, after which the flag processing is brought to an end. In this way, the default buffer is updated with the recorded contents of the current buffer having reflected therein any manually-set or externally-requested connection. Further, if the connections recorded in the default buffer have been restored and there has been made no manually-set connection or externally-requested connection, it is determined at step S390 that the auto flag is currently at "1", so that the flag processing is brought to an end without updating the default buffer.

Thus, in a case where all of the processing elements to be connected are available when the new client has been connected to the internal network, the connection states immediately before the last powering-off can be completely restored. Further, if the new client logs off from the internal network in a case where at least part of the processing elements to be connected is unavailable and thus the connection states immediately before the last powering-off can not be completely restored, the non-complete connection states are not recorded into the default buffer, so that it is possible to prevent the non-complete connection states from being restored at the time of next logon.

As set forth above, the automatic setting processing of FIG. 21 is performed, for each of the processor devices in the network, by a respective computer program provided in the processor device. The hardware arrangements for installing the program of the aforementioned automatic setting processing (FIG. 21) in the computers to perform the automatic setting processing, if expressed in different terms, are a "restoration control device that, when any one of the processor devices has logged into the network, automatically restores logical connections between one or more processing elements of the processor device having logged into the network and one or more processing elements in the network on the basis of the default information stored in the default memory of the processor device having logged into the network (steps S350-S359), the restoration control device determining, for each of the processing elements of the processor device having logged into the network, whether or not another processing element, selected as a connection partner to be connected with the processing element, is available (steps S351 and S355) and then restoring only the logical connection to the available processing element.

Further, the flag processing of FIG. 22 is performed, for each of the processor devices in the network, by a respective computer program provided in the processor device. In short, the flag processing is intended to control writing (updating) of default information in the default memory (default buffer). The hardware arrangements for installing the program of the aforementioned flag processing (FIG. 22) in the computers to perform the flag setting processing, if expressed in different terms, are a "device that performs control for, when the logical connection building the signal path has been changed in the connection control device in response to operation by the user (namely, when it has been determined, at step S390 or S391 of FIG. 22, that the auto flag is at the value "0" or that the current buffer is not empty), storing information indicative of a state of the changed logical connection into the default memory (default memory) as default information, to thereby update the default information". Here, when automatic restoration of logical connections have been effected by the restoration control device, on the basis of the default information, in response to any one of the processor devices logging into the network, the auto flag turns to the value "1" (step S359 of FIG. 21). When automatic restoration of only a part of the logical connections has been restored, the current buffer is left empty. Thus, in each of the two cases, the default information stored in the default memory (default buffer) is not updated.

The above-described network connection processing of FIG. 6, network disconnection processing of FIG. 7, connection selection processing of FIGS. 10-12, connection establishment processing of FIGS. 14-16 and connection selection processing of FIG. 18 performed by the SV (server) 11 may be carried out using a browser by the processor devices, performing these processing, activating browser software. The browser can perform file transfer based on HTTP (HyperText Transfer Protocol) and read and display a hyper text described in HTML (Hyper Text Markup Language). In this case, the browser is caused to display necessary setting screens and selecting screens so that the user can make settings and selections on the screens. Further, control data can be communicated using request methods, such as "GET" capable of requesting a file prepared in the HTTP, "POST" for transmitting desired data and "PUT" capable of updating a file. Although the HTTP protocol generally uses a port number "80", the present invention is not so limited.

Figure 25:
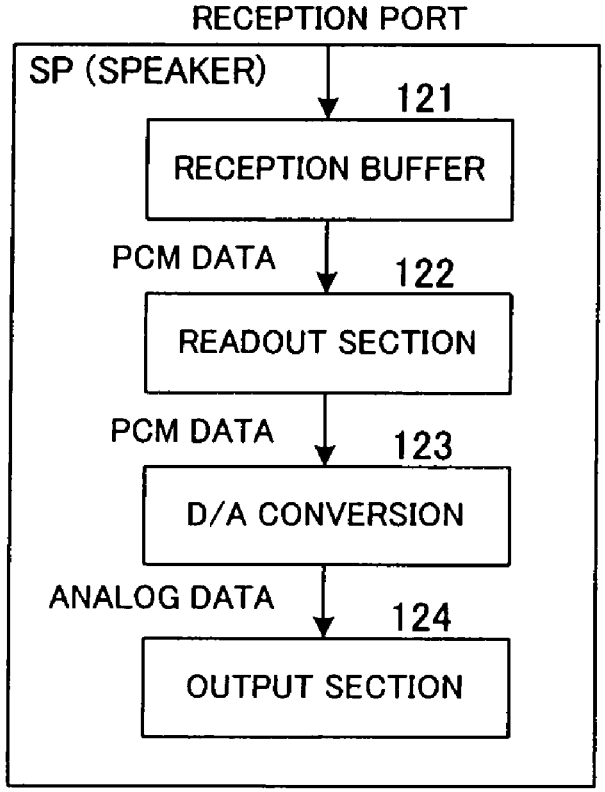
FIG. 25 is a functional block diagram of a speaker element in the tone generation system of the present invention.

FIG. 25 is a functional block diagram of the tone generator element. As shown, the tone generator element TG includes a reception buffer 100 that receives, from the reception port, MIDI data and stores the received data in predetermined processing order, and a readout section 101 that, in accordance with the timing indicated by an internal MIDI clock, sequentially reads out, from the reception buffer 100, the MIDI data to be processed and then supplies the read-out MIDI data to a tone synthesis section 102. The tone synthesis section 102 determines a tone pitch in accordance with note data of the supplied MIDI data, determines a tone color in accordance with program change data of the MIDI data, determines control amounts, such as a tone volume and effect amount, in accordance with control change data of the MIDI data, and generates a tone in the form of PCM data in accordance with the thus-determined information. The tone generator element TG also includes a transmission buffer 103 that stores a plurality of the PCM data, generated by the tone synthesis section 102, in generated order (i.e., in the order the PCM data were generated). The reception buffer 100 receives substantive data (MIDI data) from the reception port of the tone generator element, and the transmission buffer 103 transmits substantive data (PCM data) from the transmission port of the tone generator element. Port number of the reception port is identical to the logical device ID of the tone generator element in question recorded in the device table shown in FIG. 3, and the transmission port is assigned a random port number at the time of transmission; however, the transmission port may be assigned a fixed port number. Further, the PCM data to be transmitted via the transmission buffer 103 may be compressed as MP3 data.

Figure 24:
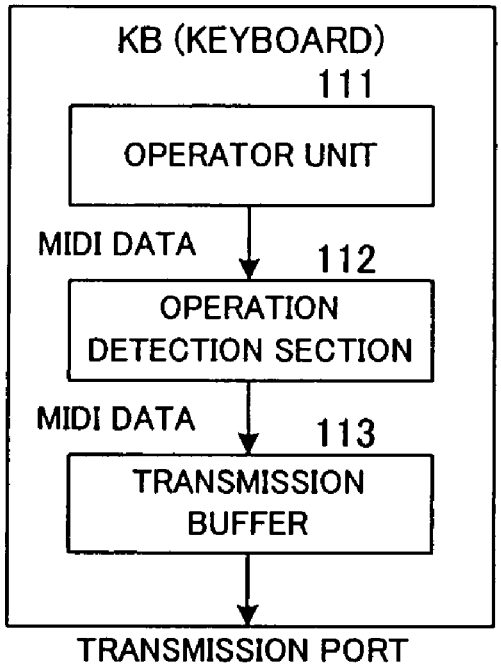
FIG. 24 is a functional block diagram of a keyboard element in the tone generation system of the present invention.

FIG. 24 is a functional block diagram of the keyboard element. As shown, the keyboard element KB includes a hardware operator unit 111, an operation detection section 112 that detects operation on the operator unit 111 to generate timing data of generated MIDI data on the basis of an internal MIDI clock, and a transmission buffer 113 that stores sets of the MIDI data and timing data, supplied from the operation detection section 112, in generated order (i.e., in the order the data were generated). The transmission buffer 113 transmits substantive data in the form of MIDI data from the transmission port of the keyboard element. In the instant embodiment, the transmission port is assigned a random port number at the time of transmission; however, the transmission port may be assigned a fixed port number.

FIG. 25 is a functional block diagram of the speaker element. As shown, the speaker element SP includes a reception buffer 121 that stores PCM data received from the reception port in the processing order, and a readout section 122 that, in accordance with timing of a sampling frequency fs, reads out the PCM data, sample by sample, from the reception buffer 121 and supplies the read-out PCM data to a D/A conversion section 123. The D/A conversion section 123 converts the PCM data, supplied form the readout section 122, into an analog audio signal. The speaker element SP further includes an output section 124 including a speaker that amplifies and audibly generates the audio signal supplied from the D/A conversion section 123. The reception buffer 121 receives the substantive data (PCM data) from the reception port of the speaker element. Port number of the reception port is identical to the logical device ID of the speaker element in question recorded in the device table shown in FIG. 3.

Figure 23:
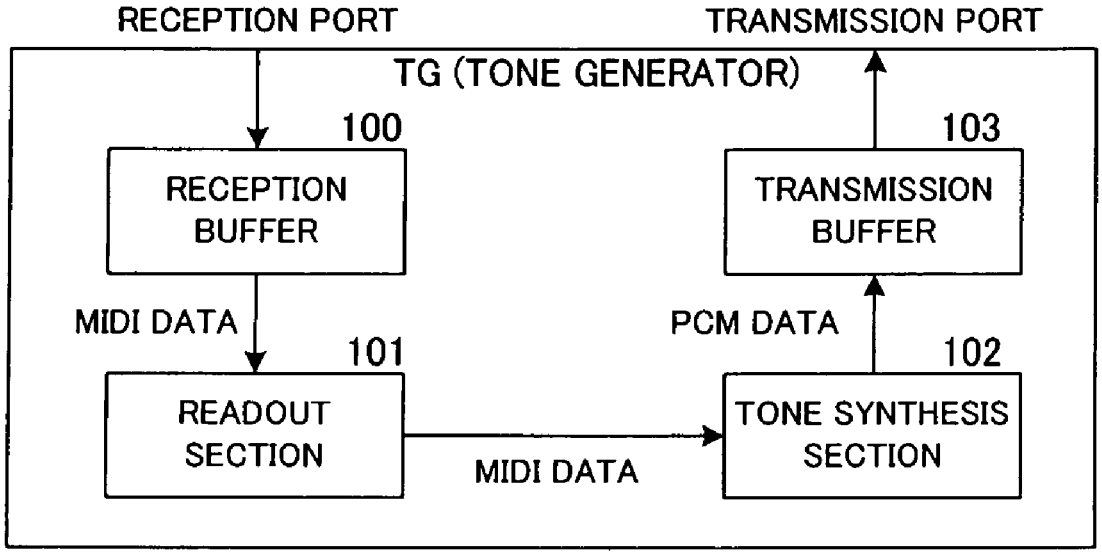
FIG. 23 is a functional block diagram of a tone generator element in the tone generation system of the present invention.
Figure 26:
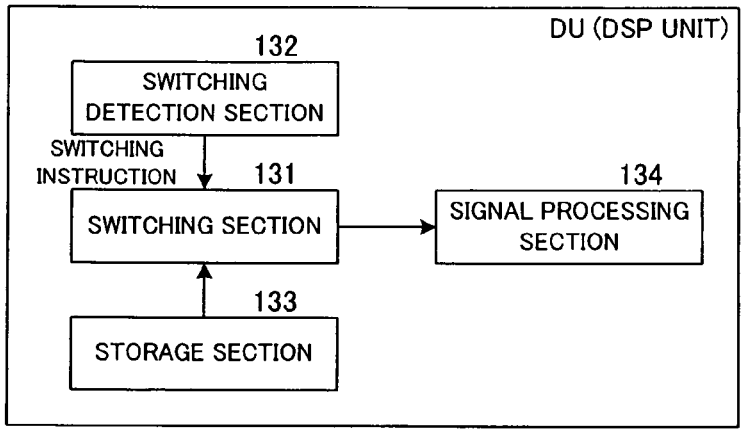
FIG. 26 is a functional block diagram of a DSP unit in the tone generation system of the present invention.

FIG. 26 is a functional block diagram of the DSP unit DU. The DSP unit DU is a processor device and arranged to be capable of switching the processing element functioning therein between a plurality of processing elements. The DSP unit DU includes an internal storage section 133 having stored therein microprograms and parameters of each of the processing elements to be implemented by the DSP to provide the processing element, and a switching detection section 132 that detects a switching instruction and instructs a switching section 131 to effect a processing element switching with designation of a processing element to be newly set. The switching section 131 reads out, from the storage section 133, the microprograms and parameters of the processing element designated by the switching instruction and sets the read-out microprograms and parameters into a signal processing section 134. The signal processing section 134 performs signal processing on the basis of the thus-set microprograms and parameters. By the signal processing section 134 performing the signal processing, the DSP unit DU can function as the processing element corresponding to the read-out microprograms. Namely, the DSP unit DU can function as any one of the processing elements having the function blocks as illustrated in FIGS. 23 to 25. When the processing element has been switched to another one, information of each connection of the previous processing element (i.e., processing element that was functioning before the switching) is deleted from the current buffer, so as to disconnect or cancel each connection of the previous processing element.

Figure 27:
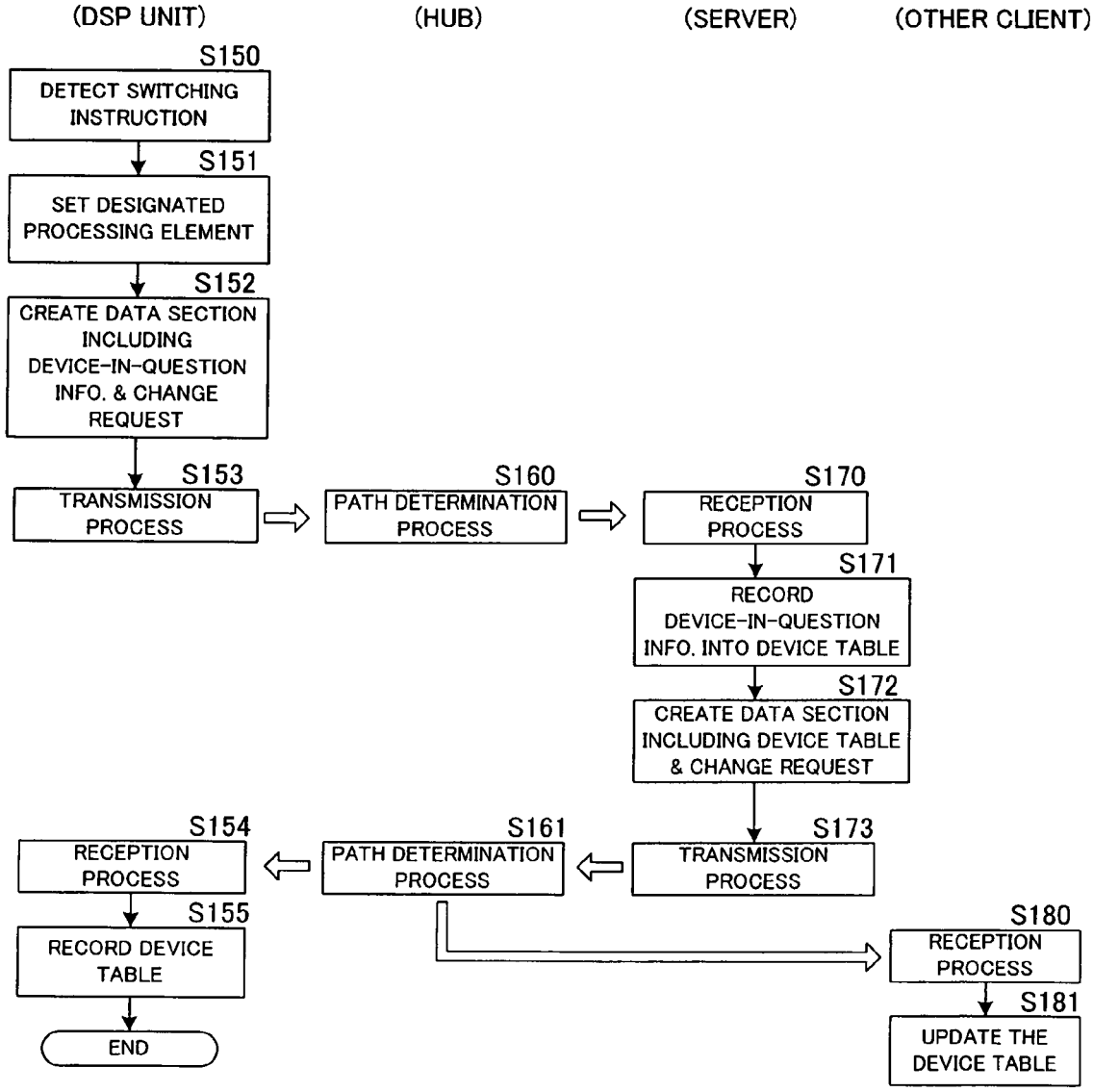
FIG. 27 is a flow chart of informing processing for informing of switching in the DSP unit between processing elements in the tone generation system of the present invention.

FIG. 27 is a flow chart of informing processing for informing of a processing element switch when the processing element functioning in the DSP unit DU has been switched to another processing element.

The informing processing is started once the processing-element witching instruction is detected (step S150). Then, at step S151, the microprograms and parameters to be newly set in accordance with the switching instruction are set, to allow the newly-selected processing element to function. Further, a data section including device-in-question information and change request is created at step S152. In this case, the device-in-question information includes information indicative of the logical device ID, IP address (assigned to the device by the DHCP server when the device logged into the internal network), physical device ID and name of the device, and name and processing ID of the processing element set in the signal processing section 134. The change request is a request that corresponding data of the device table provided in the SV (server) 11 be rewritten with the device-in-question information. Then, a transmission process is performed at step S153. In the transmission process of step S153, the data section created at step S152 is formed into transmitting data, a MAC frame is formed with the transmitting data ultimately capsulated therein as illustrated in FIG. 2, and the thus-formed MAC frame is then transmitted to the internal network. The MAC address (physical device ID) of the SV (server) 11 is set, as a destination MAC address, in the MAC header of the MAC frame.

Because the internal network is a star-type network, the MAC frame transmitted from the DSP unit DU is received by one of the hubs, and a path determination process is performed by the hub (step S161). In the path determination process, the hub determines a transmission path, on the basis of the destination MAC address of the received MAC frame, to relay the MAC frame. As a consequence, the MAC frame transmitted from the DSP unit DU is received by the SV (server) 11 that matches the destination MAC address, and a reception process is performed in the SV (server) 11 (step S170). In the reception process, the IP packet is taken out from the MAC frame, then the TCP segment is taken out from the IP packet, and thence the data section is taken out from the TCP segment. Then, the SV (server) 11 reads the data section and judges, because of the change request present in the data section, that a change process is to be performed. The SV (server) 11 rewrites the device table with the device-in-question information of the DSP unit DU included in the data section at next step S171, and then creates a data section including the changed device table and change request at step S172. The thus-created data section is transmitted to the internal network through a transmission process performed at step S173. This transmission process is similar to the transmission process of step S153, except that an all-one broadcast address (FF-FF-FF-FF-FF-FF) is set as a destination MAC address and a broadcast address is also set as a destination IP address. If the network address of the internal network address is set at "192.168.111.0" as in the device table of FIG. 3, the broadcast address of the IP address is set to "192.168.111.255".

The MAC frame broadcast by the SV (server) 11 is received by one of the hubs, and the hub performs a path determination process (step S161). The path determination process of step S161 is similar to the path determination process of step S160 above; however, at step S161, the MAC frame is relayed to all of the processor devices because the MAC frame has been assigned the broadcast address. Upon receipt of the broadcast MAC frame, the DSP unit DU performs a reception process on the MAC frame of the broadcast address at step S154 in a similar manner to step S170, because of the broadcast address. Then, at step S155, the device table information taken out from the received MAC frame is stored in the internal storage means of the DSP unit DU so that the device table is updated, after which the network connection processing in the DSP unit is brought to an end. Upon receipt of the broadcast MAC frame, the other client performs a reception process on the MAC frame of the broadcast address at step S180 in a similar manner to step S170. At next step S181, the other client updates the stored device table in accordance with device table information taken out from the received MAC frame, after which the network connection processing in the other client is brought to an end.

Figure 28:
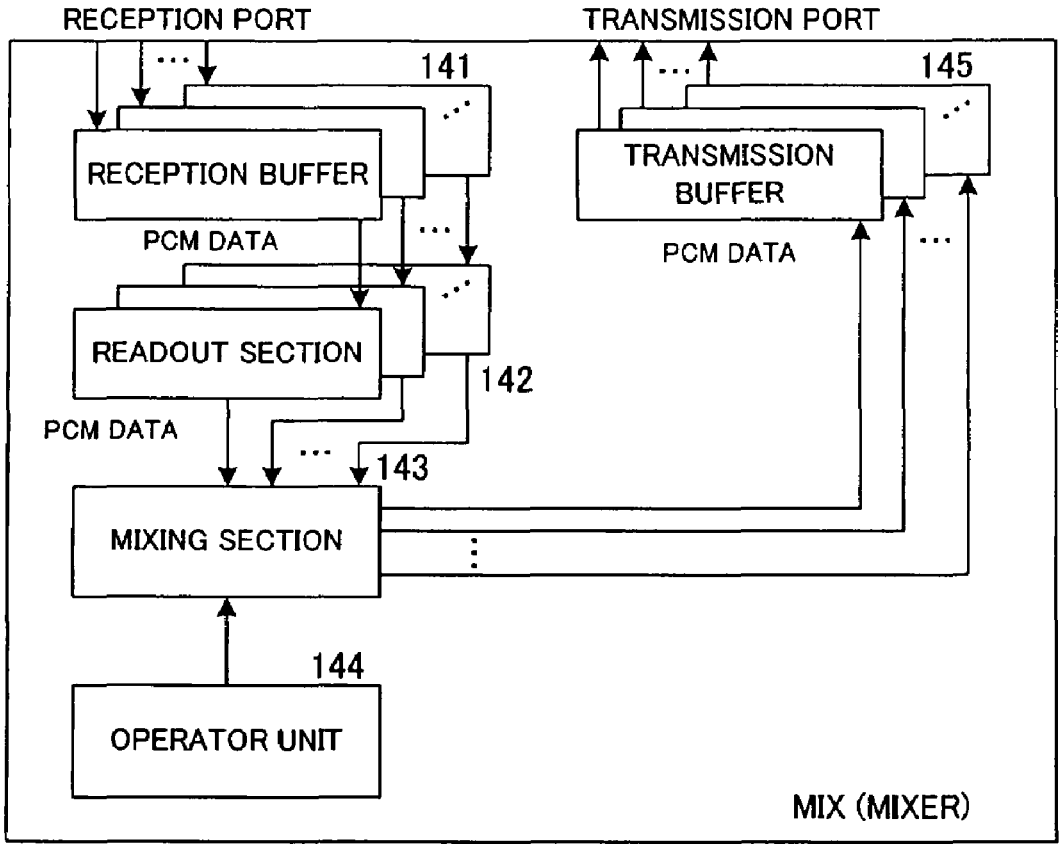
FIG. 28 is a functional block diagram of a mixer element in the tone generation system of the present invention.

FIG. 28 is a functional block diagram of the mixer element. As shown, the mixer element MX includes reception buffers 141 provided, in corresponding relation to receiving channels, for receiving PCM data from reception ports and recording the received PCM data in predetermined processing order, and readout sections 142 provided, in corresponding relation to the receiving channels, for, in accordance with timing of a sampling frequency fs, reading out the PCM data, sample by sample, from the reception buffers 141 and supplies the readout PCM data to a mixing section 143. The mixing section 143 mixes (signal-processes) the PCM data, input from the reception buffers 141, in accordance with settings of various parameters input via an operator unit 144 operable to set various parameters. The mixer element MX further includes transmission buffers 145 provided, in corresponding relation to transmitting channels, for recording the PCM data, output from the mixing section 143, in generated order. The reception buffers 141 receive substantive data (PCM data) from the reception ports of the mixer element, and the transmission buffers 145 transmit substantive data (PCM data) via the transmission ports of the mixer element. Port numbers of the reception ports are the logical device ID of the corresponding processing element recorded in the device table of FIG. 3, and the transmission ports are assigned random port numbers at the time of transmission although may be assigned fixed port numbers.

Figure 29:
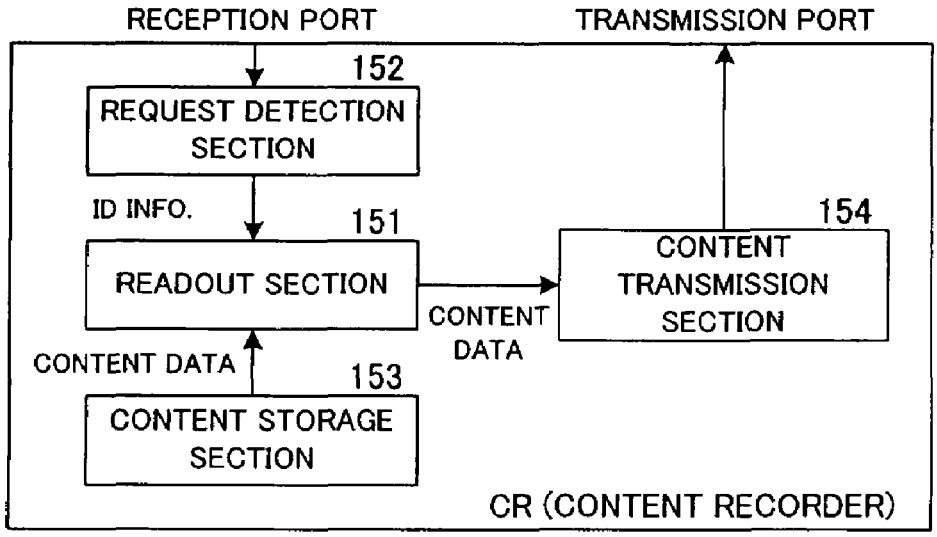
FIG. 29 is a functional block diagram of a content recorder element in the tone generation system of the present invention.

FIG. 29 is a functional block diagram of the content recorder element. Data to be communicated by the content recorder element CR are control data rather than substantive data, and a control data port rather than a substantive data port is used in communication between the content recorder element and another processing element. In this case, the processing element (processor device) requesting the content may be caused to display a screen necessary for acquisition of content so that the user can select, on the screen, desired content. Communication of the control data can be performed using a "GET" request method included in the HTTP protocol to request a file.

The processing element (processor device) requesting the content of the content recorder element CR transmits control data after putting a content request and content data identification information in the data section of the control data to be transmitted. Here, the content is a file to be used in a particular processing element, such as a file of a song, style and voice. The content recorder element CR includes a request detection section 152 that detects (receives) a content request input via the reception port and supplies a readout section 151 with the content request and content data identification information, and the readout section 151 reads out, from a content storage section 153, the content data corresponding to the identification information and passes the read-out content data to a content transmission section 154. The content storage section 153 has stored therein a plurality of content data along with respective identification information, and the content transmission section 154 transmits the read-out content data via the transmission port. Port number of the reception port is identical to the logical device ID of the corresponding content recorder element CR recorded in the device table of FIG. 3, and the transmission port is assigned a random port number at the time of transmission; however, the transmission port may be assigned a fixed port number.

Figure 30:
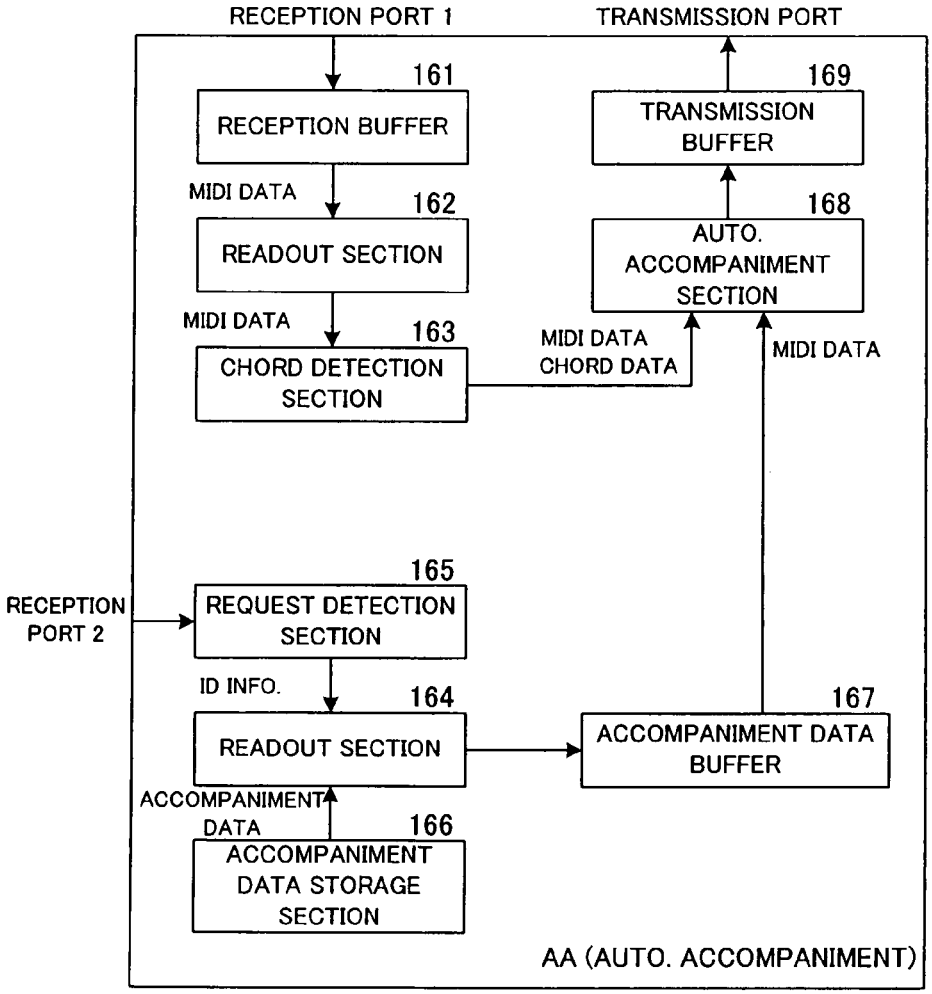
FIG. 30 is a functional block diagram of an automatic accompaniment element in the tone generation system of the present invention.

FIG. 30 is a functional block diagram of the automatic accompaniment element. The automatic accompaniment element AA is arranged to, in accordance with an accompaniment data request from another processing element, edit designated accompaniment data on the basis of performance data and transmits the edited accompaniment data to the other processing element. The automatic accompaniment request data is communicated using a control-data communicating port rather than a substantive-data communicating port. In this case, the processor device, where the accompaniment-data requesting processing element is functioning, may be caused to display a screen necessary for requesting of an automatic accompaniment so that the user can select, on the screen, an automatic accompaniment and transmission destination of the accompaniment data. The communication for the accompaniment data request and acquisition may be performed using the HTTP protocol.

The automatic accompaniment element AA includes: a reception buffer 161 that receives MIDI data (performance data) from the reception port; a readout section 162 that, in accordance with timing of an internal MIDI clock of the automatic accompaniment element AA, reads out, from the reception buffer 161, the MIDI data (performance data) to be processed; and a chord detection section 163 that detects a chord in the MIDI data (performance data) on the basis of note-on and note-off event data included in the MIDI data (performance data).

The processing element (processor device), requesting the automatic accompaniment of the automatic accompaniment element AA, transmits control data after putting an accompaniment data request and accompaniment data identification information in the data section of the control data. The automatic accompaniment element AA also includes a request detection section 165 that, when the accompaniment data request has been detected (received) from "reception port 2", passes, to a readout section 164, the received accompaniment data request and automatic accompaniment identification information. The readout section 164 reads out, from an accompaniment data storage section 166 having stored therein a plurality of sets of accompaniment data, a set of accompaniment data corresponding to the identification information and passes the read-out accompaniment data to an accompaniment data buffer 167. The accompaniment data buffer 167 in turn records the accompaniment data read out from the accompaniment data storage section 166. Note that the accompaniment data set is in the form of a file having accompaniment-reproducing MIDI data recorded therein in predetermined processing order.

The chord detection section 163 passes the detected chord data and supplied MIDI data (performance data) to an automatic accompaniment section 168, and the accompaniment data buffer 167 passes the MIDI data (accompaniment data) to the automatic accompaniment section 168. The automatic accompaniment section 168 sequentially reads out, in accordance with the timing of the internal MIDI clock of the automatic accompaniment element AA, the to-be-processed MIDI data (accompaniment data) from the accompaniment data buffer 167. If the read-out MIDI data (accompaniment data) is note-on event data, the note number is modified in accordance with the current chord data passed from the chord detection section 163, and then the modified or read-out MIDI data (accompaniment data) and the MIDI data (performance data) received from the chord detection section 163 are passed to a transmission buffer 169 along with timing data indicative of processing timing of the individual data. The transmission buffer 169 records therein the MIDI data and timing data, supplied from the automatic accompaniment section 168, in predetermined processing order and transmits the MIDI data and timing data, via the transmission port, to the processing element identified by the destination IP address and port number included in the accompaniment data request. The port number of "reception port 1", which is a reception port of substantive data (MIDI data), is identical to the logical device ID of the automatic accompaniment element AA in question recorded in the device table shown in FIG. 3, and the port number of "reception port 2" is identical to the port number assigned in advance to the control data (generally, in the case of the HTTP protocol, a port number "80" is assigned although the present invention is not so limited), and the transmission port, which is a transmission port of substantive data (MIDI data), is assigned a random port number at the time of transmission; however, the transmission port may be assigned a fixed port number.

Figure 31:
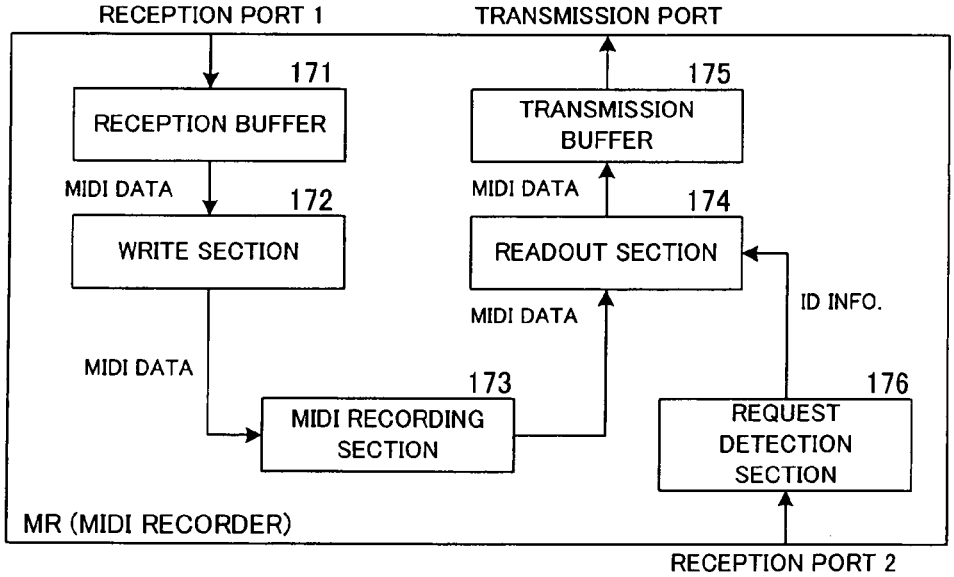
FIG. 31 is a functional block diagram of a MIDI recorder element in the tone generation system of the present invention.

FIG. 31 is a functional block diagram of the MIDI recorder element. The MIDI recorder element MR is arranged to record therein received MIDI data and transmit the recorded MIDI data to a destination processing element (processor device) in response to a readout request.

The MIDI recorder element MR includes a reception buffer 171 that receives MIDI data from "reception port 1" and records therein the received MIDI data in predetermined processing order, and a write section 172 that reads out the MIDI data from the reception buffer 171 and writes sets of MIDI event data and timing data, indicative of processing timing of the MIDI event data, into a MIDI recording section 173 in predetermined processing order. Further, the processing element (processor device), requesting the MIDI data (performance data) of the MIDI recorder element MR, transmits control data after putting a readout request and MIDI file identification information in the data section of the control data. In this case, the processor device, where the readout requesting processing element is functioning, may be caused to display a screen necessary for the readout request so that the user can select, on the screen, a MIDI file and transmission destination of the MIDI file. The communication for the readout request and acquisition may be performed using the HTTP protocol.

The MIDI recorder element MR also includes a request detection section 176 that, when the readout request has been detected (received) from "reception port 2", passes, to a readout section 174, the received readout request and MIDI file identification information. The readout section 174 reads out, in accordance with timing of an internal MIDI clock of the MIDI recorder element MR, the to-be-processed MIDI data from the MIDI recording section 173 and supplies the readout MIDI data to a transmission buffer 175 that in turn records therein the supplied MIDI data and timing data in predetermined processing order. The transmission buffer 175 transmits the recorded MIDI data and timing data, via the transmission port, to the processing element identified by the destination IP address and port number included in the readout request. The port number of "reception port 1", which is a reception port of substantive data (MIDI data), is identical to the logical device ID of the MIDI recorder element MR in question recorded in the device table shown in FIG. 3, and the port number of "reception port 2" is identical to the port number assigned in advance to the control data (generally, in the case of the HTTP protocol, a port number "80" is assigned although the present invention is not so limited), and the transmission port, which is a transmission port of substantive data (MIDI data), is assigned a random port number at the time of transmission; however, the transmission port may be assigned a fixed port number.

Figure 32:
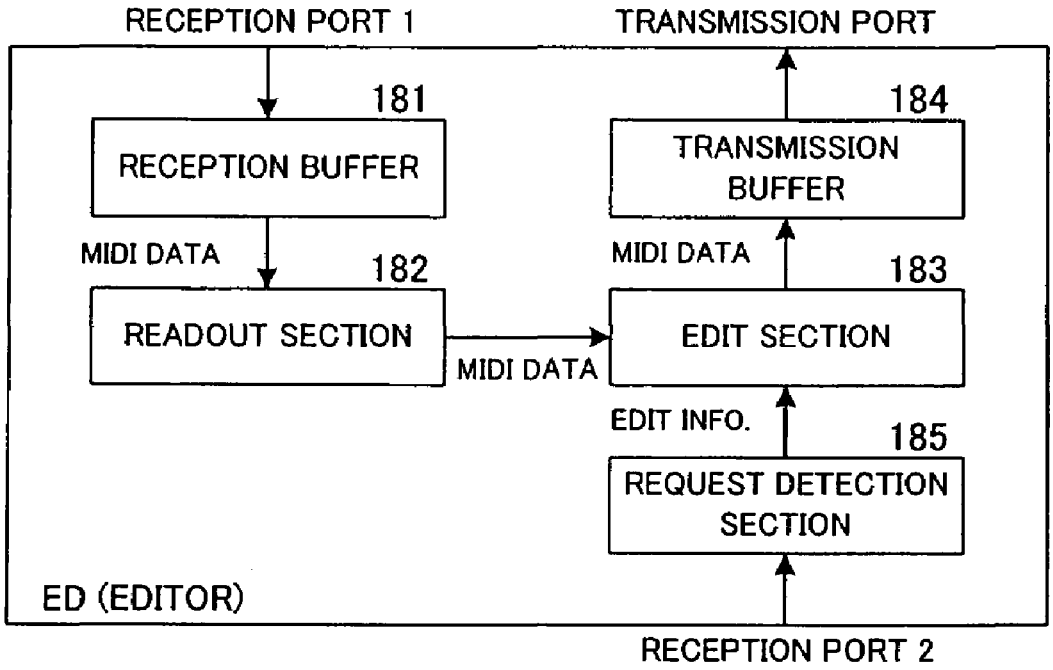
FIG. 32 is a functional block diagram of an editor element in the tone generation system of the present invention.

FIG. 32 is a functional block diagram of the editor element. The editor element ED is arranged to edit received MIDI data in accordance with a setting request and transmit the edited MIDI data to a destination processing element (processor device) in response to the setting request.

The editor element ED includes a reception buffer 181 that receives MIDI data from "reception port 1" and records therein the received MIDI data in predetermined processing order, and a readout section 182 that reads out the to-be-processed MIDI data from the reception buffer 181 in accordance with timing of an internal MIDI clock of the editor element ED and passes the read-out MIDI event data to an editing section 183. Processing element, requesting the editor element ED to perform edit setting, transmits control data after putting the setting request and edit information in the data section of the control data. In this case, the processor device, where the setting requesting processing element is functioning, may be caused to display a screen necessary for the setting request so that the user can set, on the screen, contents of editing to be performed. The communication for the setting request may be performed using the HTTP protocol. The aforementioned "edit information" is information indicative of contents of editing to be made.

The editor element ED also includes a request detection section 185 that, when the setting request has been detected (received) from "reception port 2", passes the received setting request and edit information to the editing section 183. The editing section 183 performs editing on the MIDI data, passed from the readout section 182, on the basis of the edit information passed from the request detection section 185 and then delivers the thus-edited MIDI data to a transmission buffer 184. The transmission buffer 184 records therein the edited MIDI data, passed from the editing section 183, and timing data in predetermined processing order. In the case of automatic composition, the editing section 183 creates, from the read-out MIDI data (phrase), MIDI data representative of a single music piece on the basis of the edit information and then passes the thus-created MIDI data to the transmission buffer 184. In the case of automatic arrangement, the editing section 183 arranges the read-out MIDI data (melody) on the basis of the edit information to create MIDI data representative of an orchestra music piece and then passes the thus-created MIDI data to the transmission buffer 184 for buffering. The transmission buffer 184 transmits the buffered MIDI data and timing data, via the transmission port, to the processing element identified by the destination IP address and port number included in the setting request. The port number of "reception port 1", which is a reception port of substantive data (MIDI data), is identical to the logical device ID of the editor element ED in question recorded in the device table shown in FIG. 3, and the port number of "reception port 2" is identical to the port number assigned in advance to the control data (generally, in the case of the HTTP protocol, a port number "80" is assigned although the present invention is not so limited), and the transmission port, which is a transmission port of substantive data (MIDI data), is assigned a random port number at the time of transmission; however, the transmission port may be assigned a fixed port number.

Figure 33:
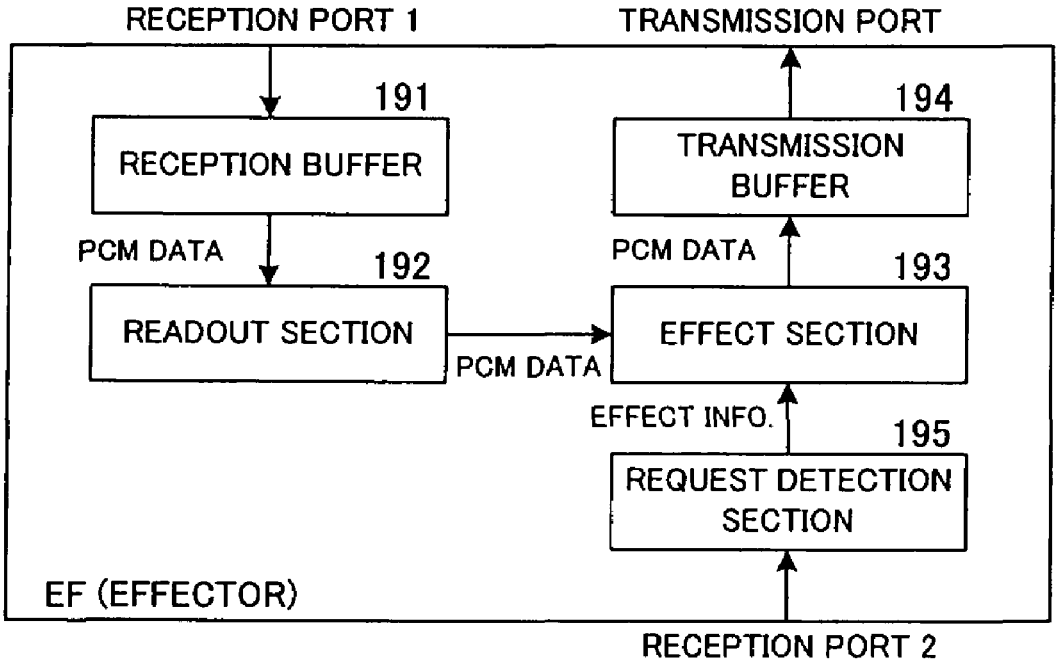
FIG. 33 is a functional block diagram of an effector element in the tone generation system of the present invention.

FIG. 33 is a functional block diagram of the effector element. The effector element EF is arranged to impart an effect to received PCM data and then transmits the effect-imparted PCM data to a destination processing element (processor device) in response to the setting request.

The effector element EF includes a reception buffer 191 provided, for each not-shown receiving channel (input channel), for receiving PCM data from "reception port 1" and recording the received PCM data in predetermined processing order, and a readout section 192 for, in accordance with timing of a sampling frequency fs, reading out the PCM data, sample by sample, from the reception buffers 191 and supplies the read-out PCM data to an effect section 193. Processing element processor device), requesting the effector element EF to set an effect, transmits control data after putting the setting request and effect information in the data section of the control data. In this case, the processor device, where the setting requesting processing element is functioning, may be caused to display a screen necessary for the setting request so that the user can set, on the screen, contents of an effect to be imparted. The communication for the setting request may be performed using the HTTP protocol. The aforementioned "effect information" is information indicative of the contents of the effect to be imparted or set.

The effector element EF also includes a request detection section 195 that, when the setting request has been detected (received) from "reception port 2", passes the received setting request and effect information to the effect section 193. The effect section 193 imparts an effect to the PCM data read out by the readout section 192 to create new (i.e., effect-imparted) PCM data and passes the created PCM data to a not-shown transmission buffer 194, provided for each transmitting channel, to recorded therein the PCM data and timing data, passed from the effect section 193, in processing order. Effect to be imparted by the effect section 193 is set (determined) on the basis of the effect information, so that a desired effect, such as reverberation or chorus, is imparted to the PCM data. The transmission buffer 194 transmits the recorded PCM data, via the transmission port, to the processing element identified by the destination IP address and port number included in the setting request. The port number of "reception port 1", which is a reception port of substantive data (PCM data), is identical to the logical device ID of the effector element EF in question recorded in the device table shown in FIG. 3, and the port number of "reception port 2" is identical to the port number assigned in advance to the control data (generally, in the case of the HTTP protocol, a port number "80" is assigned although the present invention is not so limited), and the transmission port, which is a transmission port of substantive data (PCM data), is assigned a random port number at the time of transmission; however, the transmission port may be assigned a fixed port number.

Figure 34:
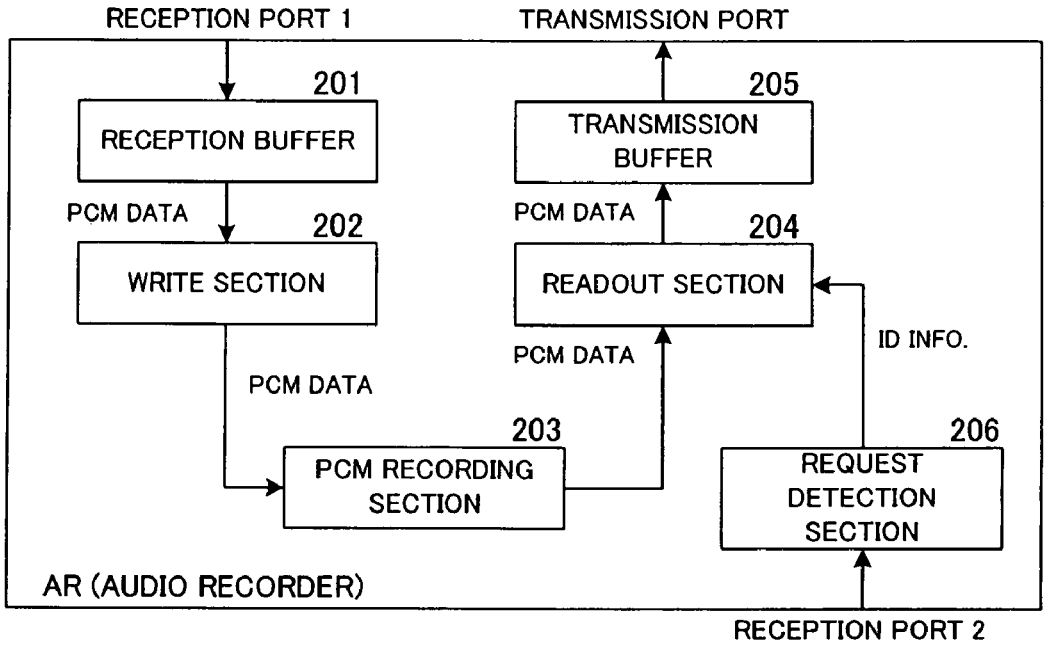
FIG. 34 is a functional block diagram of an audio recorder element in the tone generation system of the present invention.

FIG. 34 is a functional block diagram of the audio recorder element. The audio recorder element AR is arranged to record therein received PCM data and transmit the recorded PCM data to a destination processing element (processor device) in response to a readout request.

The audio recorder element AR includes a reception buffer 201 that receives PCM data from "reception port 1" and records therein the received PCM data in predetermined processing order, and a write section 203 that reads out the PCM data from the reception buffer 201 and writes the read-out PCM data, as a PCM file, into a PCM recording section 203. Further, the processing element (processor device), requesting the PCM data from the audio recorder element AR, transmits control data after putting the readout request and PCM file identification information in the data section of the control data. In this case, the processor device, where the readout requesting processing element is functioning, may be caused to display a screen necessary for the readout request so that the user can select, on the screen, a PCM file and transmission destination of the PCM file. The communication for the readout request and PCM data acquisition may be performed using the HTTP protocol.

The audio recorder element AR includes a request detection section 206 that, when the readout request has been detected (received) from "reception port 2", passes, to a readout section 204, the received readout request and PCM file identification information. The readout section 204 reads out, from the PCM recording section 203 and in accordance with timing of a sampling frequency fs, the PCM data corresponding to the identification information and supplies the read-out PCM data to a transmission buffer 205 that in turn records therein the supplied PCM data in predetermined processing order. The transmission buffer 205 transmits the recorded PCM data, via the transmission port, to the processing element identified by the destination IP address and port number included in the readout request. The port number of "reception port 1", which is a reception port of substantive data (PCM data), is identical to the logical device ID of the audio recorder element AR in question recorded in the device table shown in FIG. 3, and the port number of "reception port 2" is identical to the port number assigned in advance to the control data (generally, in the case of the HTTP protocol, a port number "80" is assigned although the present invention is not so limited), and the transmission port, which is a transmission port of substantive data (PCM data), is assigned a random port number at the time of transmission; however, the transmission port may be assigned a fixed port number.

Figure 35:
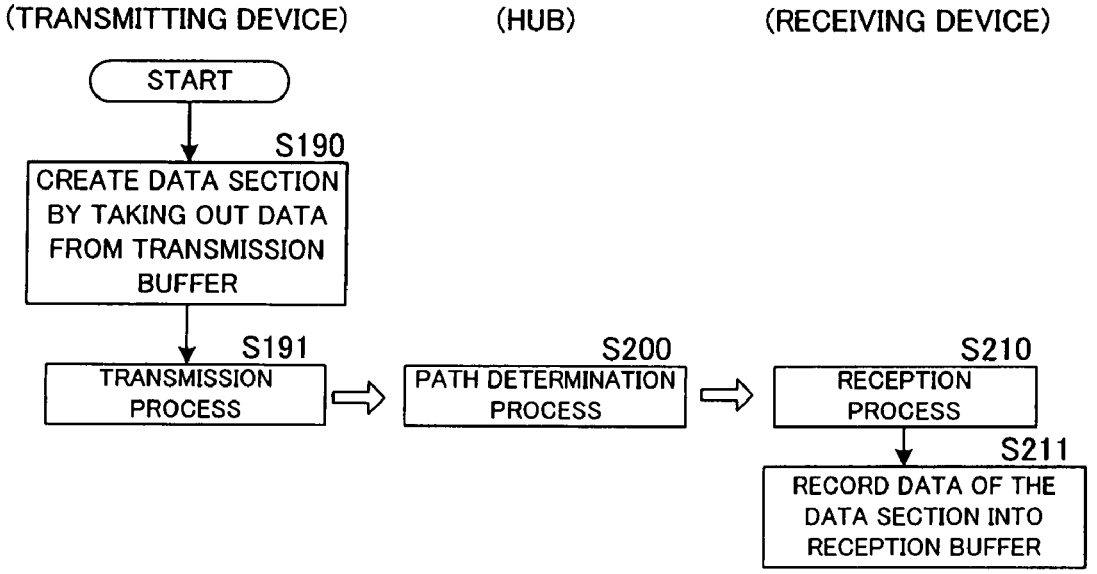
FIG. 35 is a flow chart of communication processing performed to communicate substantive data in the tone generation system of the present invention.

FIG. 35 is a flow chart of communication processing performed to communicate substantive data.

To communicate substantive data, the communication processing is started up in a processor device from which the substantive data are to be transmitted. At step S190, a data section is created by data being read out from the transmission buffer. Then, a transmission process is performed at step S191, where the data section created at step S190 is formed into transmitting data, a MAC frame is formed with the transmitting data ultimately capsulated therein as illustrated in FIG. 2 and the thus-formed MAC frame is then transmitted to the internal network. The MAC address (physical device ID) of the destination processor device, receiving the substantive data, is set, as a destination MAC address, in the MAC header of the MAC frame.

Because the internal network is a star-type network, the transmitted MAC frame is received by one of the hubs, and a path determination process is performed by the hub (step S200). In the path determination process, the hub determines a transmission path, on the basis of the destination MAC address of the received MAC frame, to relay the MAC frame. As a consequence, the MAC frame transmitted from the transmitted-from processing element is received by the processor device matching the destination MAC address (step S210). In the reception process, the IP packet is acquired from the MAC frame, then the TCP segment is taken out from the IP packet, and thence the data section is acquired from the TCP segment. The data section acquired at step S211 is recorded into the reception buffer of the receiving processor device; communication of the data section is performed using ports established for transmission of the substantive data and recorded in the current buffer.

Whereas the preferred embodiment of the present invention has been described above in relation to the case where the internal network is in the form of an Ethernet LAN, the present invention is not so limited, and the internal network may be in the form of any other suitable network medium. Further, the communication protocol for use in the present invention may be other than the TCP protocol. For example, in cases where a more importance is put on realtimeness, there may be used UDP (User Datagram Protocol) that permits higher transmission speeds although it is less reliable, or TCP/IP may be replaced with IPX/SPX (Internetwork Packet Exchange/Sequence Packet Exchange).

Further, the edit information of the editor element and the effect information of the effector element may be transmitted from another processing element after having been set in the other processing element. In this way, the editor element and effector element can be manipulated from a room where the speaker element is located; thus, the editor element and effector element can be manipulated as if these elements were located in the same room as the speaker element, which can achieve enhanced operability.

Furthermore, the timing for disconnecting between a plurality of processing elements in a given processor device is not limited to the time when the given processor device is connected to the network, and the disconnection may be permitted at any desired timing after the connection, to the network, of the given processor device. In such a case, arrangements may be made such that a process for checking when a disconnection instruction has been given is periodically performed periodically, after the connection to the network, so that the connection between the processing elements in the processor device can be canceled when a disconnection instruction has been detected. Such a disconnection instruction may be given via a particular disconnection-instructing switch. Further, such a disconnection instruction may be given from another processor device resident in the network than the processor device in question.

What is claimed is:

1. A tone generation system comprising:

a plurality of processor devices connected to a star-type network, each processor device including one or more types of programs, each type of program corresponding to a function of a processing element of said tone generation system, the types of programs including a first type of program executable to cause the processor device to function as a performance-information-generating processing element that creates a frame including generated performance information and respective identification information of a source processing element and destination processing element and transmits the created frame to the network, a second type of program executable to cause the processor device to function as a tone-generator-providing processing element that receives a frame matching identification information of the processing element functioning in the processor device, synthesizes a tone signal on the basis of performance information taken out from the received frame, creates a frame including the synthesized tone signal and respective identification information of a source processing element and destination processing element and transmits to the network the frame created thereby, and a third type of program executable to cause the processor device to function as a sounding processing element that receives a frame matching identification information of the processing element functioning in the processor device and performs a sounding process on a tone signal taken out from the received frame, wherein two or more of the processor devices each possess a content file related to tone generation, and each of the processor devices has a table storing, for each of the processor devices, information indicating whether the content file possessed thereby can be supplied to another one of said processor devices, and wherein each of said processor devices is adapted to:

receive a request for selecting a content file;

determine whether or not a content file corresponding to the received request is possessed thereby; and if the content file corresponding to the received request is not possessed thereby, extract, from the table, any other processor device capable of supplying the content file corresponding to the received request, transmits an acquisition request of the content file to the extracted other processor device via the network, and receive, via the network, the content file transmitted by the other processor device in response to the acquisition request.

2. A tone generation system as claimed in claim 1 wherein the content file related to tone generation is a tone-synthesizing tone color data file.

3. A tone generation system including a plurality of processor devices connected to a star-type network, individual ones of the processor devices being arranged to function as processing elements corresponding to respective programs executed, said tone generation system comprising at least:

a first processor device functioning as a performance-information-generating processing element that creates a frame including generated performance information and respective identification information of a source processing element and destination processing element and transmits the created frame to the network;

a second processor device functioning as a tone-generator-providing processing element that receives a frame matching identification information of the processing element functioning in said second processor device, synthesizes a tone signal on the basis of performance information taken out from the received frame, creates a frame including the synthesized tone signal and respective identification information of a source processing element and destination processing element and transmits to the network the frame created thereby; and a third processor device functioning as a sounding processing element that receives a frame matching identification information of the processing element functioning in said third processor device and performs a sounding process on a tone signal taken out from the received frame, said tone generation system further comprising:

a connection selection device operable, in response to operation by a user, to not only select a plurality of processing elements and set a logical connection between the selected processing elements but also select a processor device to function as a processing element in the set logical connection; and a control device that, 1) if the selected processor device is in a state incapable of establishing a new connection, determines whether the selected processor device may be replaced with another processor device, 2) if the selected processor device may be replaced with another processor device, searches for another processor device capable of functioning as the same processing element as the selected processor device does, and 3) if the searched-out other processor device is in a state capable of establishing a new connection, determines the searched-out other processor device as the processor device to function as the processing element in the set logical connection in place of the selected processor device.

4. A tone generation system as claimed in claim 3 which includes a table storing, for each of the processor devices, information indicating whether or not a function of a processing element possessed thereby can be performed by another processor device than the processor device, and said control device determines, by referring to the table, whether the selected processor device may be replaced with another processor device.

5. A tone generation system as claimed in claim 3 wherein each of the processor devices includes said connection selection device and said control device, and said control device in the processor device having been operated by a user and said control device included in the selected processor device are activated.

6. A tone generation system including a plurality of processor devices connected to a star-type network, individual ones of the processor devices being arranged to function as processing elements corresponding to respective programs executed, said tone generation system comprising at least:

a first processor device functioning as a performance-information-generating processing element that creates a frame including generated performance information and respective identification information of a source processing element and destination processing element and transmits the created frame to the network;

a second processor device functioning as a tone-generator-providing processing element that receives a frame matching identification information of the processing element functioning in said second processor device, synthesizes a tone signal on the basis of performance information taken out from the received frame, creates a frame including the synthesized tone signal and respective identification information of a source processing element and destination processing element and transmits to the network the frame created thereby; and a third processor device functioning as a sounding processing element that receives a frame matching identification information of the processing element functioning in said third processor device and performs a sounding process on a tone signal taken out from the received frame, said tone generation system further comprising:

a connection control device that sets a logical connection between the processing elements, establishes a connection between the processor devices to function as the processing elements in the set logical connection, and thereby builds a signal path for tone generation in said tone generation system;

a default memory that is provided for each of the processor devices and stores default information indicative of logical connections between one or more processing elements the processor device is functioning as and one or more processing elements in the network; and a restoration control device that, when any one of the processor devices has logged into the network, automatically restores logical connections between one or more processing elements of the processor device having logged into the network and one or more processing elements in the network on the basis of the default information stored in said default memory of the processor device having logged into the network, said restoration control device determining, for each of the processing elements of the processor device having logged into the network, whether or not another processing element, selected as a connection partner to be connected with the processing element, is available and then restoring only the logical connection to the available processing element.

7. A tone generation system as claimed in claim 6 wherein, when the logical connection building the signal path has been changed in said connection control device in response to operation by a user, said default memory stores information indicative of a state of the changed logical connection as default information, to thereby update the default information stored therein, and wherein the default information stored in said default memory is not updated when a logical connection is automatically restored by said restoration control device, on the basis of the default information, in response to any one of the processor devices logging into the network.

8. A tone generation system as claimed in claim 6 which further comprises a display control device that presents, to a user, a display indicating that no default connection has been made, when none of the logical connections between the processing elements, indicated by the information stored in said default memory of the processor device having logged into the network, has been restored by said restoration control device.

9. A network processing method for use in a tone generation system including a plurality of processor devices connected to a star-type network, each processor device including one or more types of programs, each type of program corresponding to a function of a processing element of said tone generation system, the types of programs including a first type of program executable to cause the processor device to function as a performance-information-generating processing element that creates a frame including generated performance information and respective identification information of a source processing element and destination processing element and transmits the created frame to the network, a second type of program executable to cause the processor device to function as a tone-generator-providing processing element that receives a frame matching identification information of the processing element functioning in the processor device, synthesizes a tone signal on the basis of performance information taken out from the received frame, creates a frame including the synthesized tone signal and respective identification information of a source processing element and destination processing element and transmits to the network the frame created thereby, and a third type of program executable to cause the processor device to function as a sounding processing element that receives a frame matching identification information of the processing element functioning in the processor device and performs a sounding process on a tone signal taken out from the received frame, wherein two or more of the processor devices each possess a content file related to tone generation, and each of the processor devices has a table storing, for each of the processor devices, information indicating whether the content file possessed thereby can be supplied to another one of the processor devices, said network processing method comprising:

a step of any one of the processor devices receiving a request for selecting a content file;

a step of the processor device, having received the request for selecting a content file, determining whether or not a content file corresponding to the received request is possessed thereby; and a step of, if the content file corresponding to the received request is not possessed by the processor device having received the request, the processor device having received the request, extracting, from the table, any other processor device capable of supplying the content file corresponding to the received request, transmitting an acquisition request of the content file to the extracted other processor device via the network, and receiving, via the network, the content file transmitted by the other processor device in response to the acquisition request.

10. A network processing method for use in tone generation system including a plurality of processor devices connected to a star-type network, individual ones of the processor devices being arranged to function as processing elements corresponding to respective programs executed, said plurality of processor devices including at least:

a first processor device functioning as a performance-information-generating processing element that creates a frame including generated performance information and respective identification information of a source processing element and destination processing element and transmits the created frame to the network;

a second processor device functioning as a tone-generator-providing processing element that receives a frame matching identification information of the processing element functioning in said second processor device, synthesizes a tone signal on the basis of performance information taken out from the received frame, creates a frame including the synthesized tone signal and respective identification information of a source processing element and destination processing element and transmits to the network the frame created thereby; and a third processor device functioning as a sounding processing element that receives a frame matching identification information of the processing element functioning in said third processor device and performs a sounding process on a tone signal taken out from the received frame, said network processing method comprising:

a step of, in response to operation by a user, not only selecting a plurality of processing elements and setting a logical connection between the selected processing elements but also selecting a processor device to function as a processing element in the set logical connection; and a step of, 1) if the selected processor device is in a state incapable of establishing a new connection, determining whether the selected processor device may be replaced with another processor device, 2) if the selected processor device may be replaced with another processor device, searching for another processor device capable of functioning as the same processing element as the selected processor device does, and 3) if the searched-out other processor device is in a state capable of establishing a new connection, determining the searched-out other processor device as the processor device to function as the processing element in the set logical connection in place of the selected processor device.

11. A network processing method for use in a tone generation system including a plurality of processor devices connected to a star-type network, individual ones of the processor devices being arranged to function as processing elements corresponding to respective programs executed, said plurality of processor devices including at least:

a first processor device functioning as a performance-information-generating processing element that creates a frame including generated performance information and respective identification information of a source processing element and destination processing element and transmits the created frame to the network;

a second processor device functioning as a tone-generator-providing processing element that receives a frame matching identification information of the processing element functioning in said second processor device, synthesizes a tone signal on the basis of performance information taken out from the received frame, creates a frame including the synthesized tone signal and respective identification information of a source processing element and destination processing element and transmits to the network the frame created thereby; and a third processor device functioning as a sounding processing element that receives a frame matching identification information of the processing element functioning in said third processor device and performs a sounding process on a tone signal taken out from the received frame, said network processing method comprising:

a step of setting a logical connection between the processing elements, establishing a connection between the processor devices to function as the processing elements in the set logical connection, and thereby building a signal path for tone generation in the tone generation system;

a step of storing, in a default memory that is provided for each of the processor devices, default information indicative of logical connections between one or more processing elements the processor device is functioning as and one or more processing elements in the network; and a restoration control step of, when any one of the processor devices has logged into the network, automatically restoring logical connections between one or more processing elements of the processor device having logged into the network and one or more processing elements in the network on the basis of the default information stored in the default memory of the processor device having logged into the network, said restoration control step determining, for each of the processing elements of the processor device having logged into the network, whether or not another processing element, selected as a connection partner to be connected with the processing element, is available and then restoring only the logical connection to the available processing element.

* * * * *